United States Patent [19]

Crowe et al.

[11] Patent Number: 4,996,821

[45] Date of Patent: Mar. 5, 1991

[54] PARTITION FORMING AND INSERTING MACHINE

[75] Inventors: Norman P. Crowe; Robert A. McCulley; Joseph C. Drilling, all of Miami Township, Clermont County, Ohio

[73] Assignee: The International Paper Box Machine Company, Inc., Milford, Ohio

[21] Appl. No.: 314,634

[22] Filed: Feb. 22, 1989

[51] Int. Cl.[5] ..... B65B 62/20; B65B 43/10

[52] U.S. Cl. ..... 53/139.5; 53/157; 53/263; 493/90

[58] Field of Search ..... 53/263, 128, 157, 238, 53/474, 48; 493/90, 91, 92

[56] References Cited

U.S. PATENT DOCUMENTS

| | | | |
|---|---|---|---|
| 3,359,873 | 12/1967 | Carle et al. | 493/91 X |
| 3,473,295 | 10/1969 | Nigrelli et al. | 53/157 X |
| 4,023,328 | 5/1977 | Calvert et al. | 53/157 |
| 4,070,850 | 1/1978 | Cunningham | 53/48 |
| 4,154,148 | 5/1979 | Weremiczyk et al. | 493/90 |
| 4,283,188 | 8/1981 | Wingerter et al. | 493/92 X |
| 4,292,034 | 9/1981 | Probyn et al. | 493/92 |
| 4,303,405 | 12/1981 | Reichert | 493/92 |
| 4,310,323 | 1/1982 | Moen | 493/92 |
| 4,315,752 | 2/1982 | Moen | 493/92 X |
| 4,601,687 | 7/1986 | Gallaher | 493/92 X |

*Primary Examiner*—Horace M. Culver

*Attorney, Agent, or Firm*—Roy F. Schaeperklaus

[57] ABSTRACT

A machine for folding and shaping a partition for a case which carries a plurality of articles and for inserting the partition between articles in the case. The machine includes a hopper for holding a plurality of the partitions. Each of the partitions has slot means substantially centrally thereof. Vacuum cups can grip one of the partitions and move in a direction to free the partition from the hopper. A flight conveyor includes flight means for engaging of the partition at the slot means. The flight conveyor advances the partition to a folding station where the partition is folded centrally thereof. The flight conveyor further advances the folded partition to a forming and insertion station. A case having articles therein stops at a loading station below the forming and insertion station. Forming elements between the forming and insertion station and the loading station are engaged by the partition as the flight conveyor advances the folded partition past forming elements to form the partition to erect position. An insertion conveyor means advances the formed partition from the forming elements into alignment with the articles in the case to separate the articles in the case.

6 Claims, 40 Drawing Sheets

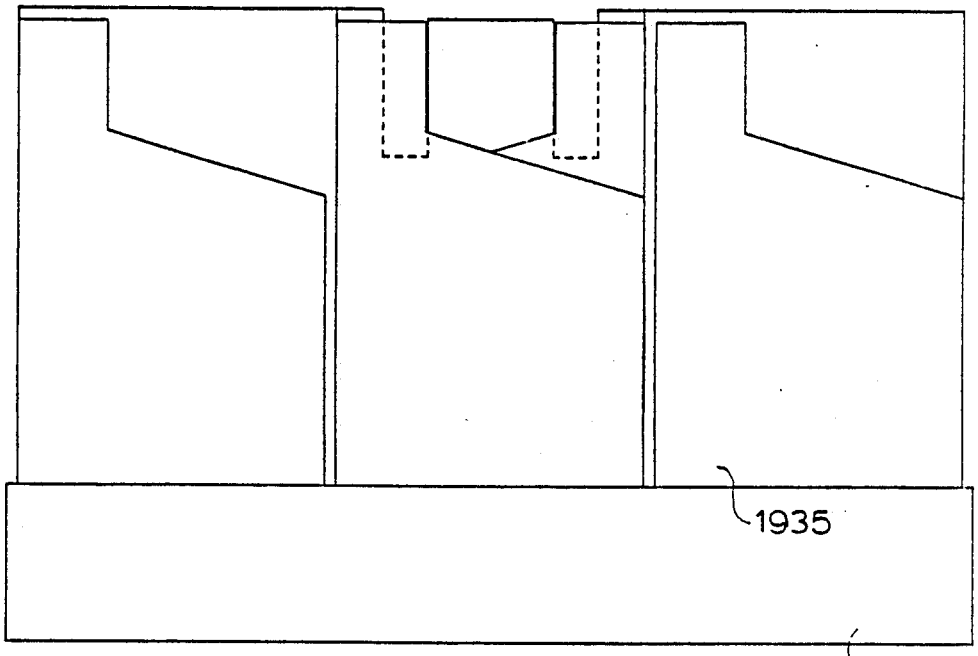
FIG. 39B
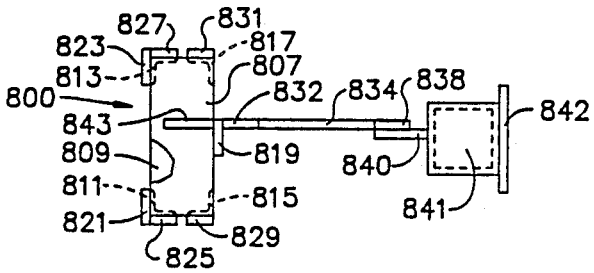
FIG. 41
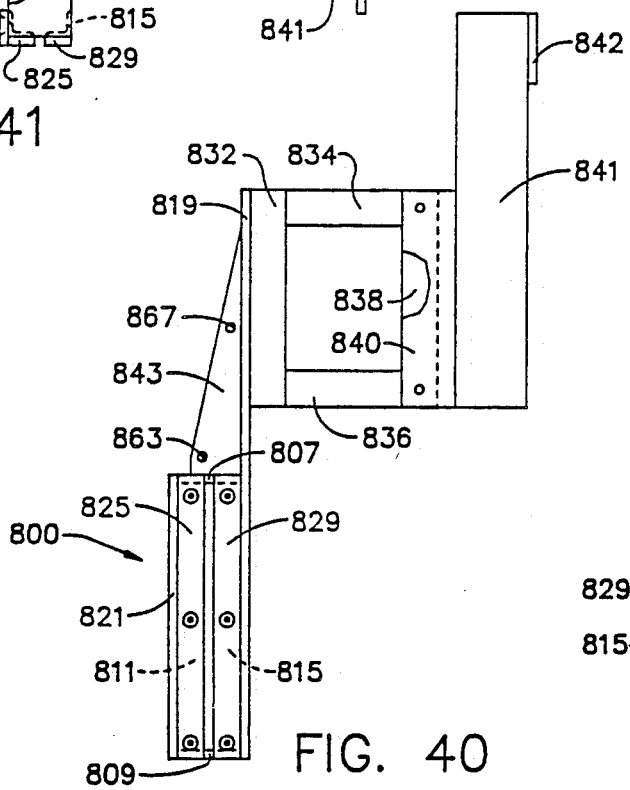
FIG. 40
FIG. 42
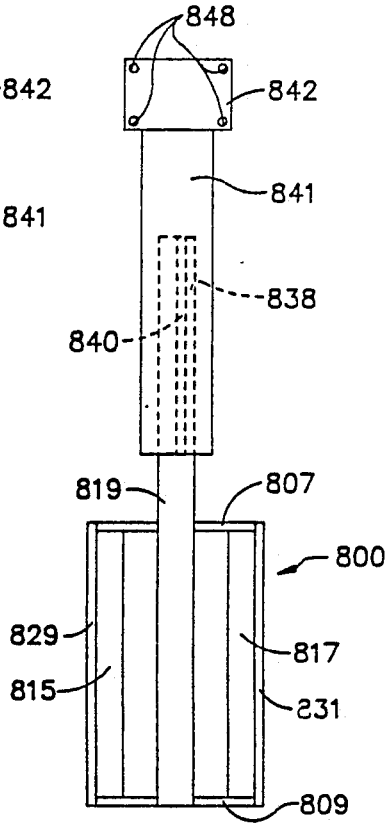

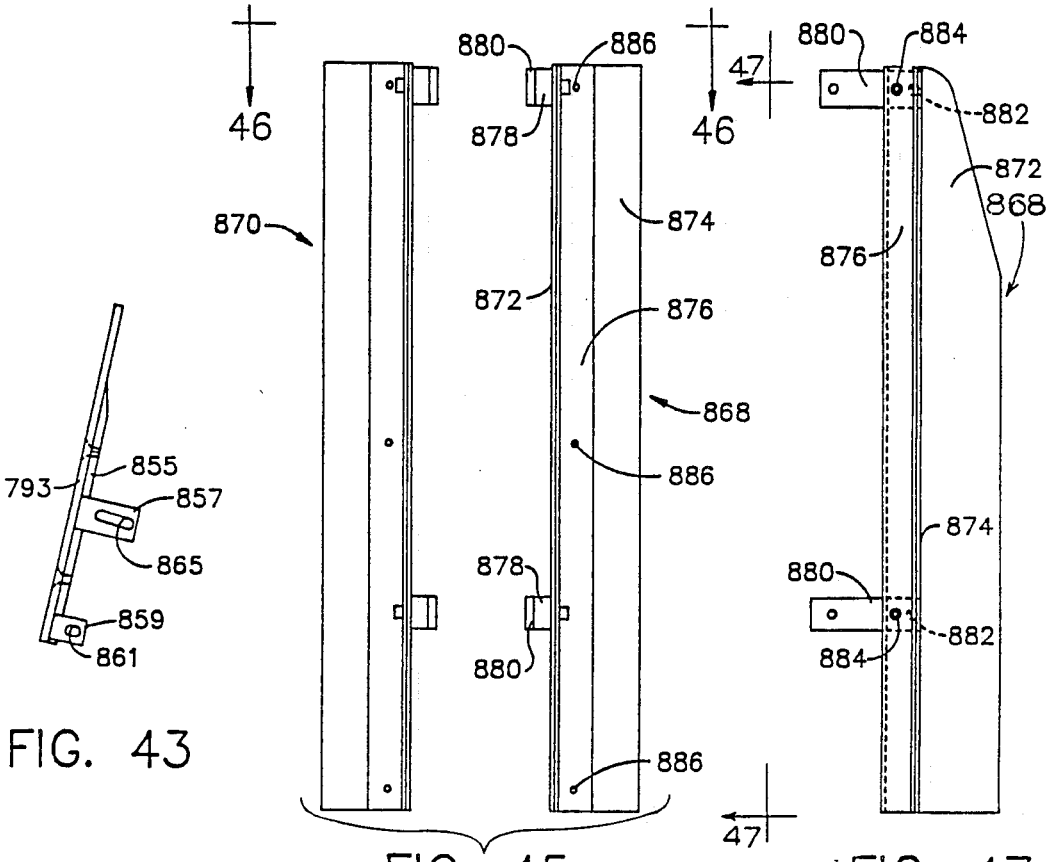
FIG. 43
FIG. 45
FIG. 47
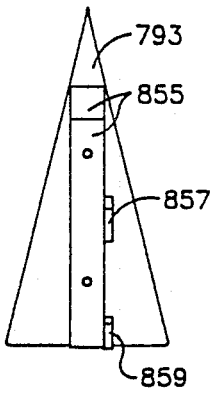
FIG. 44
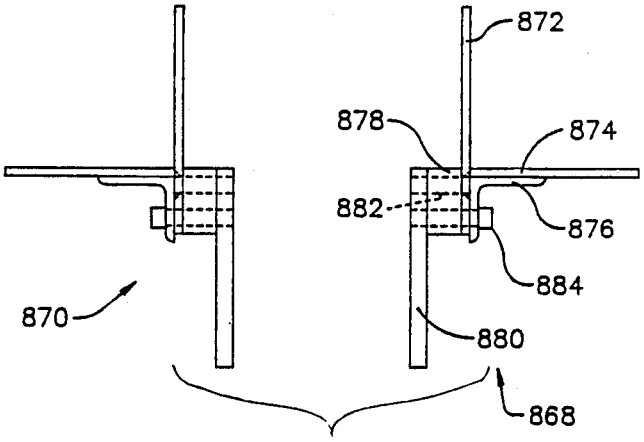
FIG. 46

PARTITION FORMING AND INSERTING MACHINE

BACKGROUND OF THE INVENTION

This invention relates to a machine for folding a partition for a case or carton and installing the partition between articles of an array of articles, to a partition structure, and to a method of forming and inserting the partition structure.

BRIEF STATEMENT OF THE INVENTION

The machine of the invention takes a flat blank for a partition, folds the blank into two main portions, folds the main portions to include tabs which can engage individual articles, and inserts the folded blank in position between articles to support the articles. An appropriate wrapper can be placed surrounding the array of articles and the carton partition to hold the array in position.

BRIEF DESCRIPTION OF THE DRAWINGS

The above and other objects and features of the invention will be apparent to those skilled in the art to which this invention pertains from the following detailed description and the drawings, in which:

FIG. 39B is a view in side elevational of the carton, articles and erected partition;

FIG. 40 is an elevational view of a core frame of the machine;

FIG. 41 is a plan view of the core frame;

FIG. 42 is another elevational view of the core frame;

FIG. 43 is an elevational view of a wedge plate of the machine;

FIG. 44 is another elevational view of the wedge plate;

FIG. 45 is an elevational view of a side guide assembly of the machine;

FIG. 46 is a view taken in the direction of the arrows 46—46 in FIG. 45;

FIG. 47 is a view taken in the direction of the arrows 47—47 in FIG. 45;

In the following detailed description and the drawings, like reference characters indicate like parts.

DESCRIPTION OF PRESENTLY PREFERRED EMBODIMENT

Figure 1:
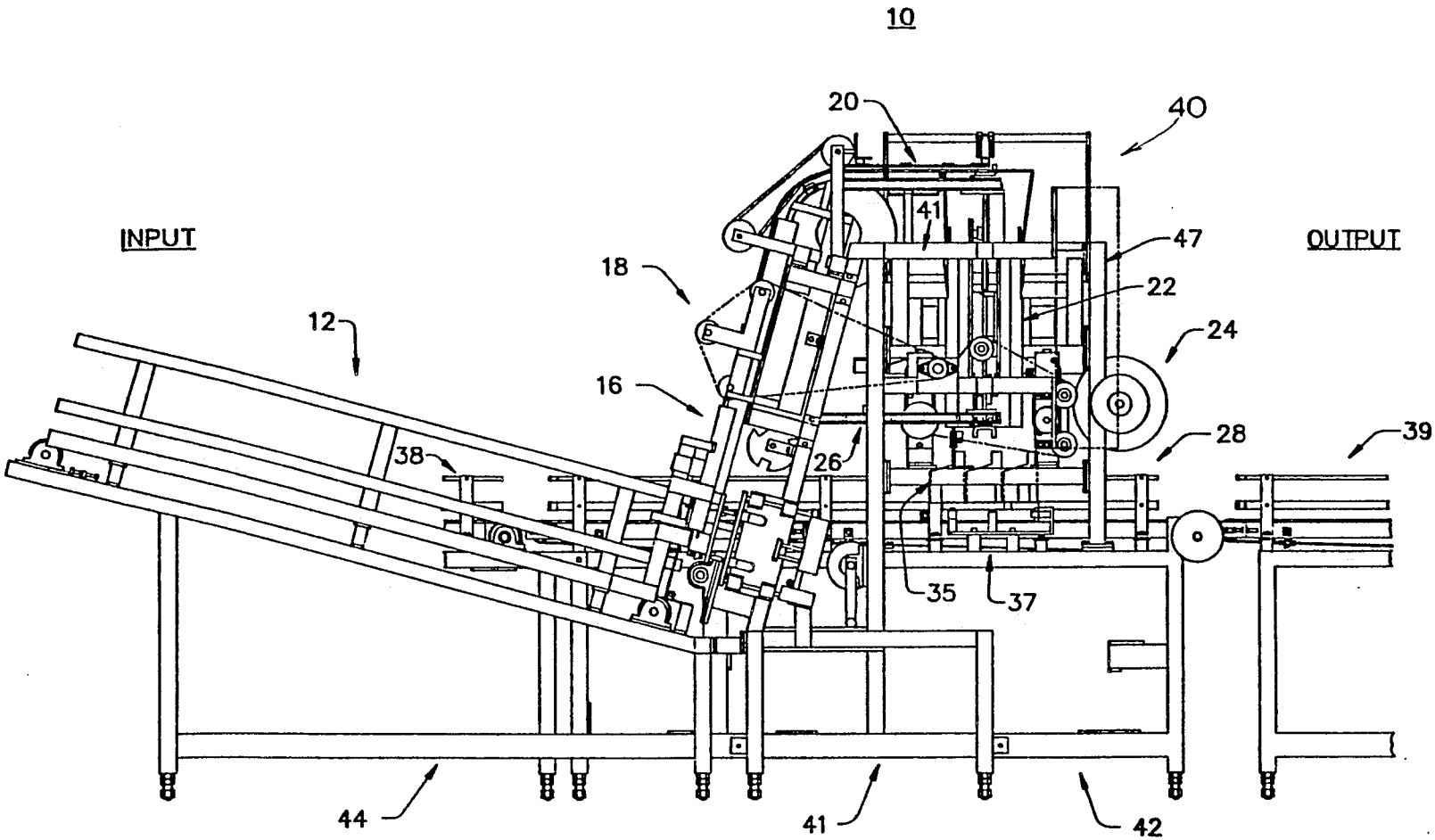
FIG. 1 is a view in side elevation of a partition forming and inserting machine constructed in accordance with an embodiment of this invention, an instrument box of the machine being shown in dot-dash lines.

In FIG. 1 is shown a partition forming and inserting machine 10, which is constructed in accordance with an embodiment of this invention. The partition forming and inserting machine 10 is comprised of an input hopper 12, a pickoff assembly 14, a flight assembly 16, a folder assembly 18, an upper curved track assembly 20, an inserter section 22, lower curved tracks 26, a tamp-down assembly 24, and a case conveyor 28.

The input hopper 12 can be considered the input end of the machine and, since partitions generally travel from left to right in FIG. 1, the output end of the machine is the right end of the conveyor 28. Any side of an object facing the input end of the machine will henceforth be termed the input face, and any side facing the output end of the machine will be termed the output face thereof. The input end of the machine may also be termed the front thereof and the output end can also be termed the rear thereof. Looking in the direction of the partition travel, the right side of the machine is fully visible in FIG. 1, the left side being opposite therefrom. The longitudinal direction is any line lying in a horizontal plane that runs from input to output end, and the lateral direction is 90 degrees to the longitudinal direction, while still remaining in a horizontal plane. Other terminology will be employed whose definitions are conventional.

Figure 2:
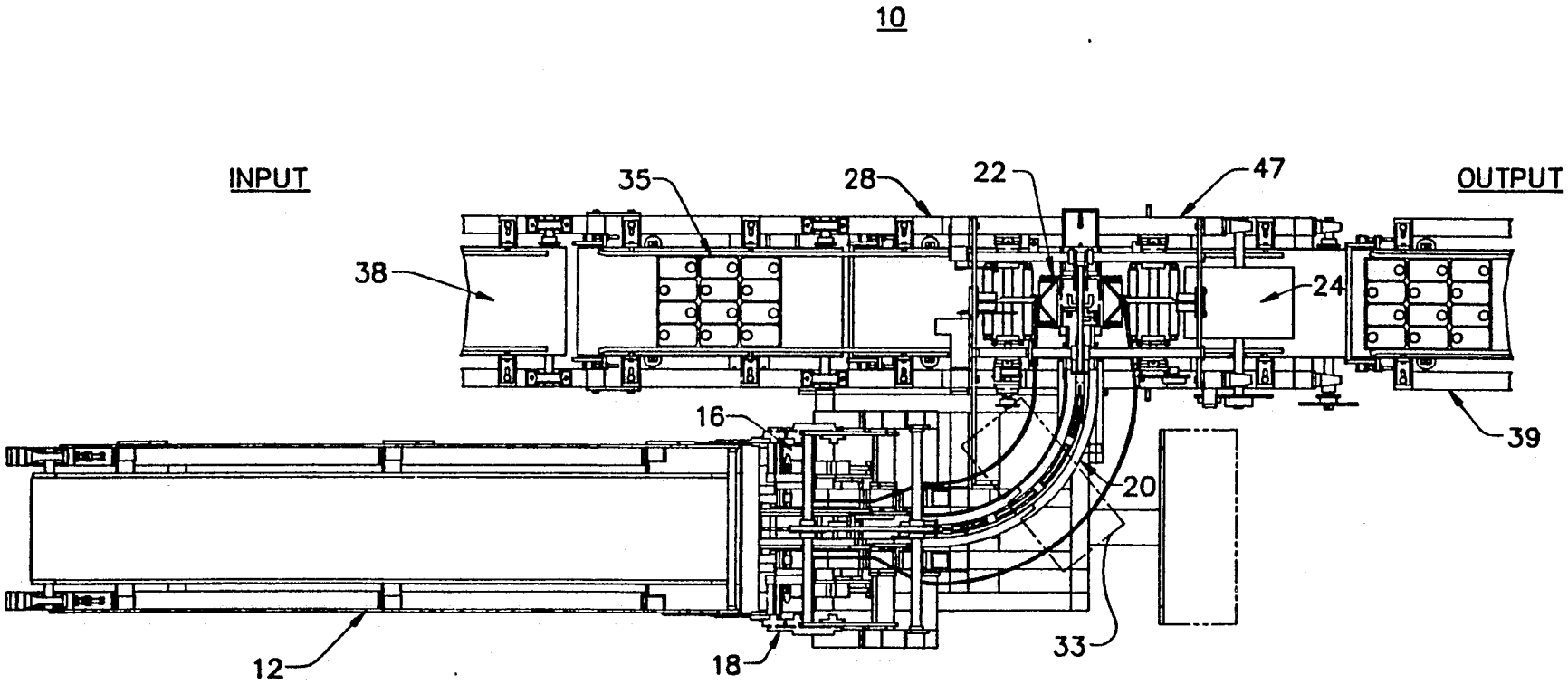
FIG. 2 is a fragmentary plan view of the machine.

An operator loads the input hopper 12 with a slug of partitions 31. Individual partitions 33 are lifted from the slug of partitions 31 by the pickoff assembly 14. A flight chain 411 then picks up the individual partitions 33 and propels them up the flight assembly 16 to the upper curved track 20 and down the inserter section 22 to an awaiting oil case 35 shown in FIG. 2. The oil case 35 is then released from a hold back assembly 37 to proceed down the case conveyor 28 to an output conveyor 39, a fragment of which is shown in FIG. 1.

Main Frame

The subassemblies of the partition inserter 10 are held in a spaced relationship with each other by a frame 40 that is comprised of a main frame 41, a conveyor frame 42, a hopper frame 44, and an inserter or tamp-down frame 47.

Figure 3:
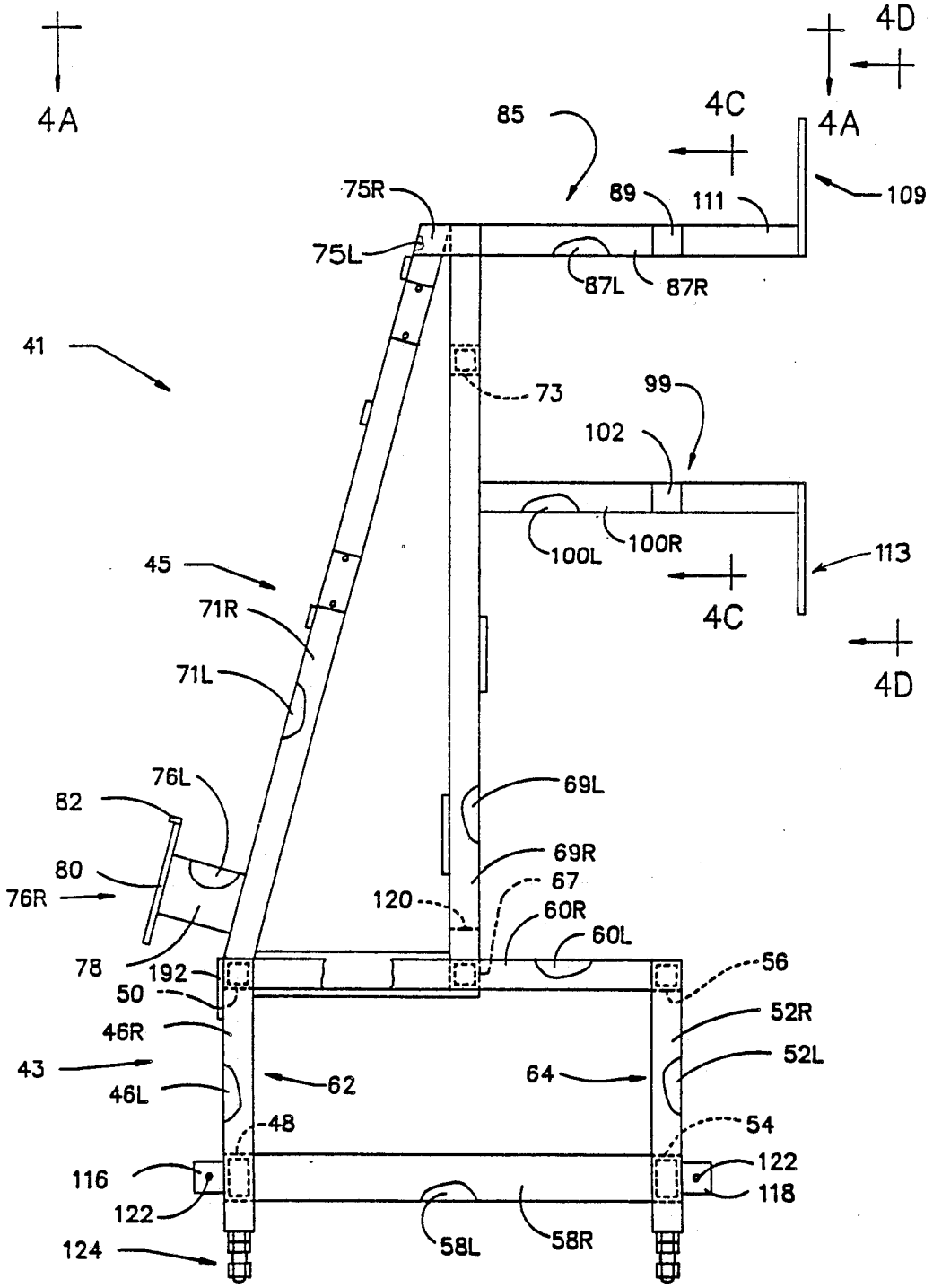
FIG. 3 is a view in side elevation of a main frame of the machine.
Figure 4A:
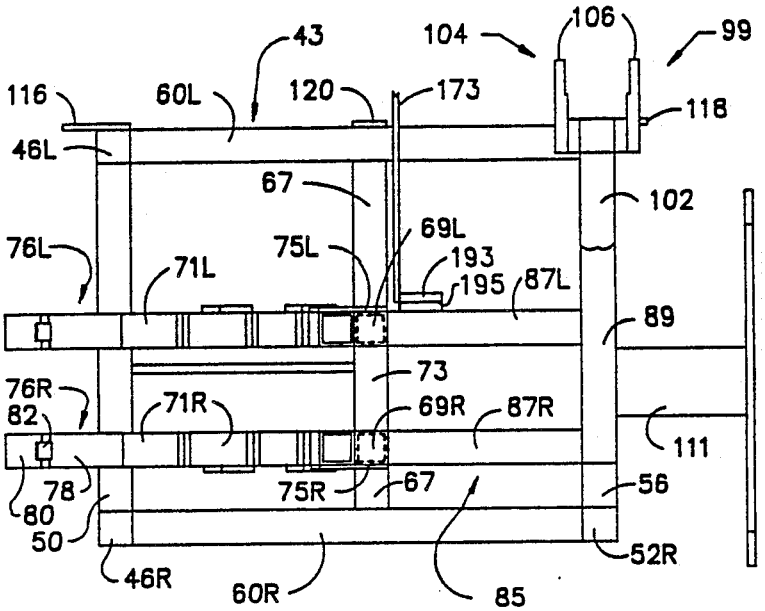
FIG. 4A is a plan view of the main frame looking in the direction of the arrows 4A—4A in FIG. 3.
Figure 4B:
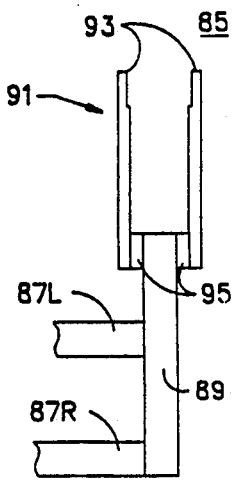
FIG. 4B is a fragmentary plan view of the main frame.
Figure 4C:
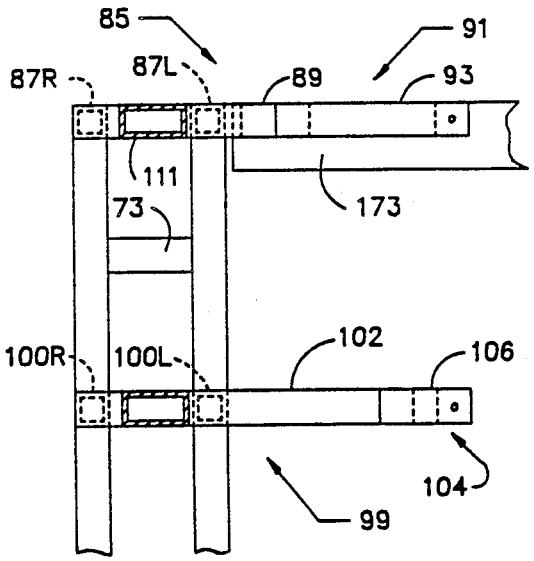
FIG. 4C is a view in section taken on the line 4C—4C in FIG. 3.
Figure 4D:
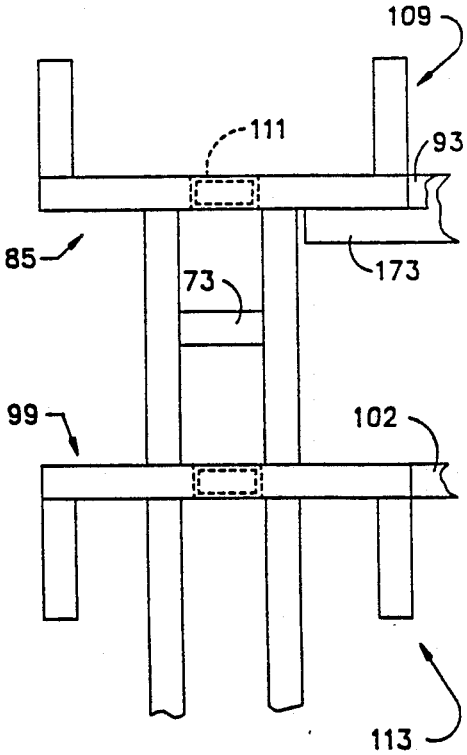
FIG. 4D is a view in end elevation looking in the direction of the arrows 4D—4D in FIG. 3.
Figure 5B:
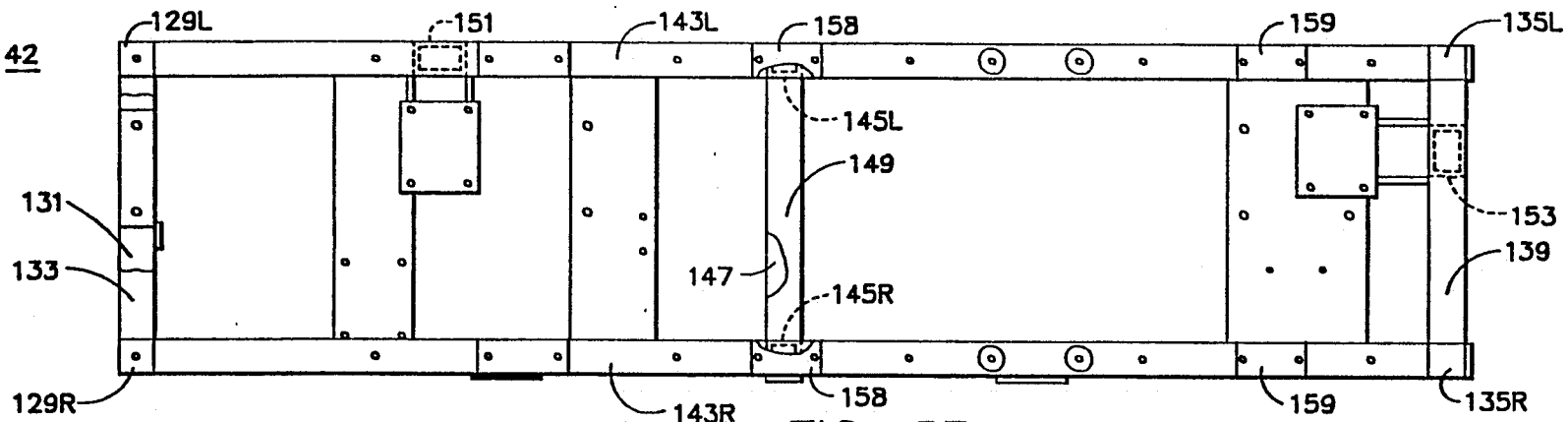
FIG. 5B is a top plan view of the conveyor frame.
Figure 5A:
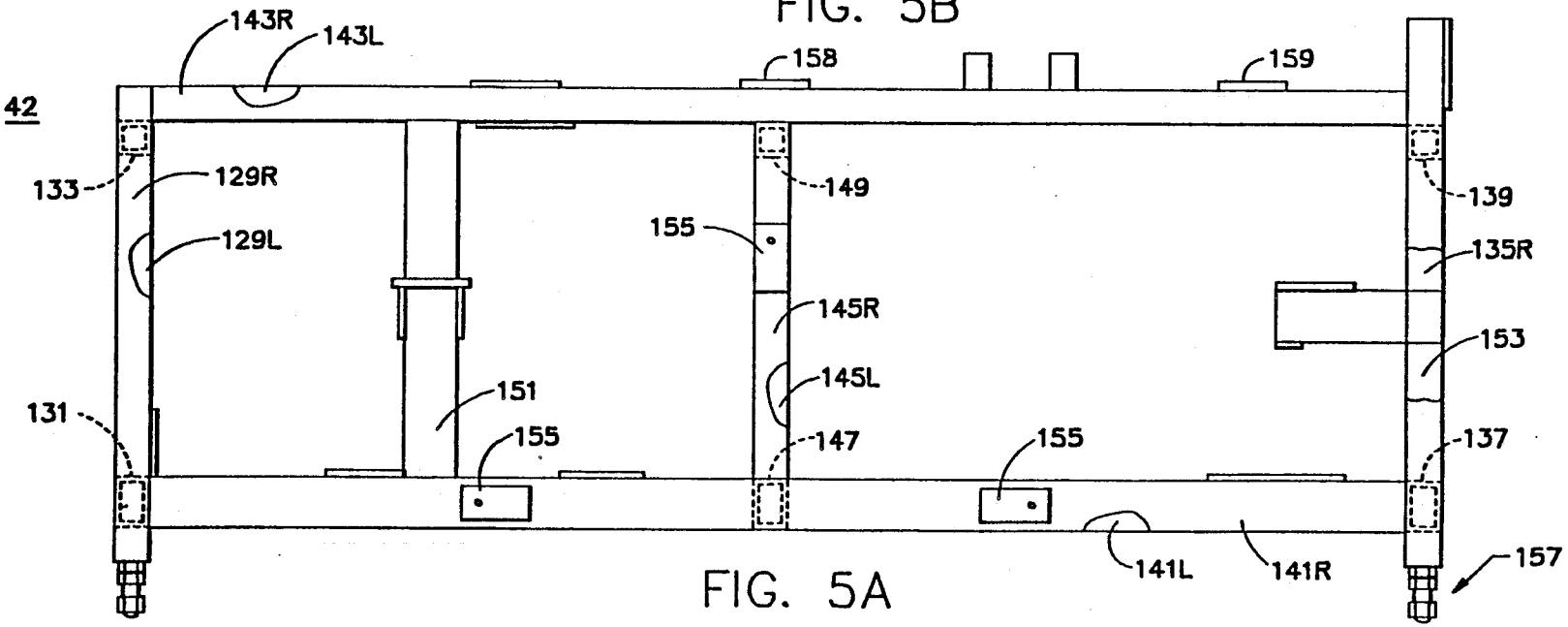
FIG. 5A is a view in side elevation of a conveyor frame of the machine, parts being broken away for clarity.
Figure 6B:
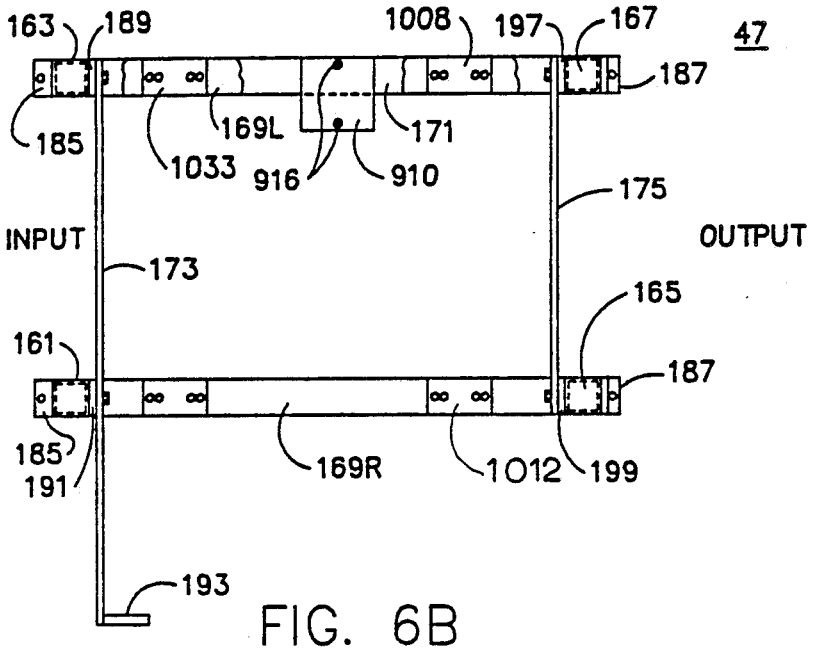
FIG. 6B is a plan view of the inserter frame.
Figure 6C:
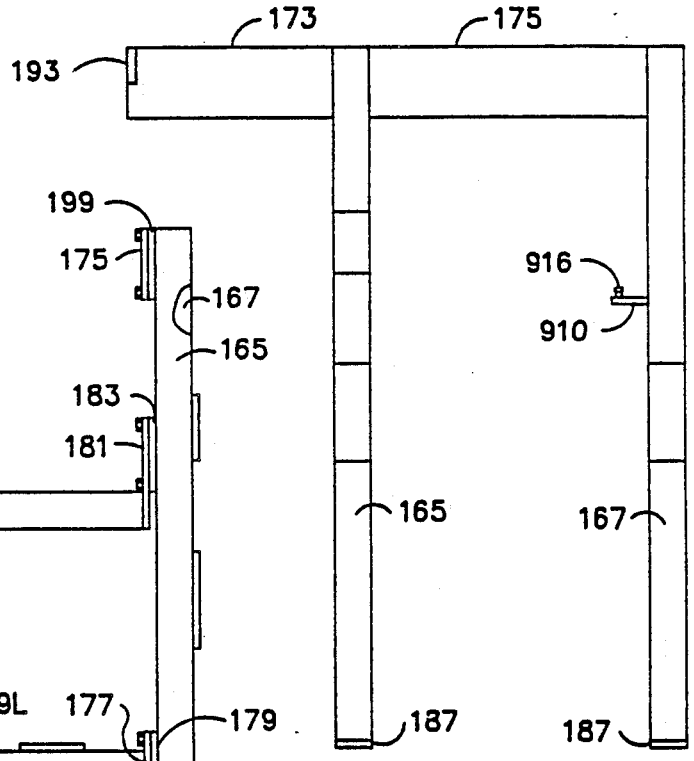
FIG. 6C is a view in side elevation of the inserter frame.
Figure 6A:
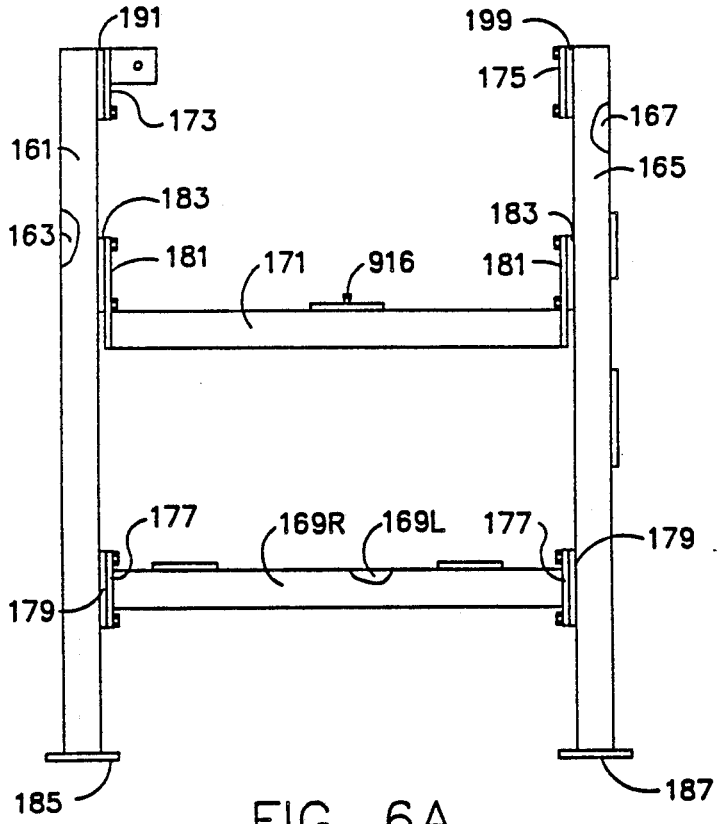
FIG. 6A is a view in end elevation of an inserter frame of the machine.
Figure 7:
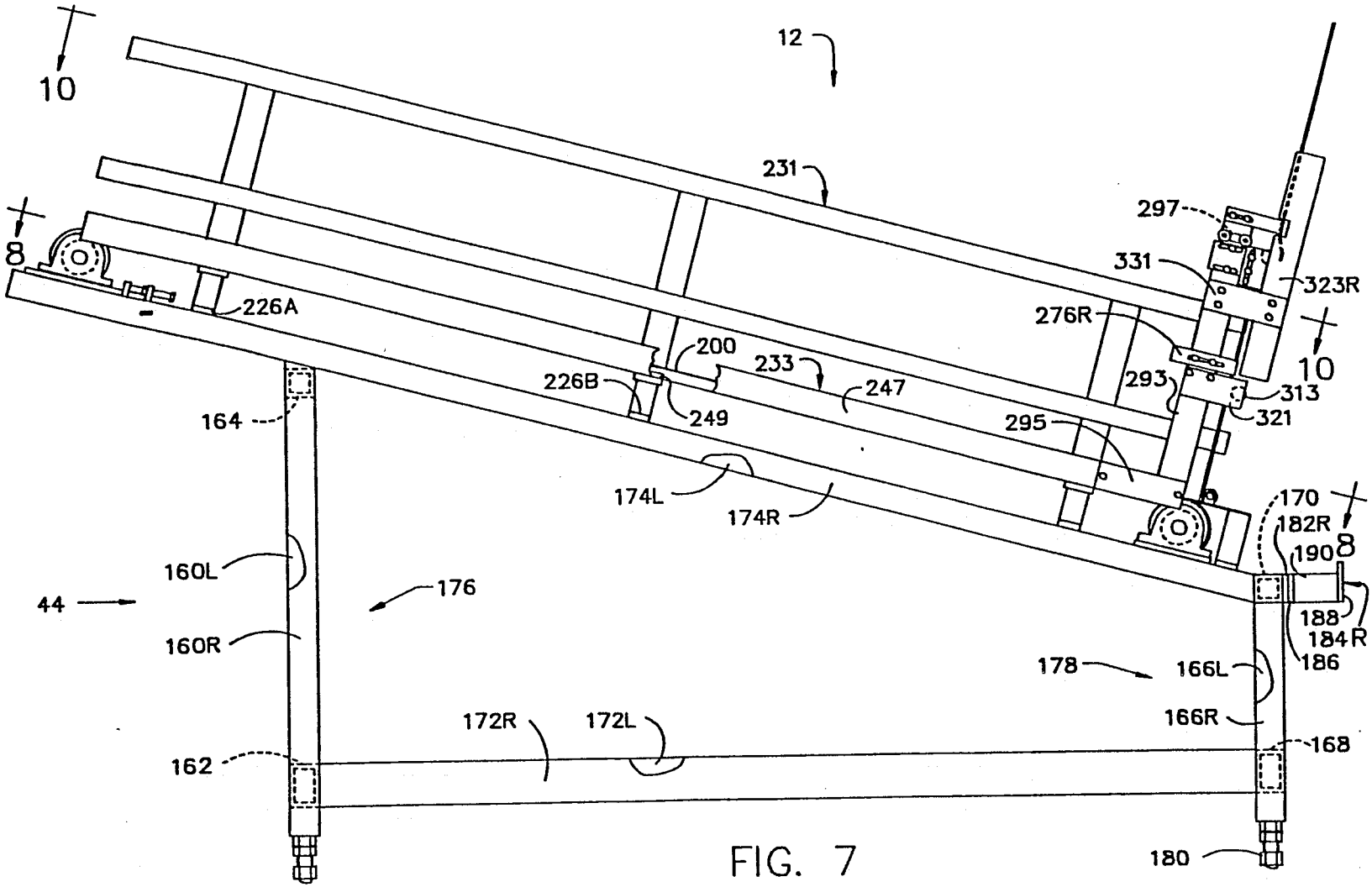
FIG. 7 is a view in side elevation of a hopper frame of the machine.
Figure 8:
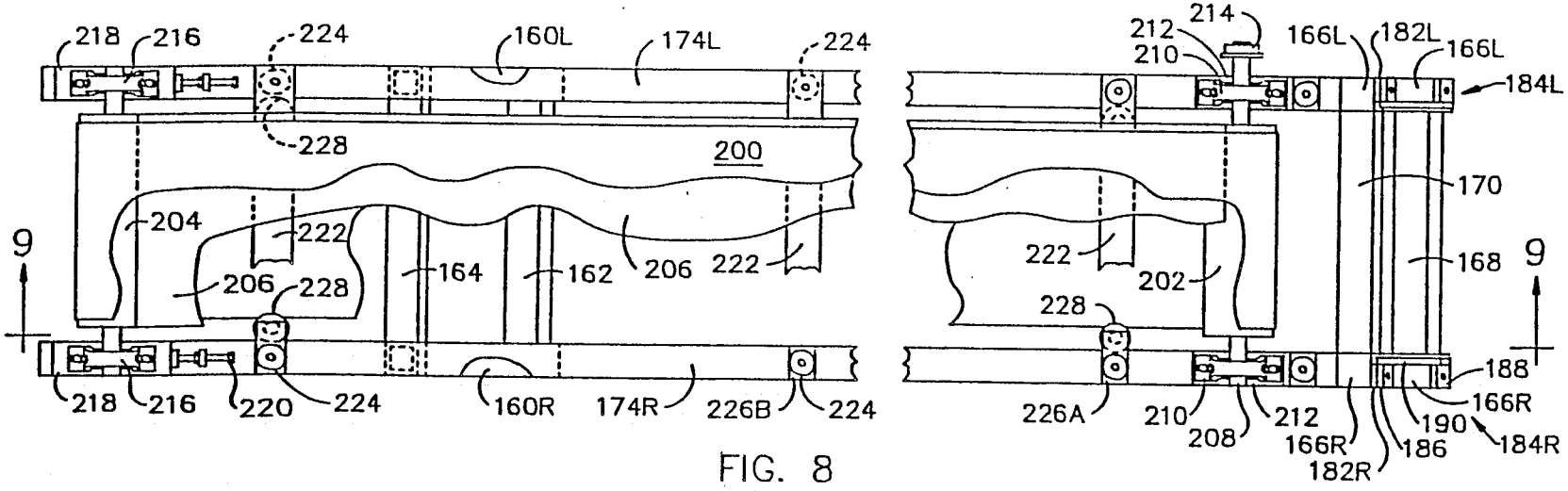
FIG. 8 is a view of the hopper frame taken generally in the direction of the arrows 8—8 in FIG. 7.

The main frame 41 is shown in FIGS. 3, 4A, 4B, 4C and 4D. The conveyor frame 42 is shown in FIGS. 5A and 5B. The inserter frame 47 is shown in FIGS. 6A, 6B and 6C. The hopper frame 44 is shown in FIGS. 7 and 8.

The main frame 41, (FIGS. 3, 4A, 4B, 4C and 4D), is comprised of a bottom frame 43 and an upper frame 45. The bottom frame 43 is comprised of a pair of input posts 46R and 46L, a lower input lateral member 48, an upper input lateral member 50, a pair of output posts 52R and 52L, a lower output lateral member 54, an upper output lateral member 56, a pair of bottom stringers 58R and 58L, and a pair of upper stringers 60R and 60L.

The pair of input posts 46R and 46L is rigidly affixed to the extremities of the lower and upper input lateral members 48 and 50 respectively, to form a rectangular assembly 62. Similarly, the pair of output posts 52R and 52L is rigidly affixed to the extremities of the lower and upper output lateral members 54 and 56 respectively, to form another rectangular assembly 64. The rectangular assemblies 62 and 64 are held in longitudinal spaced relationship by rigidly affixing the pair of bottom stringers 58R and 58L therebetween near the bottom ends of the pairs of input and output posts 46 and 52 respectively, and rigidly affixing the pair of upper stringers 60R and 60L therebetween, at the upper ends of the pairs of input and output posts 46R and 46L and 52R and 52L, respectively.

The upper frame 45 incorporates a middle transverse member 67, a pair of vertical uprights 69R and 69L, a pair of inclined uprights 71R and 71L, a lateral tie member 73, and tie plates 75R and 75L. The middle transverse member 67 is rigidly affixed between the pair of upper stringers 60R and 60L of the bottom frame 43 and located at approximately mid-span thereof. The vertical upright 69R is rigidly affixed at its bottom extremity upon the top surface of the middle transverse member 67 a short distance inboard the right end thereof. Similarly, the vertical upright 69L is rigidly affixed atop the middle transverse member 67 at approximately the center span thereof. The upper extremities of the pair of vertical uprights are rigidly held in lateral spaced relationship by the lateral tie member 73 that is rigidly affixed therebetween, and located near the top portion thereof. Inclined upright 71R is rigidly affixed upon the top surface of the upper input lateral member 50 of the bottom frame 43 and laterally located so it resides in the same longitudinal plane as the vertical upright 69R. Furthermore, the top output edge of the inclined upright 71R lies adjacent the top input edge of the vertical upright 69R and is retained in rigid relationship by tie plate 75R. More specifically, the tie plate 75R is rigidly affixed across the upper right hand surfaces of the inclined and vertical uprights 71R and 39R, respectively. The clined upright 71L is rigidly affixed between the upper input lateral member 50 and the vertical upright 69L in the same manner as the inclined upright 71R except that the tie plate 75L is rigidly affixed upon the left hand surfaces of the vertical inclined uprights 69L and 71L, respectively.

The right hand member of a pair of bearing mounts 76R and 76L is located upon the lower input surface of the inclined upright 71R of the upper frame 45. The bearing mount 76R is comprised of a standoff 78, a mount plate 80, and an adjustment lug 82. The adjustment lug 82 is rigidly affixed to the upper edge of the mount plate 80, and extends in cantilever form in the input direction therefrom. The mount plate 80 is rigidly affixed to the input extremity of the standoff 78 that is in turn rigidly affixed to the lower input face of the inclined upright 71R. The bearing mount 76L is similar to the bearing mount 76R to form the pair of bearing mounts 76R and 76L.

The upper output portion of the upper frame 45 is provided with an upper frame extension 85 that incorporates a pair of top frame members 87R and 87L. The frame members 87R and 87L are rigidly affixed to the top output faces of the vertical uprights 69R and 69L, respectively, to extend in cantilever form in the output direction therefrom. An upper lateral member 89 is rigidly affixed across the output extremities of the top frame members 87R and 87L. The right hand extremity of the lateral member 89 is coincident with the right hand surface of the top frame member 87R and extends to the left of the top frame member 87L to provide mounting structure for a large sprocket yoke 91 as is shown in FIG. 4B.

The large sprocket yoke 91 incorporates tines 93 that are rigidly affixed at their right hand ends to spacer blocks 95 that are in turn rigidly affixed to the left hand input and output surfaces of the upper lateral member 89, such that the unsupported ends of the tines 93 extend laterally to the left beyond the left hand confines of the bottom frame 43.

The upper output portion of the upper frame 45 is also provided with a lower frame extension 99 that is comprised of a pair of lower frame members 100R and 100L, a lower lateral member 102, and a small sprocket yoke 104. The assembly of the lower frame extension 99 is the same as that of the upper frame extension 85. Note that tines 106 of the small sprocket yoke 104 are shorter than the tines of the upper frame extension 85 and that the lower lateral member 102 of the lower frame extension 99 is longer than the upper lateral member 89 of the upper frame extension 85 so that the unsupported ends of tines 93 and 106 lie in the same vertical plane. The lower frame extension 99 is rigidly affixed in parallel spaced relationship with respect to the upper frame extension 85 to the output face of the upper frame 45.

An upper cabinet bracket 109 (FIG. 4D), a U-shaped frame, is rigidly affixed to the output extremity of tubular standoff 111 that is in turn rigidly affixed to the output surface of the upper lateral member 89 at a lateral location between the top frame members 87R and 87L. A lower cabinet bracket 113 is identical in construction and mounted in mirror image to the upper cabinet bracket 109 upon the output face of the lower lateral member 102 of the lower frame extension 99.

The main frame 41 is prepared for attachment to the conveyor frame 42 by incorporating an input, an output, and an upper attachment plate, 116, 118 and 120, respectively. The three plates are identical and each incorporates a clear hole 122 through one end portion thereof. The input attachment plate 116 is rigidly affixed to the left hand surface of, and at the input end of, the bottom stringer 58L. Similarly, the output attachment plate 118 is rigidly affixed to the left side of, and at the output end of, the bottom stringer 58L in such disposition that the portion of the plate 116 containing the hole 122 extends in the output direction therefrom. Likewise, the upper attachment plate 120 extends upwardly from the left side of the upper stringer 60L and is rigidly affixed opposite the intersection of the middle transverse member 67 and the left hand upper stringer 60L of the main frame 41.

The main frame 41 is leveled and adjusted in height by a set of four legs 124 provided at the bottom of the pairs of input and output posts 46L, 46R, 52L and 52R, respectively.

Conveyor Frame

The conveyor frame 42 is shown in FIGS. 5A and 5B and incorporates a pair of input posts 129R and 129L, a lower input lateral brace 131, an upper input lateral brace 133, a pair of output posts 135R and 135L, a lower output lateral brace 137, an upper output lateral brace 139, a pair of bottom longitudinal members 141R and 141L, and a pair of top longitudinal members 143R and 143L.

The pair of input posts 129R and 129L is rigidly affixed in transverse and parallel spaced relationship at the extremities of the lower and upper input lateral braces 131 and 133, respectively. The pair of output posts 135R and 135L is also rigidly affixed in transverse spaced relationship at the extremities of the lower and upper output lateral braces 137 and 139, respectively. The pair of input posts 129R and 129L and the pair of output posts 135R and 135L are rigidly affixed in longitudinal spaced relationship at the extremities of the pairs of bottom and top longitudinal members 141L–141R and 143L–143R, respectively. Note that the top extremity of the pair of output posts 135R and 135L resides above the top surface of the upper output lateral brace 139 by about two beam heights.

Two middle posts 145R and 145L are rigidly affixed between the pair of bottom longitudinal members 141R and 141L and the pair of top longitudinal members 143R and 143L at about mid-span. A lower middle lateral brace 147 is rigidly affixed between the bottom longitudinal members 141R and 141L adjacent the intersection of the middle posts 145R and 145L. An upper middle lateral brace 149 is rigidly affixed between opposing faces of, and at the top of, the middle posts 145R and 145L. An upright post 151 is rigidly affixed between the left hand members of the pairs of bottom and top longitudinal members 141L and 143L respectively, and longitudinally located near the input end of the conveyor frame 42. Similarly, an output upright post 153 is rigidly affixed between the opposing faces of the lower and upper output lateral brace 137 and 139 respectively, and laterally located near the left side of the conveyor frame 42.

A set of three nut plates 155 is rigidly affixed to the right side of the conveyor frame 42, two of the nut plates being affixed to the right hand face of the right hand bottom longitudinal member 141R and one affixed to the right hand middle post 145R in such a configuration so as to cooperate with the input, output, and upper attachment plates 116, 118 and 120, respectively, of the main frame 41.

Middle nut plates 158 are rigidly afixed to top surfaces of the top longitudinal members 143R and 143L in juxtaposition with intersections of the upper middle lateral brace 149. Output nut plates 159 are also rigidly affixed to the top surfaces of the top longitudinal members 143R and 143L near the output end thereof. The conveyor frame 42 is leveled and adjusted in height by a set of four legs 157 provided at the bottoms of the input and output posts 129R, 129L and 135R, 135L, respectively.

Inserter Frame

The inserter frame 47 is shown in FIGS. 6A, 6B and 6C. It is comprised of a right input post 161, a left input post 163, a right output post 165, a left output post 167, a right and left longitudinal bar 169R and 169L, an upper left longitudinal bar 171, an upper input lateral plate 173, and an upper output lateral plate 175.

The right input and output posts 161 and 165 respectively, are held in vertical and parallel spaced relationship by the right longitudinal bar 169R that rigidly incorporates flange plates 177 upon each extremity thereof. Bolts pass through clear holes in the upwardly and downwardly extending ends of the flange plates 177 to threadably mount into nut plates 179. The two nut plates 179 are rigidly affixed to the inboard surfaces of the right input and output posts 161 and 165 respectively, at a moderate elevation from the bottom thereof.

The left input and output posts 163 and 167 respectively, are held in vertical and parallel spaced relationship by the left longitudinal bar 169L and the upper left longitudinal bar 171. The left longitudinal bar 169L is mounted between the input and output posts 163 and 167 respectively, in exactly the same manner as is the right longitudinal bar 169R. The upper longitudinal bar 171 rigidly incorporates hanger plates 181 at each extremity thereof. Bolts pass through clear holes in the upstanding ends of the hanger plates 181 to threadably mount into nut plates 183. The two nut plates 183 are rigidly affixed to the inboard surfaces of the left input and output posts 163 and 167, respectively, at an elevation favoring the upper portion thereof.

The bottom extremities of the right and left input posts 161 and 163, respectively, rigidly incorporate a pair of bottom plates 185, that cooperate with the pair of middle nut plates 158 of the conveyor frame 42 to fixedly attach the input side of the inserter frame 44 thereto. The bottom extremities of the right and left output posts 165 and 167 respectively rigidly incorporate a pair of bottom plates 187 that cooperate with the pair of output nut plates 159 of the conveyor frame 42 to fixedly attach the output side of the inserter frame 47 thereto.

The right side of the inserter frame 47 is held in vertical and parallel spaced relationship with the left side thereof by the upper input and output lateral plates 173 and 175 respectively. With respect to the upper input lateral brace 173, a pair of bolts pass through clear holes in the left end thereof to threadably mount into a first nut pad 189 that is in turn rigidly affixed to the output surface of, and at the top end of, the left input post 163. Another pair of bolts pass through clear holes in the approximate center of the upper input lateral plate 173 to threadably mount into a second nut pad 191 that is in turn rigidly affixed to the output surface of, and at the top of, the right input post 161. The upper input lateral plate 173 extends to the right of the right input post 161 to rigidly incorporate a mount flange 193. The mount flange 193 is rigidly affixed along its input edge to the output surface of, and at the upper edge of, the upper input lateral plate 173. As is shown in FIG. 4A, the upper input lateral plate 173 extends to the right to cooperate with the left top frame member 87L of the upper frame extension 85 of the upper frame 45 of the main frame 41. A bolt passes through a clear hole in the mount flange 193 to threadably mount into a nut plate 195 that is in turn rigidly affixed to the left side of, and adjacent the input end of, the left top frame member 87L.

With respect to the upper output lateral brace 175, a pair of bolts pass through clear holes in the left end thereof, to threadably mount into a third nut pad 197 that is in turn rigidly affixed to the input side of, and at the top end of, the left output post 167. Similarly, bolts pass through the right end of the upper output lateral plate 175 to threadably mount into a fourth nut pad 199 that is in turn rigidly affixed to the input side of, and at the top end of, the right output post 165.

Hopper Frame

The hopper frame 44 is shown in FIGS. 7 and 8 and incorporates input uprights 160R and 160L, a bottom input lateral brace 162, a top input lateral brace 164, output uprights 166R and 166L, a bottom output lateral brace 168, a top output lateral brace 170, a pair of lower longitudinal members 172R and 172L, and a pair of incline stringers 174R and 174L.

The input uprights 160R and 160L are rigidly affixed to the end surfaces of the bottom and top input lateral braces 162 and 164 respectively, to form a first frame 176 that is largely rectangular. The output uprights 166R and 166L are also rigidly affixed to the end surfaces of the bottom and to output lateral braces 168 and 170 respectively, to form a second frame 178 of largely square proportions. The first frame 176 and second frame 178 are rigidly affixed in longitudinally spaced and transverse parallel relationship by the pair of lower longitudinal members 172R and 172L. The top extremities of the input uprights 160R and 160L are cut on an angle sloping downward in the output direction to rigidly accommodate the pair of inclined stringers 174R and 174L. The output extremities of the inclined stringers 174R and 174L are rigidly affixed to the input surface of, and at the top of, the output uprights 166R and 166L. The input end of the pair of inclined stringers 174R and 174L extend in cantilever form in the input direction.

The hopper frame 44 is leveled and adjusted in height by a set of four legs 180 provided at the bottoms of the input and output uprights 160R and 160L, and 166R and 166L, respectively. A pair of nut plates 182R and 182L is rigidly affixed to the upper output face of the output uprights 166R and 166L to provide means for fixedly attaching the hopper frame 44 to the main frame 41. "U" brackets 184R and 184L are used to properly control the vertical and longitudinal relationship between the hopper frame 44 and the main frame 41. They are mirror images of each other, the right hand "U" bracket 184R being comprised of an input plate 186, an output plate 188, and a spanner plate 190. The inboard edge of the output surface of the input plate 186 is rigidly affixed to the right hand surface of, and at the input edge of, the spanner plate 190. Similarly, the lower left hand edge of the output plate 188 is rigidly affixed to the right side of, and at the output edge of, the spanner plate 190. This allows access to bolt heads for fixedly attaching the frames together after they have been leveled and aligned with each other as shown in FIG. 1. The output plates 188 cooperate with nut plates 192 (only one of which is shown, FIG. 3) that are rigidly affixed to the upper input surfaces of the pair of input posts 46R and 46L of the bottom frame 43 of the main frame 41.

Input Hopper

Figures 9, 9A:
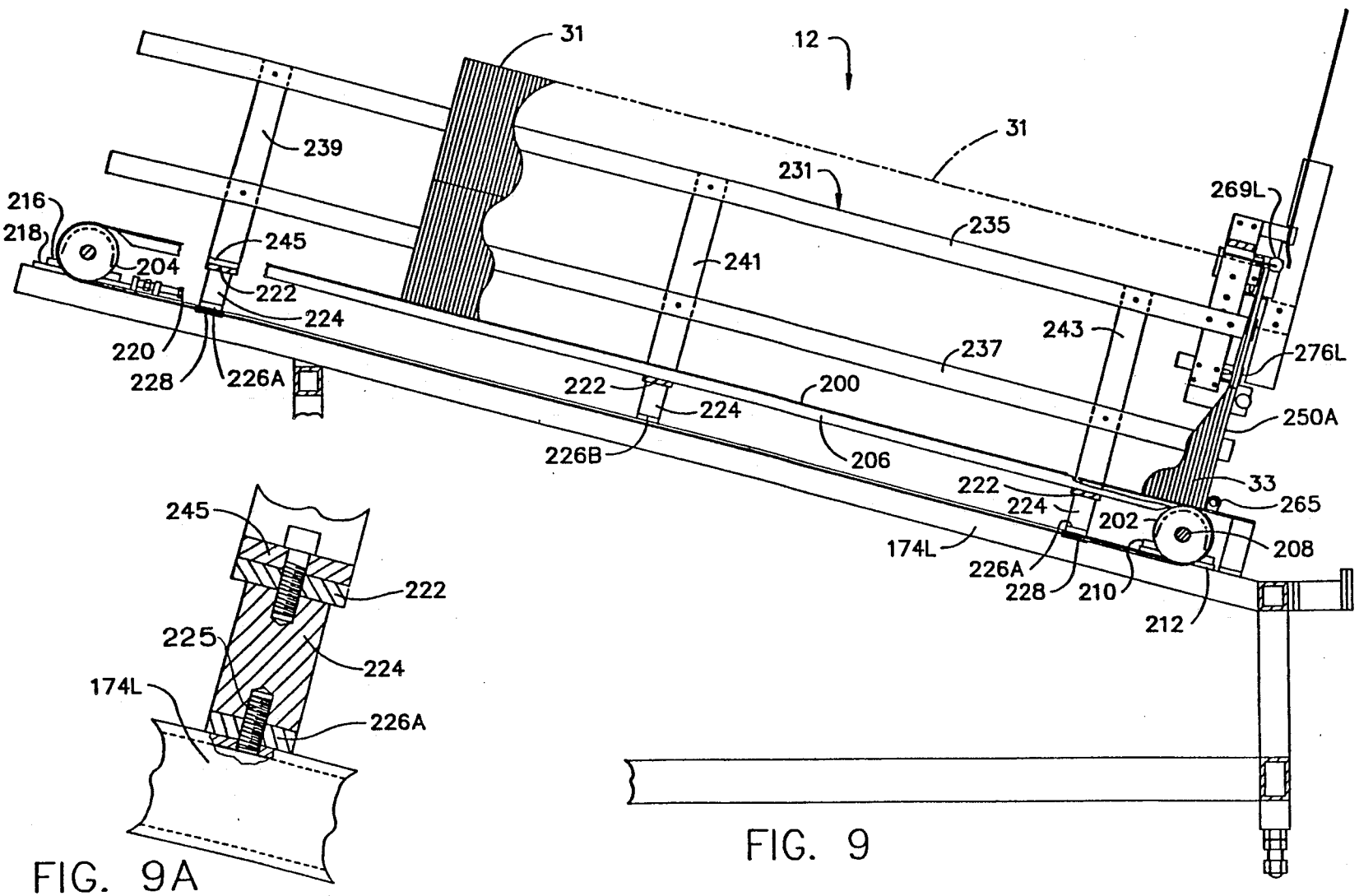
FIG. 9 is a view in section taken on the line 9—9 in FIG. 8.
FIG. 9A is an enlarged view in upright section of a riser and associated elements of the machine.

The input hopper 12, shown in FIGS. 8, 9, and 9A, incorporates a belt 200 that moves in a clockwise direction, as shown in FIG. 9, about a drive roll 202 and an idler roll 204, its upper span being supported by a plate 206 whose ends are tapered from the bottom surface to the top surface thereof to cooperate closely with the upper quadrant of the drive and idler rolls 202 and 204 respectively. The drive roll 202 is fixedly mounted upon a shaft 208 that is in turn rotatably mounted in a pair of bearings 210. The pair of bearings 210 is fixedly attached to the upper output surface of, and near the output end of, the pair of inclined stringers 174R and 174L by means of nut plates 212. The left end of the shaft 208 fixedly incorporates a drive sprocket 214.

The idler roll 204 is likewise rotatably mounted in a pair of bearings 216. The bearings 216 in turn are fixedly attached to the top surface of slide plate 218. The slide plates 218 are clampedly attached to the top surface of, and at the input end of, the pair of inclined stringers 174R and 174L. The slide plates 218 are adjustable in the longitudinal direction by bolts 220 for installation and tensioning of the belt 200.

The plate 206 (FIG. 9) is supported beneath the top portion of belt 200 by a set of three bars 222, one approximate the input end, one approximate the output end, and one at center span of the plate 206. The plate 206 is fixedly attached to the top surface of the set of three bars 222. Each member of the set of three bars 222 is fixedly attached across the top surfaces of a pair of cylindrical risers 224. Each of the cylindrical risers 224 incorporates a threaded stud 225 projecting from the bottom end thereof, to facilitate threadable attachment into nut plates 226A and 226B. The nut plates 226A and 226B are rigidly affixed to the top surfaces of the inclined stringers 174R and 174L. The nut plates 226A, associated with the input and output members of the set of three bars 222, extend inboardly of the inclined stringers 174R and 174L to rotatably accommodate side guide rollers 228. The side guide rollers 228 are grooved to cooperate with edges of the belt 200 so as to keep it in lateral place.

Figure 10:
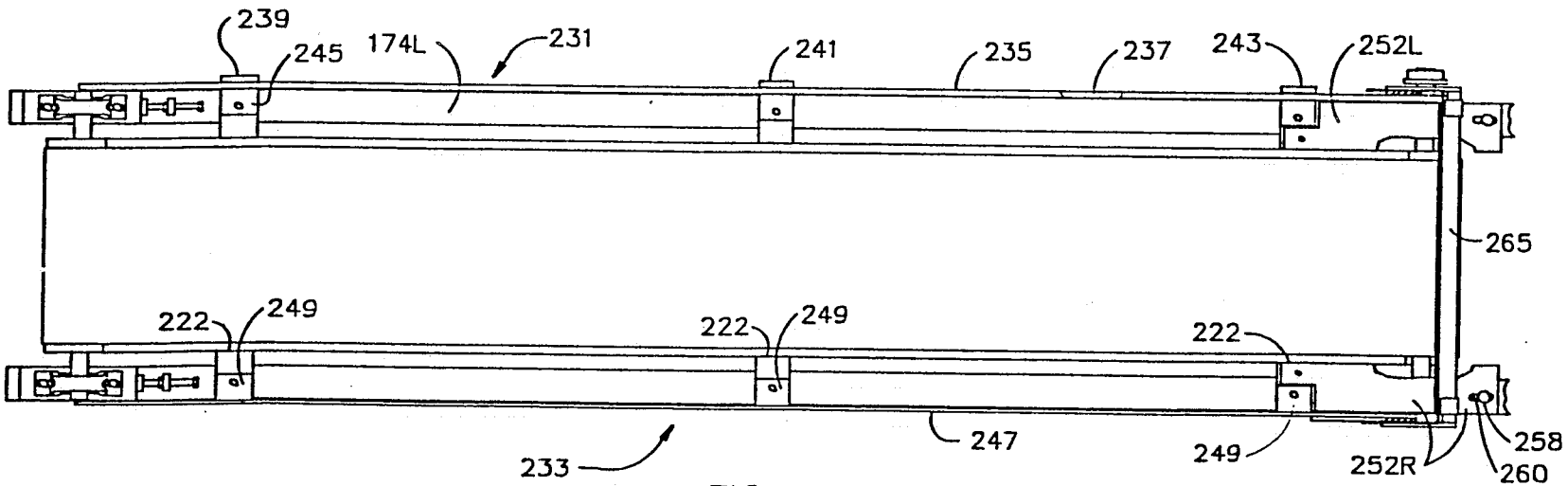
FIG. 10 is a view in section taken generally on the line 10—10 in FIG. 7.

As is shown in FIGS. 7, 9 and 10, the input hopper 12 incorporates a left side fence 231 and a right side fence 233. The left side fence 231 is comprised of a top rail 235, a bottom rail 237, an input post 239, a middle post 241, and an output post 243. The input post 239 (FIGS. 9 and 10) is rigidly affixed at its bottom inboard surface to the left end of a foot 245 that is in turn fixedly attached to the top left hand surface of the input member of the set of three bars 222. The foot 245 extends outboardly somewhat so that the input post 239 stands outboardly of the left hand inclined stringer 174L of the hopper frame 44. The top rail 231 is fixedly attached across the top inboard surface of the input post 239, while the bottom rail 237 is likewise attached thereto, but located thereupon at about half height. This provides for the inboard surface of the top and bottom rails 231 and 237 respectively, to lie in a vertical longitudinal plane just outboard of the left side of the hopper frame 44. The top and bottom rails 235 and 237 respectively, are attached to the middle and output posts 241 and 243 respectively, and the middle and output posts 241 and 243 respectively are mounted to their respective members of the set of three bars 222 in identical manner as the input post 239. The top rail 235 is identical to the bottom rail 237 save for its length, the top rail 235 being shorter at the output end.

The right side fence 233 (FIGS. 7 and 10) is comprised of a bottom rail 247 and three laterally disposed feet 249. The three laterally disposed feet 249 are fixedly attached upon the upper right hand surfaces of the set of three bars 222. The right hand edges of the feet 249 are rigidly affixed to the lower inboard surface of the bottom rail 247 such that the inboard surface of the bottom rail 247 lies just outside the vertical longitudinal plane of the right side of the hopper frame 12. The right and left side fences 231 and 233 respectively control the lateral position of a stack of partitions 31 (FIG. 9) as they are placed upon the belt 200 of the input hopper 12.

Figure 11:
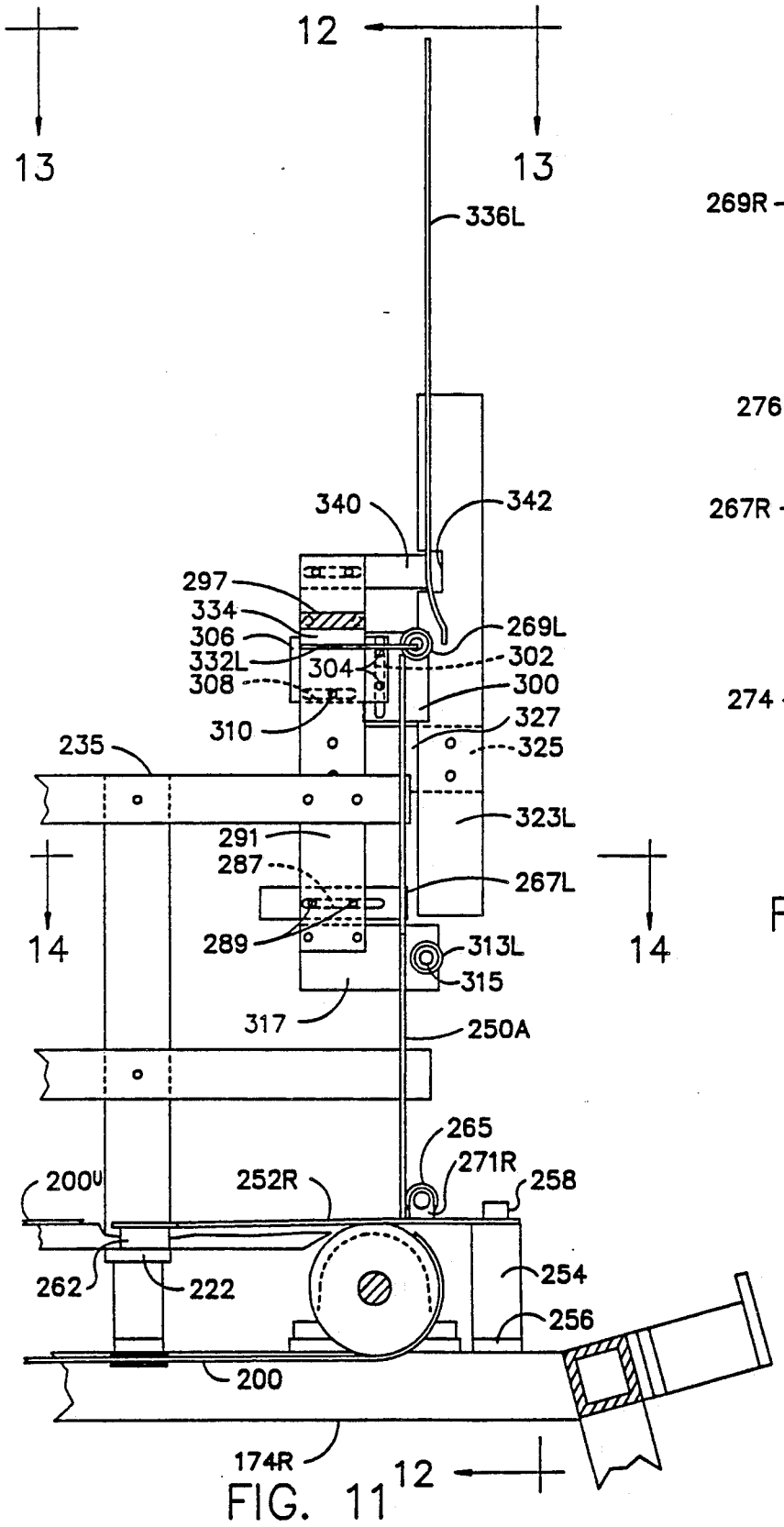
FIG. 11 is a view in upright section of a portion of the hopper frame and associated elements.

As each partition 33 of the stack of partitions 31 proceeds along the belt 200 to the output end of the input hopper 12, it is gradually lifted out of contact with the belt 200 by ramp plates 252R and 252L, as is shown in FIGS. 10 and 11. The ramp plate 252R is fixedly attached at its output end to the top surface of a cylindrical riser 254 that is in turn fixedly attached to a nut plate 256. The nut plate 256 is rigidly affixed to the top surface of, and adjacent the output end of, the right hand inclined stringer 174R of the hopper frame 44. A bolt 258 passes through a slot 260 in the output end of the ramp plate 252R to threadably mount into the top of the cylindrical riser 254. Such mounting permits proper longitudinal placement of the ramp plate 252R at assembly. The input end of the ramp plate 252R is fixedly attached to the top surface of a spacer block 262 that is not rigidly affixed to the upper surface of the output member of the set of three bars 222 until its longitudinal position has been determined at assembly. When so affixed, the input end of the ramp plate 252R is pulled down to a level below the top of an upper course 200U of the belt 200 while the output end thereof remains at a level slightly higher than the belt course 200U. The middle portion of the ramp plate 252R is thus flexed forming the necessary ramp required to lift the output end of the stack of partitions 31 off the belt 200. The left side ramp plate 252L is a mirror image of the right side ramp plate 252R and is mounted in the same way as the ramp plate 252R upon the left side of the hopper frame 44.

The output end of the stack of partitions 31 is held in proper longitudinal place by a bottom roller 265 (FIGS. 9 and 11), mid-fingers 267R and 267L, and upper rollers 269R and 269L as is further shown in FIGS. 11–14. The bottom roller 265 is rotatably mounted at each end in pillow blocks 271R and 271L that are in turn fixedly attached to the top surface of, and along the outboard edges of, the ramp plates 252R and 252L, respectiveely. The bottom roller 265 holds the bottom end of the stack of partitions 31 in longitudinal spaced relationship with the pickoff assembly 14.

Figure 12:
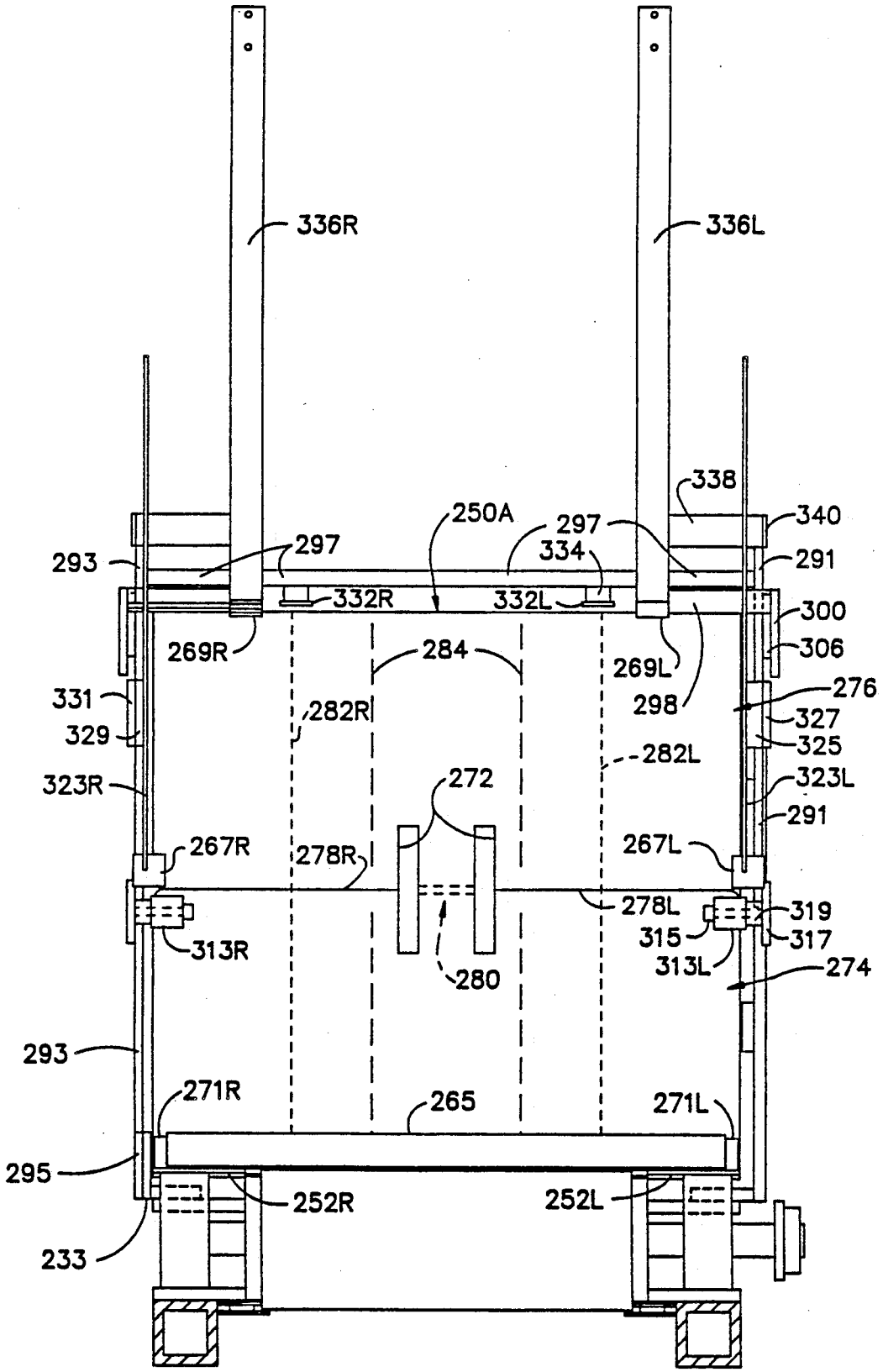
FIG. 12 is a view in section taken on the line 12—12 in FIG. 11.

As can be seen in FIG. 12, an end partition 250A of the stack of partitions 31 is a sheet of corrugated pasteboard incorporating two vertical slots 272 at the center thererof, a bottom half 274, and a top half 276 separated by lateral slits 278R and 278L that extend from the sides thereof to the slots 272. A pair of score lines 280 is laterally disposed across the central portion of the end partition 250A, and are aligned with the lateral slits 278R and 278L to facilitate folding the partition in half. The end partition 250A also incorporates vertically disposed score lines 282R and 282L and vertically disposed perforation lines 284. With respect to FIG. 12, the pair of score lines 280 and the score lines 282L–282R are on the back side of the end partition 250A. The utility of these features will be described hereinafter.

The central portion of the stack of partitions 31 is held in longitudinal place by the mid-fingers 267R and 267L that are L-shaped brackets (FIG. 14) whose short legs extend inboardly to cooperate with the output surface of the end partition 250A. The vertical height of the mid-fingers 267R and 267L is set to cooperate with the bottom corners of the top half 276 of the end partition 250A. As can be seen in FIG. 11, the long leg of the mid-finger 267L incorporates a longitudinal adjustment slot 287. The longitudinal adjustment slot 287 cooperates with a pair of bolts 289. The bolts 289 are threadably mounted into the left side of an upright bar 291. The upright bar 291 is fixedly attached near the output end of, and upon the left side of, the top rail 235 of the left side fence 231. The mid-finger 267R (FIG. 7) is similar to the mid-finger 267L but mounted in mirror image upon an upstanding bar 293 that is in turn rigidly affixed at its bottom end upon the top edge of, and at the output end of, a mount base 295. The mount base 295 is fixedly attached to the right hand surface of, and at the output end of, the bottom rail 247 of the right side fence 233.

The top extremities of the upright bar 291 of the left side fence 231 (FIG. 11), and the upstanding bar 293 of the right side fence 233 (FIG. 7), are laterally stabilized by a cross bar 297 that is fixedly attached therebetween adjacent the upper ends thereof.

The top edge of the end partition 250A is retained in longitudinal position by the upper rollers 269R and 269L, as stated previously. The upper roller 269L is rotatably mounted to the unsupported end of a cantilever bar 298 (FIG. 12) that is in turn fixedly attached to the inboard surface of, and at the upper output corner of, a vertical adjustment plate 300. The vertical adjustment plate 300 incorporates a slot 305 (FIG. 11) adjacent the input edge thereof that cooperates with a pair of bolts 304. The bolts 304 are threadably mounted into the outboard surface of, and at the output end of, a horizontal adjustment plate 306. The horizontal adjustment plate 306 incorporates a pair of slots 308, only one of which is shown, adjacent the top and bottom edge thereof, that cooperate with a pair of bolts 310, only one of which is shown. The bolts 310 threadably mount into the left face of the upright bar 291. The guide roller 269L is so positioned horizontally and vertically that the upper output edge of the partition 250A contacts it. The upper roller 269R is constructed and mounted in a manner similar to the upper roller 269L, except in mirror image thereto, upon the upstanding bar 293 that is mounted to the right side fence 233. Thus, the stack of partitions 31 is held in proper place upon the input hopper 12.

Pickoff Assembly

Figure 11A:
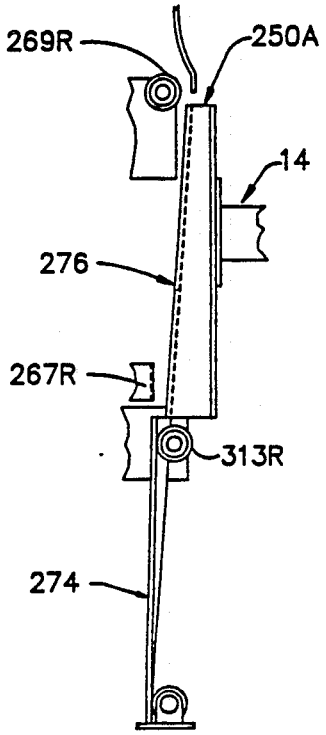
FIG. 11A is a fragmentary view showing details of a partition and partition guiding members.

The pickoff assembly 14 (FIGS. 15, 16, and 17) advances in the input direction to take hold of the top half 276 of the end partition 250A of the stack of partitions 31 outboardly of the score line 282L and 282R, as will be described hereinafter. As the pickoff assembly 14 retreats in the output direction, the top half 276 (FIG. 12) of the partition 250A breaks in the output direction along the perforation lines 284 and reverse flexes along the perforation lines 282L and 282R so that the outboard panels of the upper half 276 are drawn in the output direction to a position past the upper rollers 269R and 269L as is shown in FIG. 11A. At the same time, the lower corners of the top half 276 of the partition 250A are snapped past the mid-fingers 267R and 267L. The upper corners of the bottom half 274 of the partition 250A are restrained from moving in the output direction by side rollers 313R and 313L.

Figure 14:
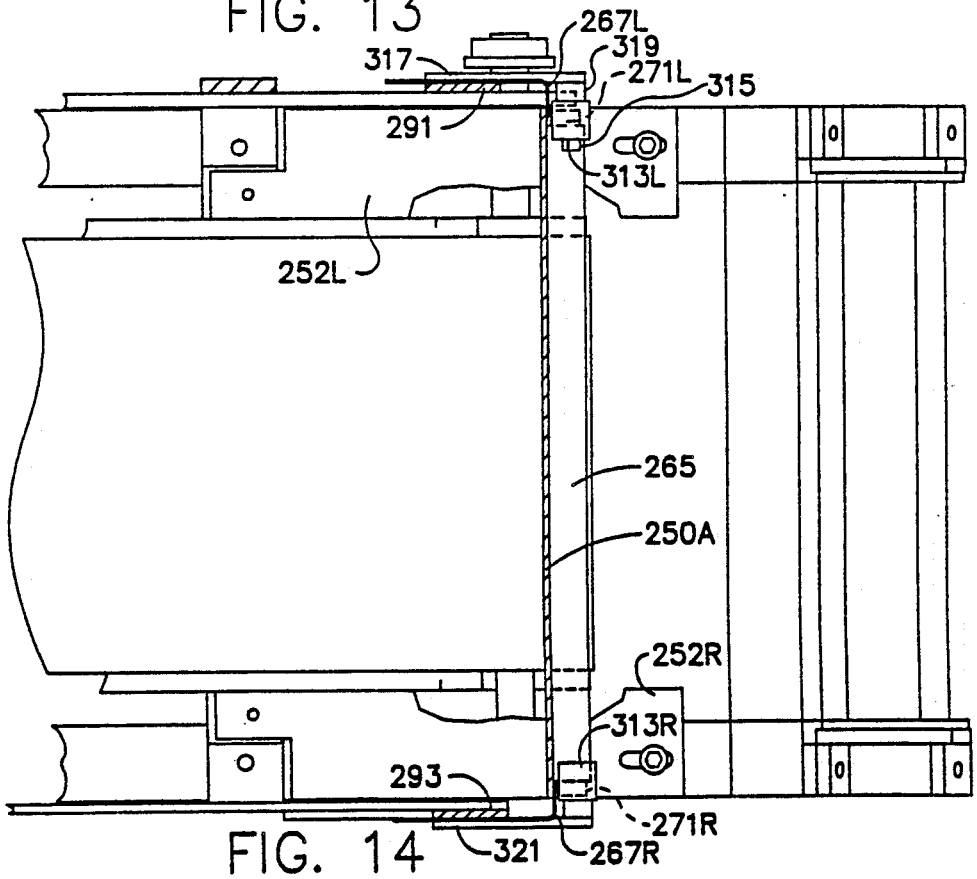
FIG. 14 is a view in section taken on the line 14—14 in FIG. 11.

The left side roller 313L (FIG. 12) is rotatably mounted upon a shoulder screw 315 that is in turn threadably mounted into the inboard surface of a plate 317. The plate 317 is fixedly attached to the left hand surface of, and at the bottom end of, the upright bar 291. The roller 313L is retained in proper lateral position upon the shoulder bolt 315 by collar spacer 319 as is shown in FIGS. 12 and 14. The right side roller 313R is mounted in mirror image to the left side roller 313L upon a plate 321 that is in turn fixedly attached to the right hand surface of the upstanding bar 293.

Figure 13:
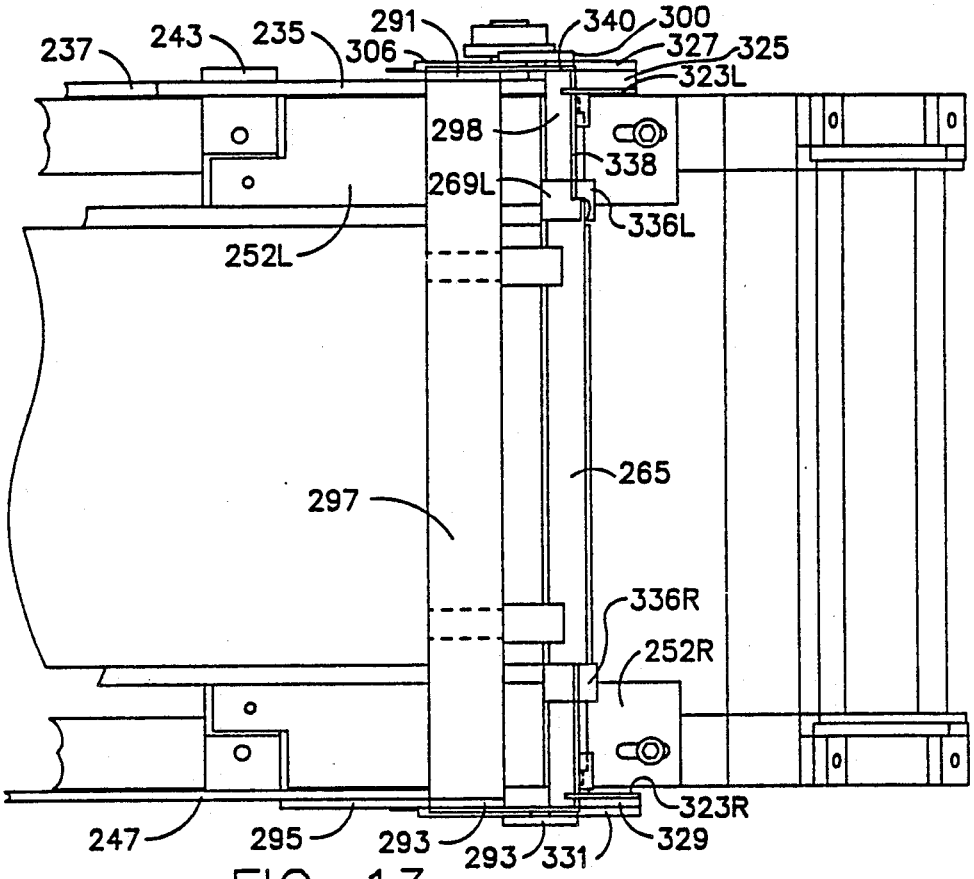
FIG. 13 is a view looking in the direction of the arrows 13–13 in FIG. 11.

As the top half 276 of the partition 250A is drawn in the output direction in preparation for motivation up the flight assembly 16, the lateral position of the partition 250A is guaranteed by guide plates 323R and 323L, as is best shown in FIGS. 11 and 13. The guide plate 323L is fixedly attached upon the right hand surface of a lateral spacer block 325 that is in turn rigidly affixed to a side guide mount 327. The side guide mount 327 extends in the input direction to be fixedly attached to the outboard surface of the upright bar 291, about halfway up. The right hand guide plate 323R is identical to the left hand guide plate 323L. It is fixedly attached to the inboard surface of a lateral spacer plate 329 that is thinner than the lateral spacer plate 325. Lateral spacer plate 329 is rigidly affixed to the left hand surface of a side guide mount 331 that extends in the input direction to be fixedly attached in cantilever fashion to the right hand surface of the upstanding bar 293 (FIG. 7). As can be seen in FIG. 13, the right hand surfaces of the left hand guide plate 323L, the top rail 235, and the bottom rail 237 lie in the same vertical and longitudinal plane. Due to the reduced thickness of the lateral spacer plate 329, the left hand surface of the right hand guide plate 323R lies somewhat outboardly of the left hand surface of the bottom rail 247, allowing some room for partition width tolerance on the right hand side of the machine.

As the flight assembly pulls the end partition 250A upward, the following partition 33 is prevented from moving with it by means of discriminator fingers 332R and 332L (FIGS. 11 and 12), that are fixedly attached to the bottom surface of the cross bar 297. More specifically, the left hand discriminator finger 332L is rigidly affixed at its input end to the bottom surface of a block 334 that is in turn fixedly attached to the bottom surface of the crossbar 297. The left hand discriminator finger 332L is laterally positioned in vertical line with the left hand score line 282L. The right hand discriminator finger 332R is likewise mounted above a position assumed by the right hand score line 282R.

Vertically disposed splitter bars 336R and 336L are mounted in longitudinal and vertical alignment with the upper rollers 269R and 269L and rise upwardly therefrom. As is shown best in FIGS. 11, 12 and 13, the left hand edge of the left hand splitter bar 336L is rigidly affixed to the right hand extremity of a lateral arm 338. The left hand extremity of the lateral arm 338 is rigidly affixed to the right hand surface of, and at the output edge of, a cantilever arm 340 that is in turn adjustably clamped to the upper outboard surface of the upright bar 291 so that is can be adjusted in the longitudinal direction. The right hand member of the splitter bar 336R is substantially identical to the left hand member 336L, and is mounted in mirror image thereto upon the upper end of the upstanding bar 293. Rectangular cutouts 342, one of which is shown in FIG. 11, are provided in the input edges of the guide plates 323R and 323L to accommodate the longitudinal movement of the splitter bars 336R and 336L. As can be seen in FIGS. 11 and 11A, bottom ends of the splitter bars 336R and 336L are arranged to separate the outboard ends of the top half 276 from alignment with outboard ends of the bottom half 274 of the end parition 250A as the end partition 25A begins to move up the flight assembly 16.

Figure 15:
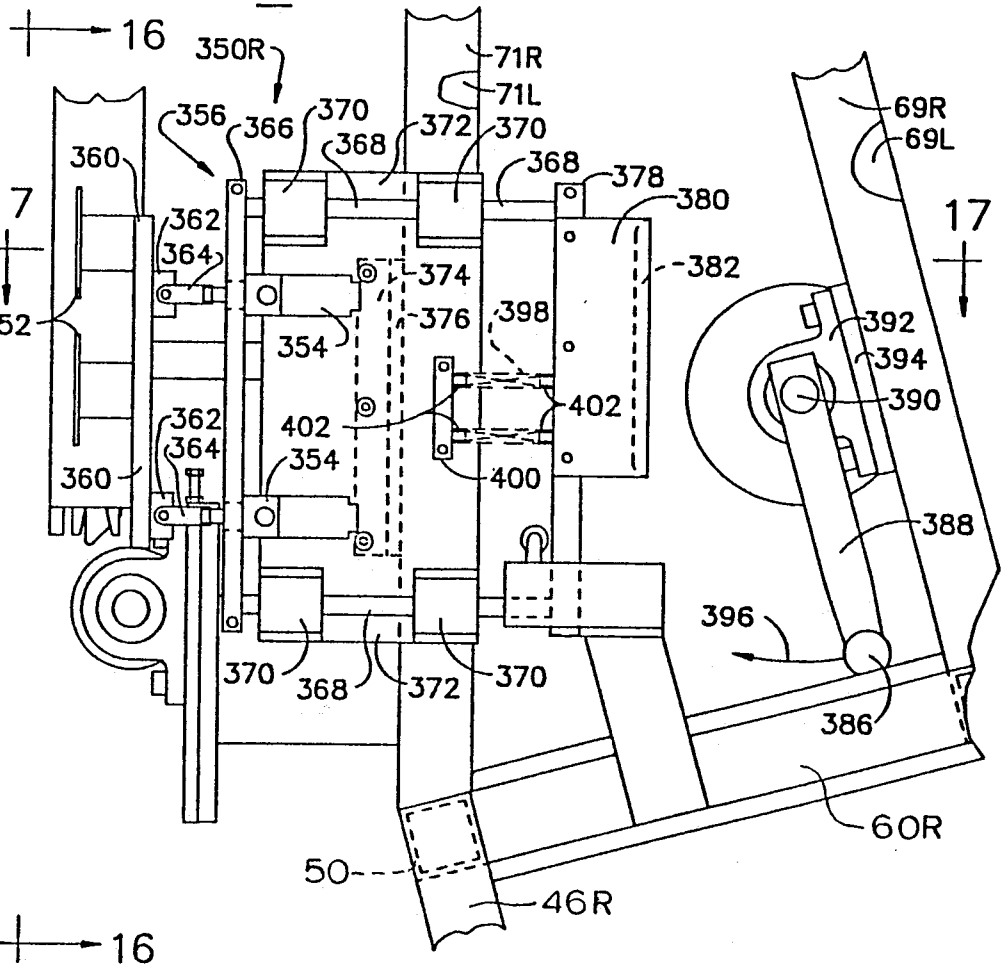
FIG. 15 is a fragmentary view in side elevation of the machine.
Figure 16:
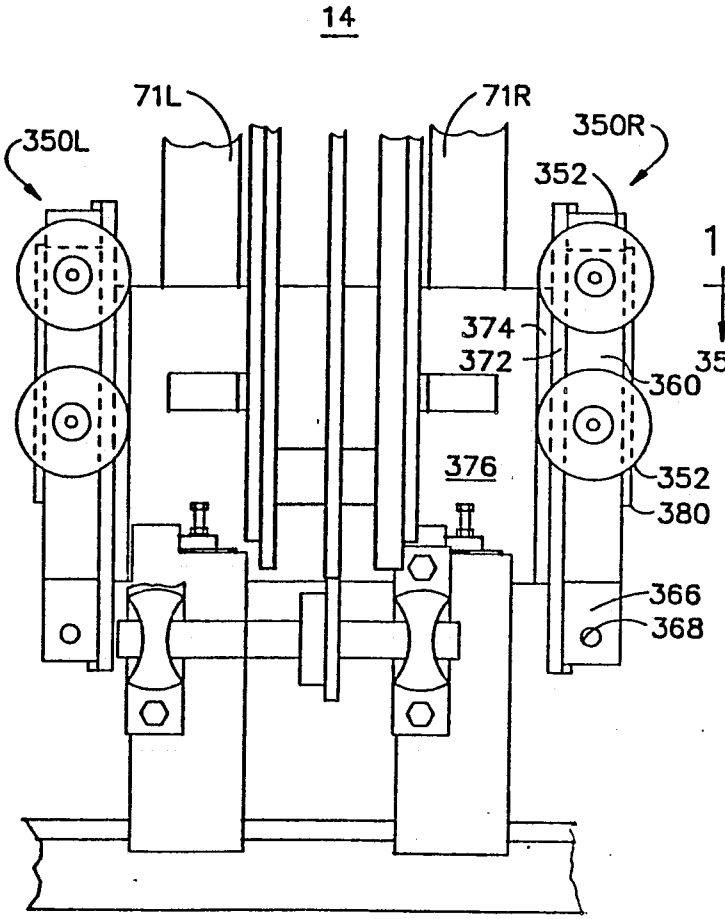
FIG. 16 is a fragmentary end elevational view taken in the direction of the arrows 16—16 in FIG. 15.
Figure 17:
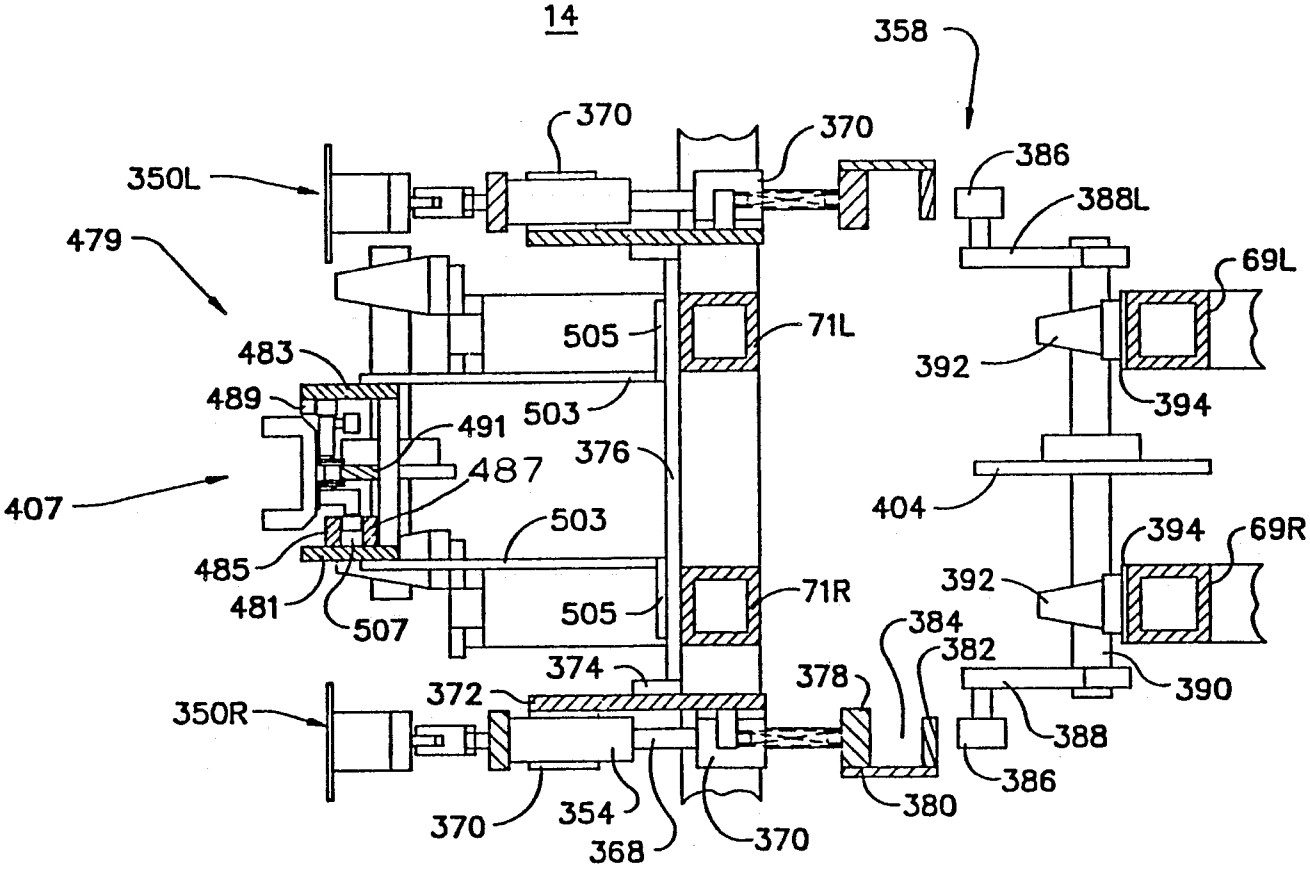
FIG. 17 is a view in section taken on the line 17—17 in FIG. 15.

The pickoff assembly 14 is shown best in FIGS. 15, 16 and 17. It incorporates a right hand extension assembly 350R and a left hand extension assembly 350L. The right hand extension assembly 350R is comprised of a pair of suction cups 352, extension cylinders 354, a parallel bar assembly 356, and a rotary driver assembly 358.

The suction cups 352 are fixedly attached to a substantially vertically disposed bar 360, one suction cup being mounted at the top end thereof, and the other suction cup being mounted at approximately the center thereof, both facing in the input direction to cooperate with the right hand side of the top half 276 of the end partition 250A. Two clevis blocks 362 are fixedly attached to the output side of the vertically disposed bar 360, one at the bottom end thereof, and one between the pair of suction cups 352. Rod clevises 364 of the cylinders 354 are pivotally attached to the clevis blocks 362. The extension cylinders 354 are threadably mounted at their front ends into a cylinder mount bar 366. Since the extension cylinders 354 are actuated together, the substantially vertically disposed bar 360 moves away from the cylinder mount bar 366 in substantially parallel spaced relationship, and returns in parallel spaced relationship by virtue of springs within the extension cylinders 354.

Input ends of a pair of slide bars 368 are fixedly attached to the output side of the cylinder mount bar 366, one at the top end, and one at the bottom end thereof. Each bar of the pair of slide bars 368 is slideably mounted in a pair of linear bearings 370. The four bearings of the pairs of linear bearings 370 are fixedly attached at the corners of, and upon the outboard surface of, a bearing plate 372. The bearing plate 372 is fixedly attached to the outboard surface of a flange plate 374 that is in turn rigidly affixed along its inboard output edge to the right hand edge of one of a pair of pickoff mount plates 376. The pickoff mount plates 376 are rigidly affixed to the input faces of the inclined uprights 71R and 71L.

The output ends of the slide bars 368 are fixedly attached to a pusher bar 378 as is shown in FIGS. 15 and 17. The pusher bar 378 is substantially similar to the cylinder mount bar 366 except for thickness. A puller mount plate 380 is fixedly attached along its input inboard edge to the right hand edge of the pusher bar 378 to provide mounting for a puller plate 382. The puller plate 382 is rigidly affexed at the left hand output edge of the puller mount plate 380 to extend inboardly to provide a channel 384 through which a cam roller 386 passes. The cam roller 386 is mounted onto the extended end of a rotary arm 388 that is in turn fixedly attached to the right end of a pickoff shaft 390. The pickoff shaft 390 is rotatably mounted in a pair of bearings 392. The bearings 392 in turn are fixedly attached upon the input face of a pair of nut plates 394. The nut plates 394 are rigidly affixed to the input faces of the vertical uprights 69R and 69L of the main frame 41.

The right hand extension assembly 350R moves substantially in the longitudinal direction by virtue of the pairs of linear bearings 370. A home position of the right hand extension assembly 350R is defined by a pair of compression springs 398. The compression springs 398 extend from the central input surface of the pusher bar 378 to a spring block 400 that is in turn fixedly attached to the right hand surface of the bearing plate 372 adjacent to its central output edge. The compression springs 398 are retained in position upon the heads of two pairs of bolts 402, one pair being threadably mounted into the output face of the spring block 400, and the other pair being mounted into the input face of the pusher bar 378.

The left hand extension assembly 350L is a mirror image of the right hand extension assembly 350R and is motivateld in the same manner except that its rotary arm 388L, corresponding to the rotary arm 388 of the right hand extension assembly 350R, is fixedly attached to a left end portion of the pickoff shaft 350 (FIG. 17).

Referring to FIG. 15, it can be seen that the cam roller 386 moves in a clockwise circular orbit 396, and at approximately its eight o'clock position with respect to FIG. 15, comes into contact with the lower output face of the pusher bar 378 urging the pusher bar 378 in the input direction. As the rotary arm 388 advances, the right hand extension assembly 350R moves substantially in the input direction compressing the springs 398. As the cam roller 386 rises past the mid-point of the channel 384, the right hand extension assembly 350R begins to return in the output direction by virtue of the compression springs 398 and the puller plate 382. The puller plate 382 is utilized to overcome the extension momentum of the right hand extension assembly 350R. As the right hand extension assembly 350R returns to its home position, its momentum is dissipated by the movement of the cam roller 386 up the output face of the pusher bar 378, thus leaving it in home position without dislodging the pair of compression springs 398.

The pickoff shaft 390 receives rotational power through a sprocket 404 that is fixedly attached at the center thereof. Power is received by the sprocket 404 through a drive chain of a central power train (not shown).

During operation of the machine, the vacuum cups are advanced into engagement with the leading partition, a vacuum is impressed on the vacuum cups so that, as the vacuum cups are advanced in output direction, the upper portion of the leading partition is released, and the flight assembly starts to advance the leading partition as the vacuum is released.

Flight Assembly

As the end or leading partition 250A of the stack of partitions 31 is positioned by means of the pickoff assembly 14 in cooperation with the holding features of the input hopper 12, the flight assembly 16 engages the end partition 250A and moves it upwardly, as will be described in greater detail hereinafter.

Figure 18:
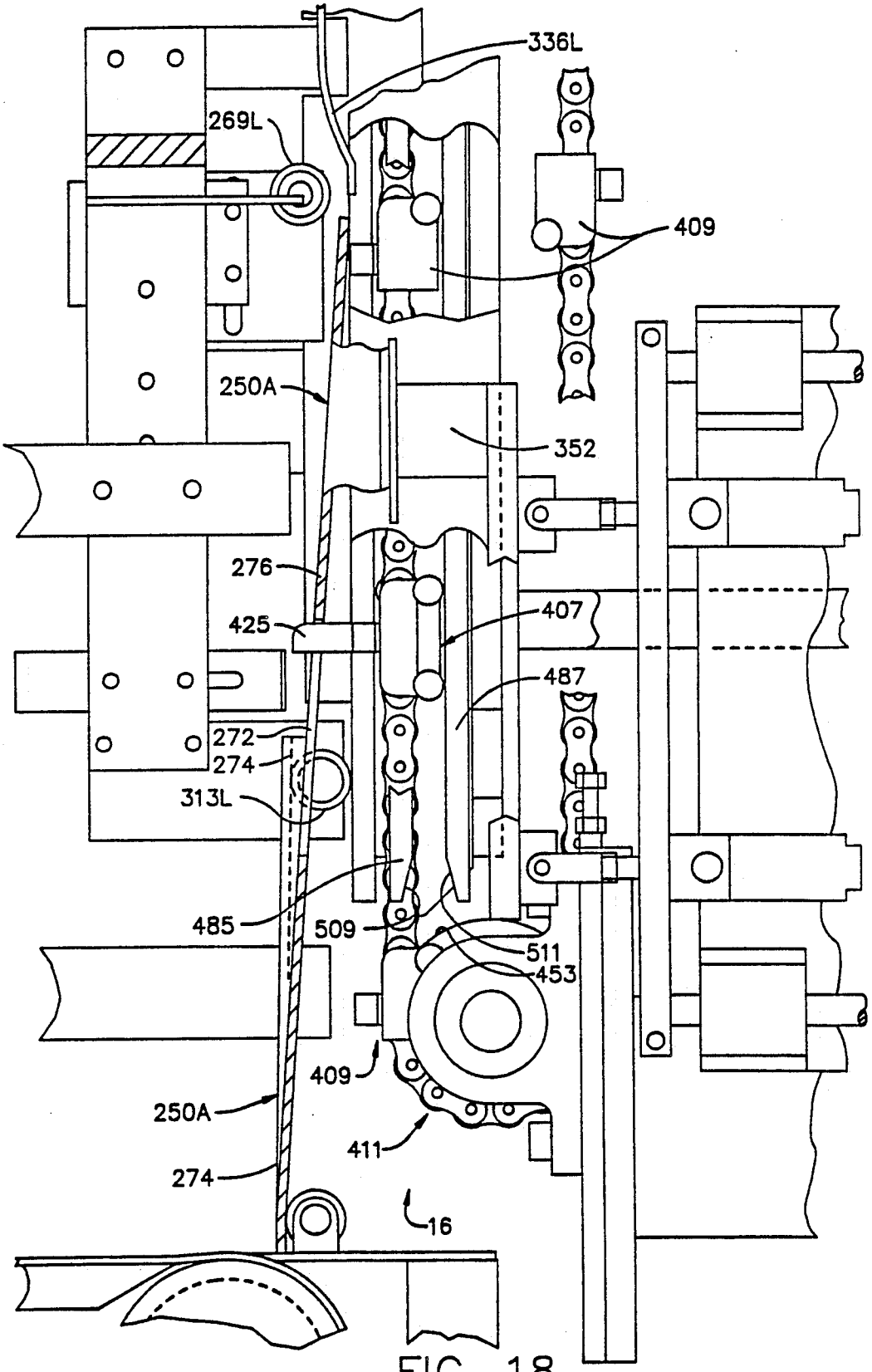
FIG. 18 is a fragmentary elevational view on an enlarged scale, partly in side elevation and partly in section, showing details of a conveyor chain and flight assemblies of the machine.
Figure 21:
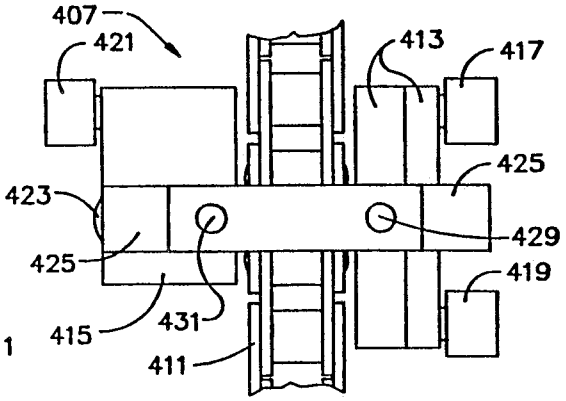
FIG. 21 is a plan view of the driver link assembly.
Figure 20:
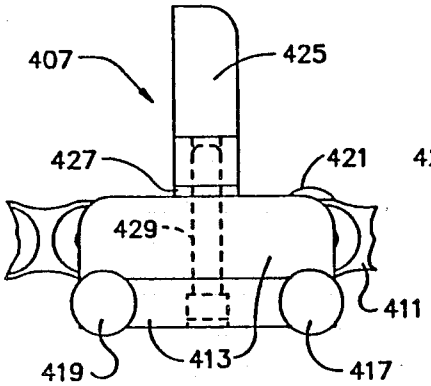
FIG. 20 is a side elevational view of the driver link assembly.
Figure 19:
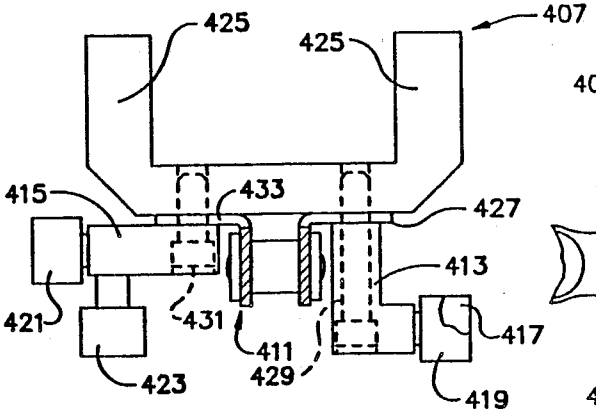
FIG. 19 is a front elevational view of a driver link assembly of the machine, a portion of a link being shown in section.

The flight assembly incorporates driver assemblies 407, holder assemblies 409, and a flight chain 411 as is shown in FIG. 18. Each driver assembly 407, shown in FIGS. 19, 20 and 21, is comprised of a right side cam mount 413, a left side cam mount 415, a first cam roller 417, a second cam roller 419, a third cam roller 421, a fourth cam roller 423, and driver tines 425. The right side cam mount 413 is fixedly attached to the underside of the laterally extending portion of an attachment link 427 by means of a bolt 429. The bolt 429 passes through a clear bore in the central portion of the right side cam mount 413 and through a clear hole in the attachment link 427 to mount into a threaded hole in the laterally disposed base of the driver tines 425. Similarly, the left side cam mount 415 is fixedly attached to the flight chain 411 by a bolt 431 that passes through a clear hole in the left side cam mount 415 and through a clear hole in the attachment link 433 to mount into a threaded hole in a lateral base of the driver tines 425. The first cam roller 417 is rotatably mounted in a lateral disposition to the lower leading edge of the right side cam mount 413. while the second cam roller 419 is rotatably mounted in a lateral disposition to the lower trailing edge of the right side cam mount 413. The third cam roller 421 is rotatably mounted in a lateral disposition to the left side of and at the input end of the left side cam mount 415. The fourth cam roller 423 is also rotatably mounted perpendicular to the bottom surface of the left side cam mount 415 and in lateral line with the driver tines 425.

Figure 24:
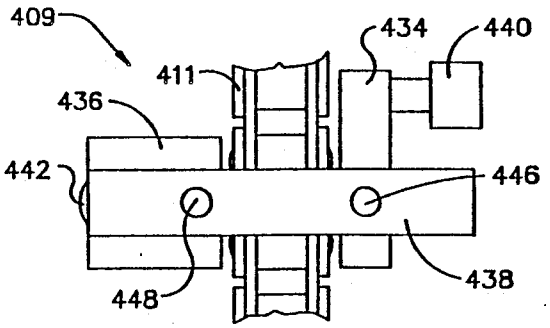
FIG. 24 is a plan view of the holder link assembly.
Figure 23:
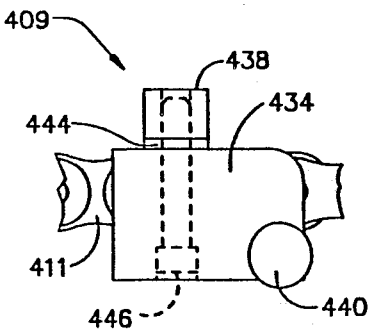
FIG. 23 is a side elevational view of the holder link assembly.
Figure 22:
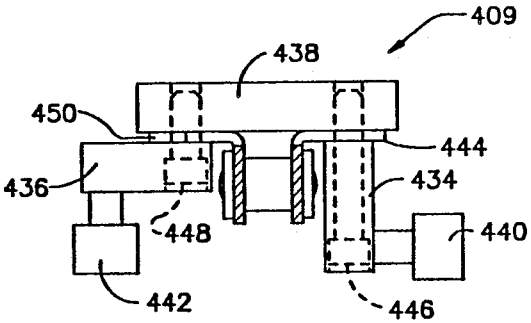
FIG. 22 is a side elevational view of a holder link assembly of the machine, a portion of the holder link assembly being in section.

The holder assembly 409 is shown in detail in FIGS. 22, 23 and 24. It is comprised of a foreshortened right side cam mount 434, a left side cam mount 436, a holder bar 438, a lead cam roller 440, and a left side cam roller 442. The foreshortened right side cam mount 434 is fixedly attached to a bent attachment link 444 by a bolt 446 that passes upwardly (with respect to FIG. 22) through a clear bore in the foreshortened right side cam mount 434, through a clear hole in the lateral leg of the bent attachment link 444, to mount into a threaded hole through the right side of the holder bar 438. The foreshortened left side cam mount 436 is fixedly attached to the flight chain 411 by a bolt 448 that passes upwardly from the underside through a clear bore therein, through a clear hole in a bent attachment link 450, to threadably mount into the left side of the holder bar 438. The lead cam roller 440 is rotatably mounted to the right hand surface of, and adjacent the lower leading corner of, the foreshortended right side cam mount 434. The left side cam roller 442 is rotatably mounted perpendicular to the undersurface of the foreshortened left side cam mount 436 in lateral line with the holder bar 438.

The purpose of each of the driver assemblies 407 is to engage its driver tines 425 into the vertical slots 272 (FIG. 12) of the end partition 250A, as well as guide the flight chain 411 as it motivates the partition through the partition inserter 10. The purpose of the holder assemblies 409 is to hold the partition 250A away from the flight chain 411 and likewise contribute in guiding the flight chain 411 through the partition inserter 10. The driver assemblies 407 and the holder assemblies 409 are arranged upon the flight chain 411 so that there are equal intervals between all elements. One driver assembly 407 and two holder assemblies 409 are required to carry each partition 250A. As can be seen in FIG. 18, the top and bottom ends of the partition 250A are supported by holder assemblies 409, while the driver assembly 407 lies therebetween.

Figure 25A:
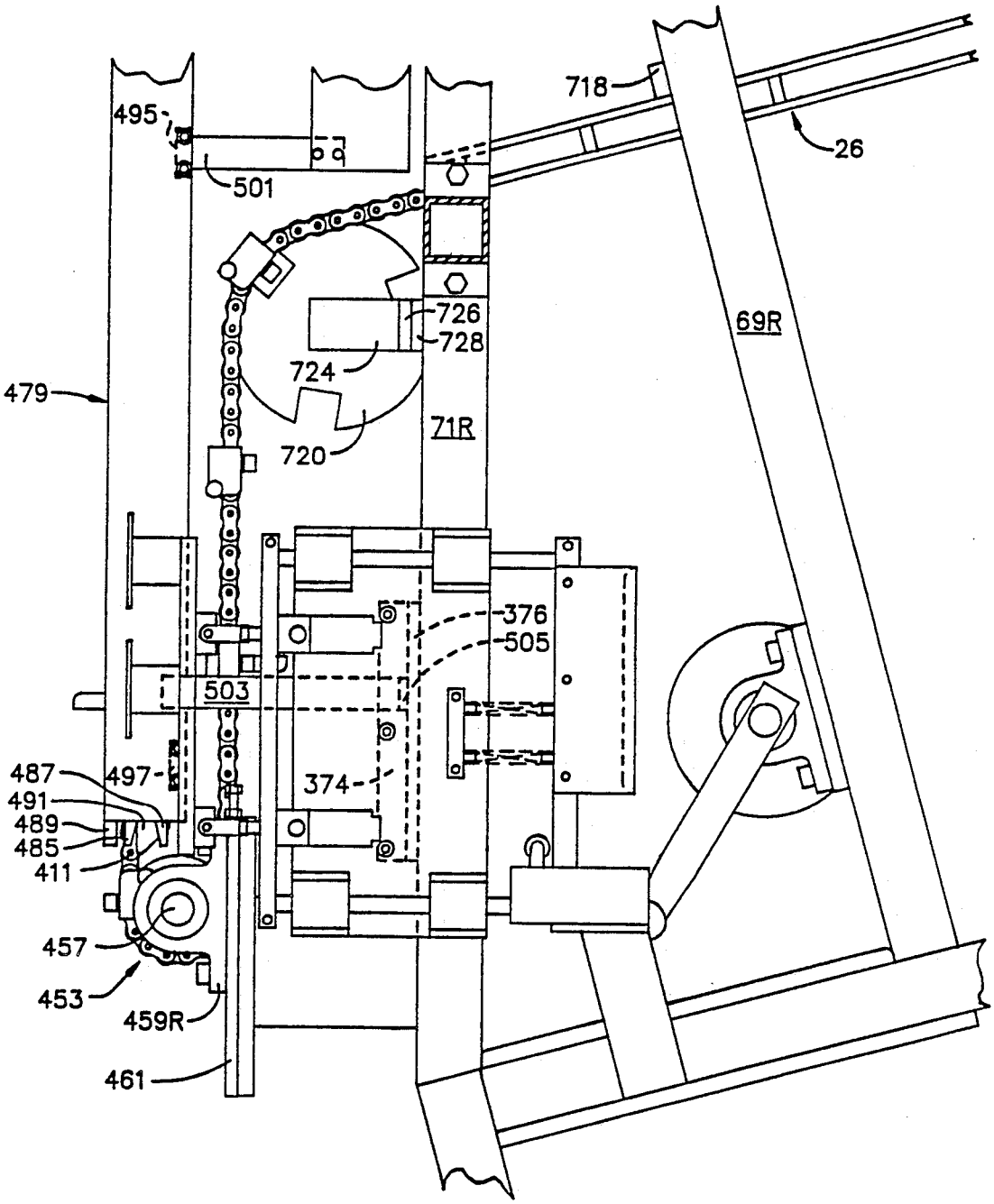
FIG. 25A is a view in side elevation showing details of track mounting for a flight chain of the machine.
Figure 25B:
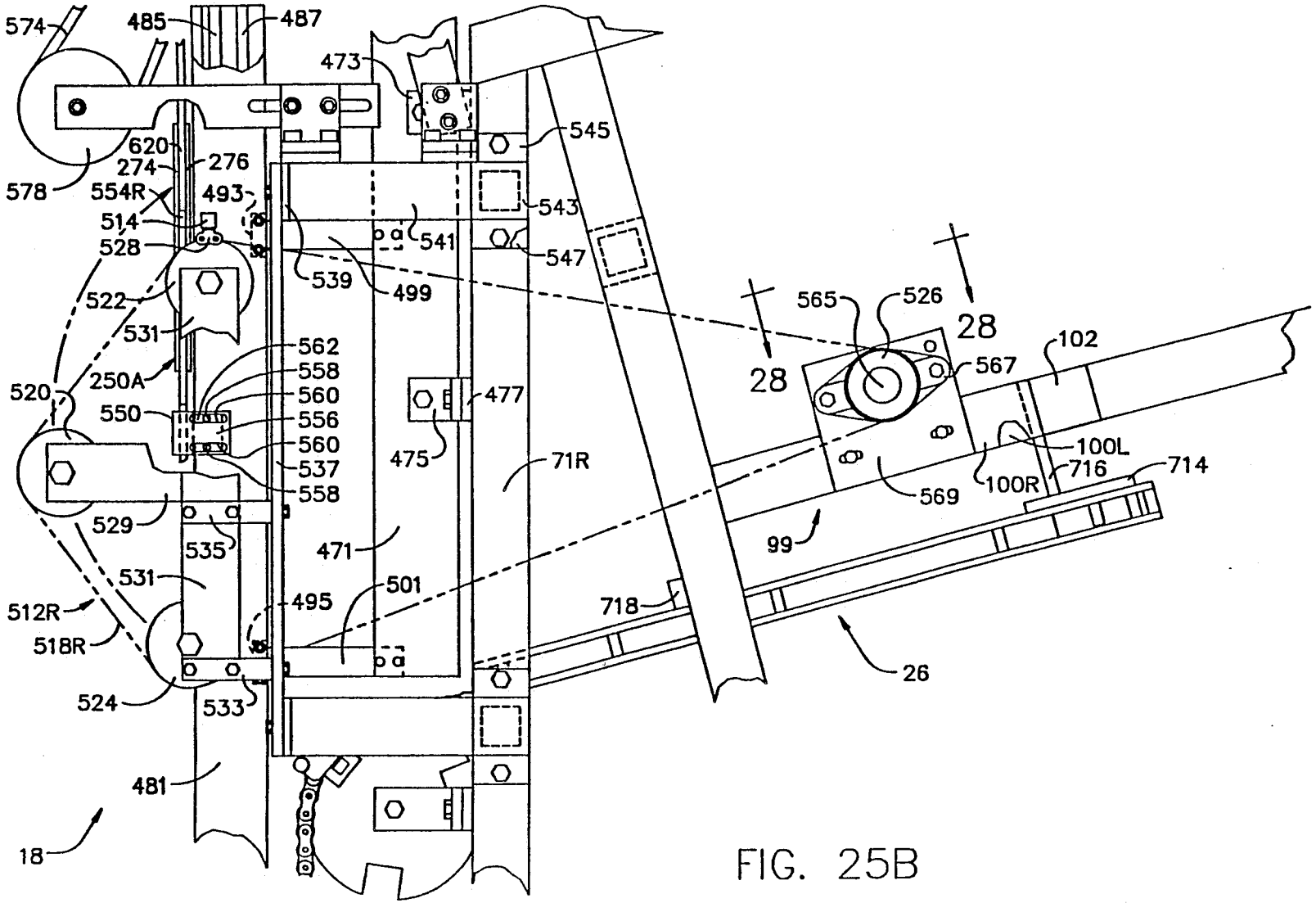
FIG. 25B is a fragmentary view in side elevation showing details of a folder assembly of the machine.
Figure 25C:
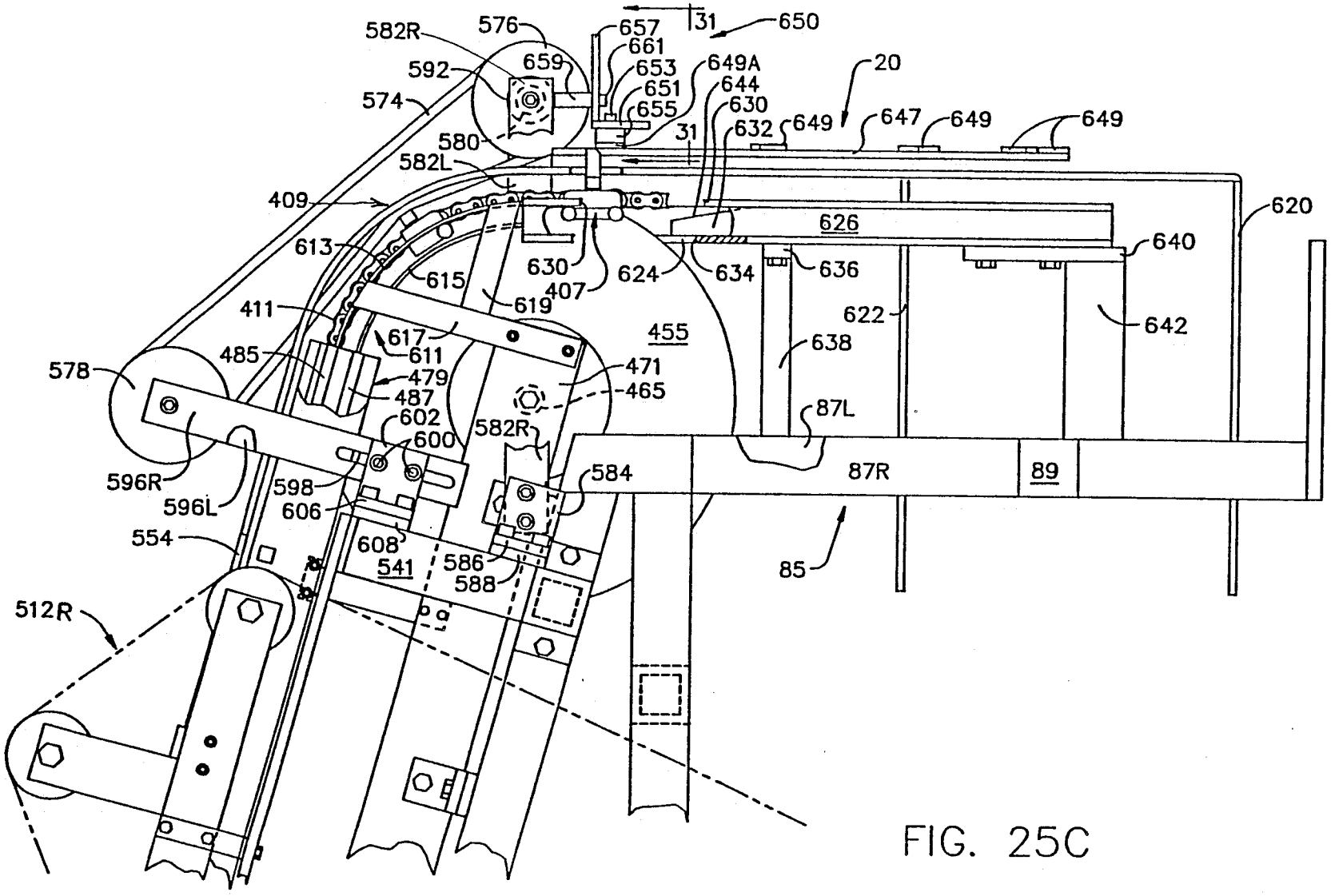
FIG. 25C is a fragmentary view in side elevation showing mounting for an overhead belt and associated structures of the machine.
Figure 26A:
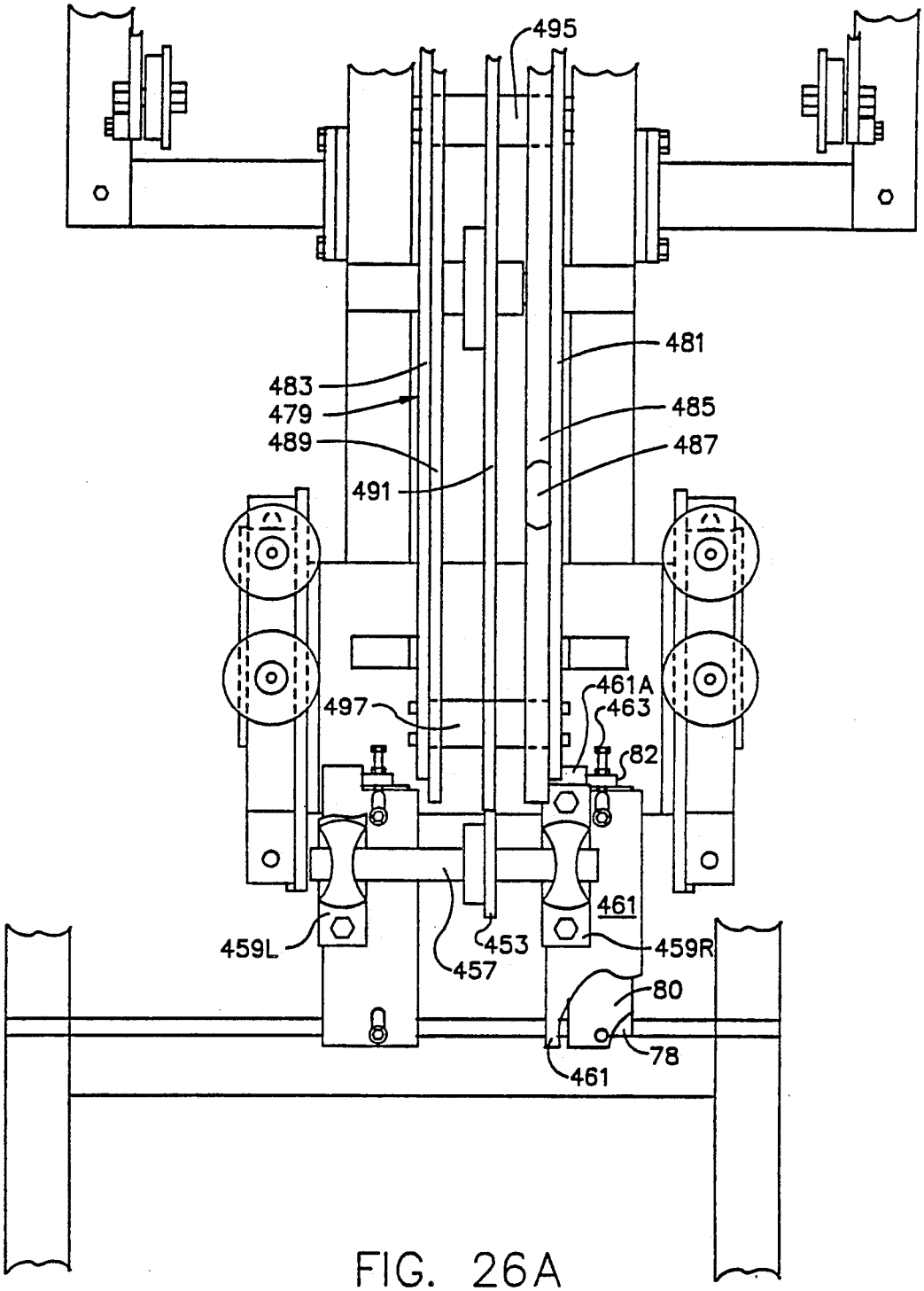
FIG. 26A is an end elevational view showing details of a vacuum cup assembly of the machine, parts being broken away to show details of construction.
Figure 26B:
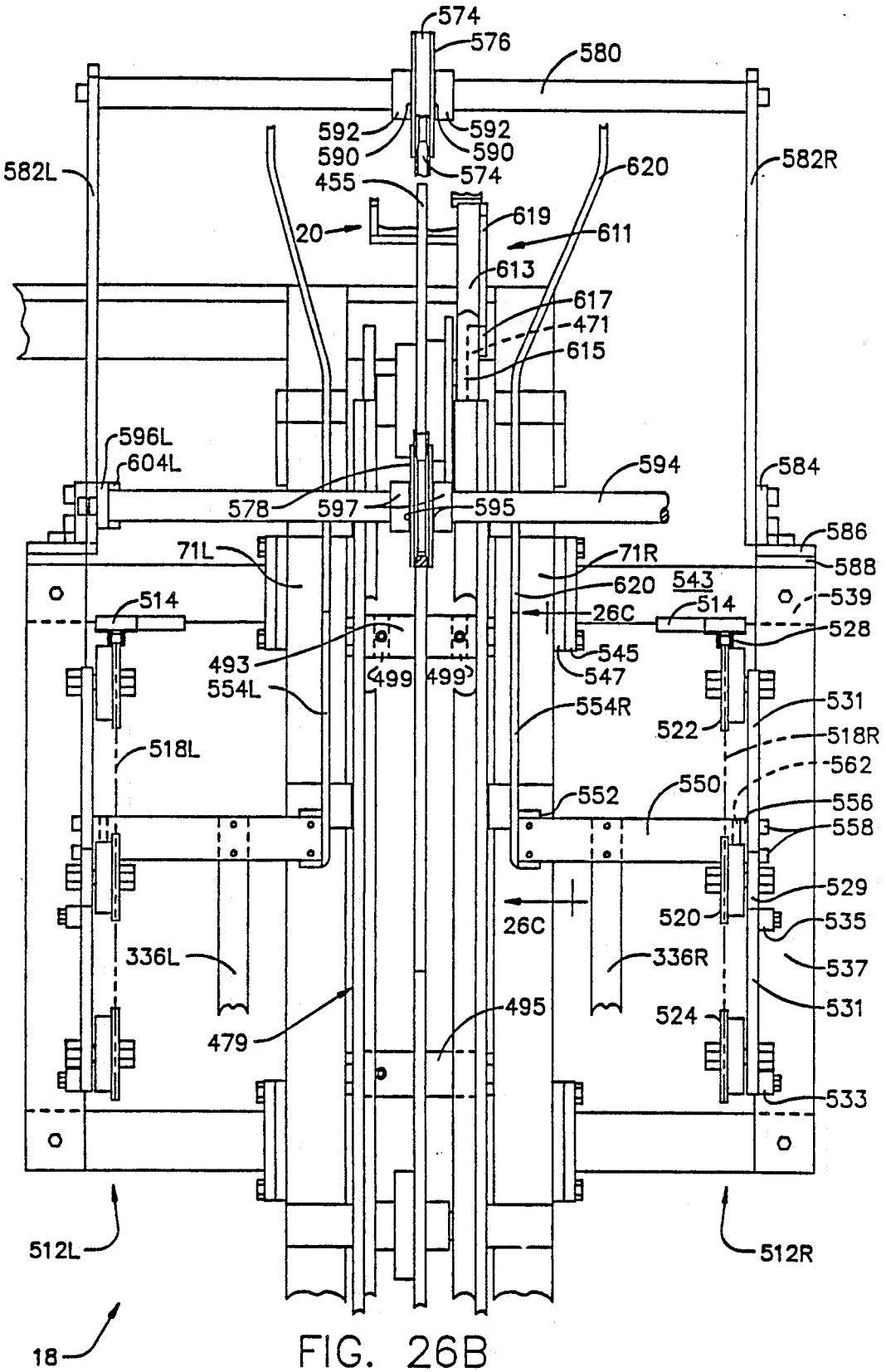
FIG. 26B is an end elevational view of the overhead belt and associated structures.

The flight chain 411 passes clockwise about a bottom takeup idler sprocket 453 and passes upwardly of the flight assembly 16 to pass clockwise over the top of a drive sprocket 455 as is better shown in FIGS. 25C and 26B.

The bottom takeup idler sprocket 453 is fixedly attached to the approximate center of a lower idler shaft 457 that is in turn rotatably mounted in a pair of bearings 459R and 459L, as is shown in FIGS. 25A and 26A. The right hand bearing 459R is fixedly attached to the input surface of, and adjacent the upper left hand edge of, a slide plate 461 that is in turn adjustably mounted in an upright direction upon the input face of the mount plate 80 of the bottom frame 43 (FIG. 3). The adjustment lug 82 threadably incorporates an adjustment bolt 463 that bears downward upon the top edge of slide plate 461 to bring tension into the flight chain 411. An upper left hand corner 461A of the slide plate 461 is extended upwardly past the left edge of the adjustment lug 82 to assist in proper vertical alignment of the pair of bearings 459R and 459L during the tensioning procedure. The left hand bearing 459L is mounted upon the left hand bearing mount 76L of the bottom frame 43 in exactly the same manner just described for the right hand bearing 459R.

Figure 27:
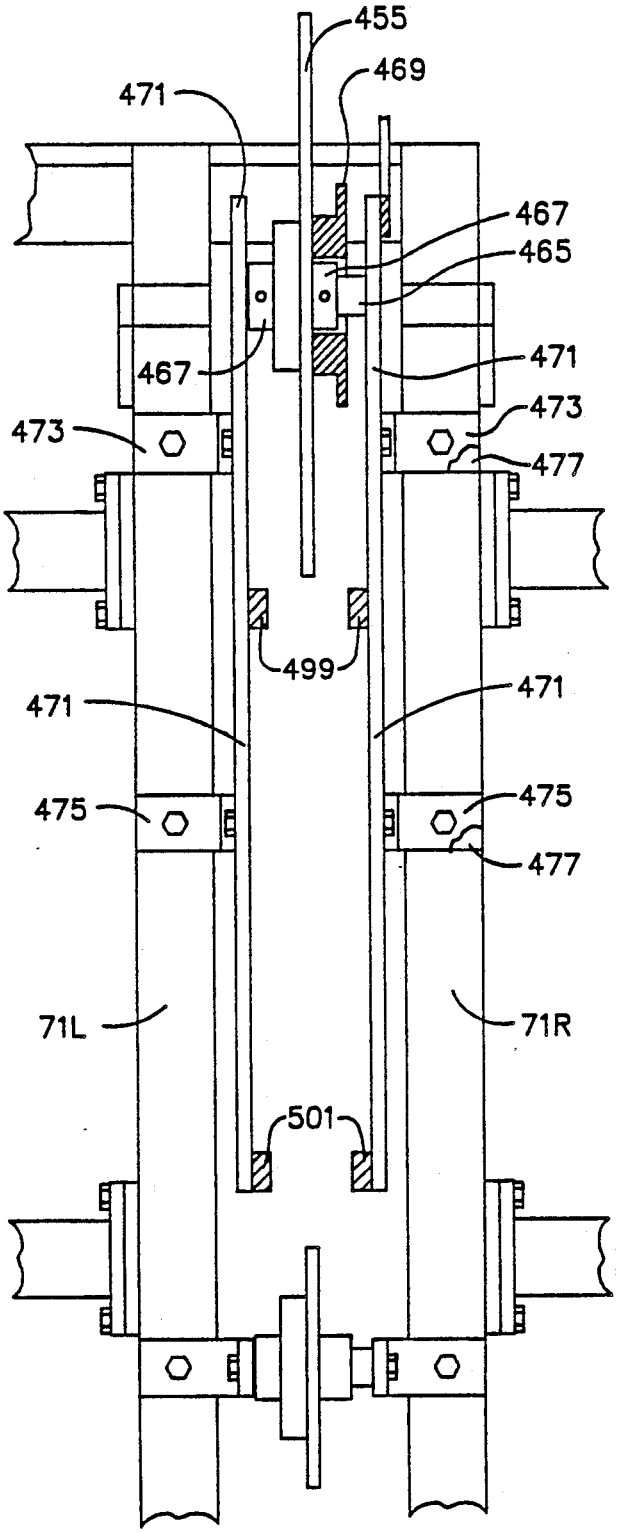
FIG. 27 is an upright substantially end elevational view showing supports for a drive shaft and sprocket of the machine.

The driven sprocket 455, shown in FIGS. 25C and 27, is rotatably mounted upon a stationary shaft 465 and held in lateral place thereupon by a pair of shaft collars 467. A drive sprocket 469 is bored out to fit over the right hand member of the pair of shaft collars 467 in order to permit fixed attachment to the right side of the driven sprocket 455. The stationary shaft 465 is fixedly attached between the upper ends of a pair of frame plates 471. The frame plates 471 are fixedly attached to the inboard surface of a pair of upper "L" brackets 473 and a pair of lower "L" brackets 475, as is also shown in FIG. 25B. The lateral legs of the upper and lower pairs of "L" brackets 473 and 475 respectively are fixedly attached upon input surfaces of a set of four unit plates 477. The set of four nut plates 477 is rigidly affixed to the input surface of the pair of inclined uprights 71R and 71L of the upper frame 45 of the main frame 41. The pair of upper "L" brackets 473 is located at the top of the pair of inclined uprights to support the upper portion of the pair of frame plates 471, while the pair of lower "L" brackets 475 supports the lower third thereof in inverted overhung form.

As previously described, driver assemblies 407 and holder assemblies 409 are mounted to flight chain 411. As the chain leaves the bottom takeup idler sprocket 453, the driver assemblies 407 must be held in proper orientation for successful pickup and vertical transportion of the paritition 250A. As is shown in FIGS. 17, 25A, 25B, 26A and 26B, this is achieved by a cam track 479 that is comprised of right and left side guide plates 481 and 483 respectively, input and output cam rails 485 and 487 respectively, a left side cam guide 489, and a chain rail 491.

The right and left side guide plates 481 and 483 respectively are fixedly held in lateral spaced relationship with each other by top, middle, and bottom mount bars 493, 495 and 497 respectively, that are spacedly affixed along the output edges thereof. The top mount bar 493 and the middle mount bar 495 are fixedly attached to the input extremities of pairs of top and middle standoff bars 499 and 501, respectively (FIG. 25B). The elements of each pair of standoff bars 499 and 501 are inset somewhat from the right and left extremities of the top mount bar 493 and middle mount bar 495 so their outboard surfaces will be aligned with the inboard surfaces of the pair of frame plates 471 to which they are fixedly attached, as is more clearly shown in FIG. 27. The top standoff bars 499 are positioned at a vertical location upon the pair of frame plates 471 and cam track 479 to bring the top extremities of the right and left side guide plates 481 and 483 respectively inot juxtaposition with the input tangent of the driven sprocket 455. The lower end of the cam track 479 is fixedly held in place above the bottom takeup sprocket 453 by a pair of bottom standoff bars 503 (FIGS. 17 and 25A) that extend in the output direction to be rigidly affixed upon the inboard end of a pair of mounting feet 505. The mounting feet 505 extend outboardly to be fixedly attached to the input surface of the pickoff mount plate 376.

The input cam rail 485 (FIGS. 17, 18 and 26A) and the outpul cam rail 487 are fixedly attached to the inboard surface of the right side guide plate 481 and are so spaced in parallel relationship to form a guide channel 507 (FIG. 17), through which the right side cam rolls of the driver and holder assemblies 407 and 409 pass. The lower ends of the input and output cam rails 485 and 487 respectively incorporate chamfers 509 and 511 (FIG. 18) respectively, and being opposedly mounted, form a tapered inlet to the guide channel 507.

The chain rail 491 is fixedly attached across the input surfaces of the top, middle and bottom mount bars 493, 495, 497 respectively (FIGS. 26A and 26B), and centrally located thereupon to be in parallel spaced relationship between the right and left side guide plates 481 and 483, respectively. The input surface of the chain rail 491 provides a surface upon which the rollers of the flight chain 411 can run, keeping the chain in straight line as it ascends upward to the driven sprocket 455. The left side cam guide 489 is fixedly attached along the input inboard edge of the left side guide plate 483. The left side cam guide 489 captures the laterally disposed left side cam rollers of the driver and holder assemblies 407 and 409 respectively to assure the lateral orientation thereof as shown in FIG. 17.

Folder Assembly

As the driver assembly 407 of the flight assembly 16 inserts its driver tines 425 into the upper ends of the two vertical slots 272 of the partition 250A (FIG. 18), vacuum is released from the suction cups 352, permitting partition 250A to move upwardly, inserting the upper edge thereof behind or on the output side of the splitter bars 336R and 336L. The side rollers 313R and 313L have restrained the upper edge of the bottom half 274 as the partition 250A moves upwardly, causing the upper edge of the bottom half 274 to pass between the upper rollers 269R and 269L and the input side of the splitter bars 336R and 336L. As the partition 250A travels upwardly, its bottom half 274 is rotated clockwise about its top edge to stand uprightly in parallel relationship with the top half 276. This is accomplished by the folder assembly 18.

The folder assembly 18 is comprised of a right and left side chain assembly 512R and 512L, respectively, as is shown in FIGS. 25B and 26B. The right side chain assembly 512R incorporates a folder bar 514, a right side chain 518R, an input sprocket 520, an upper and a lower sprocket 522 and 524 respectively, and a drive sprocket 526.

The folder bar 514 is a short length of square rod whose inboard half incorporates rounded corners. The square end permits fixed attachment to the laterally disposed flanges of an attachment link 528 of the right side chain 518R. The right side chain 518R incorporates two equally spaced folder bars 514 (only one of which is shown). The right side chain 518R passes clockwise with respect to FIG. 25B about the input, upper, drive and lower sprockets 520, 522, 526, and 524, respectively. The upper and lower sprockets 522 and 524 are rotatably mounted at opposing ends of, and upon the inboard surface of, an upright mount plate 531. The input sprocket 520 is likewise mounted to the input inboard surface of a standoff arm 529 that is in turn rigidly affixed at its output extremity to the input edge of the upright mount plate 531. The upright mount plate 531 is fixedly attached to the left sides of, and at the input ends of, a lower mount bar 533 and a middle mount bar 535, both of which extend therefrom in the output direction to be fixedly attached upon the face of, and favoring the lower left hand portion of, an upright plate 537. The upper end of the upright plate 537 is fixedly attached to a cap 539 that is in turn rigidly affixed to the input extremity of a square tube 541. The square tube 541 is rigidly affixed at its output extremity to the input surface of, and at the right hand end of a lateral tube 543. The inboard end of the lateral tube 543 is rigidly affixed to a flange plate 545 that is in turn fixedly attached upon the right hand surface of a nut block 547. The nut block 547 is rigidly affixed to the outboard face of, and adjacent the top end of, the right hand inclined upright 71R of the upper frame 45 of the main frame 41.

The lower end of the upright plate 537 is mounted in the same manner as the upper end thereof, just described, to the right hand surface of, and just above the pickoff assembly of the right hand inclined upright 71R of the upper frame 45.

Figure 26C:
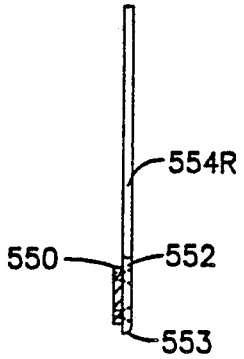
FIG. 26C shows details of a splitter rod and rod mount of the machine.

The top end of the splitter bar 336R (FIG. 26B) of the input hopper 12 is fixedly attached at its upper end to the output surface of a rod mount 550. The rod mount 550 extends to the left from the splitter bar 336R to fixedly incorporate upon its onput surface, and at the left end thereof, a rod block 552. The rod block 552 provides mounting for a splitter rod 554R that is rigidly affixed in upstanding manner along the left edge thereof. The bottom output edge of the rod block 552 incorporates an edge radius 553 to provide a guided entry for the leading edge of the partition 250A, as is better shown in FIG. 26C.

The right end of the rod mount 550 (FIG. 26B) is rigidly affixed to the inboard surface of, and along the input edge of, a slide base 556. Fasteners 558 pass through clear holes in the upright mount plate 531, through longitudinal slots 560 (FIG. 25B) in the slide base 556 (FIG. 26B), and threadably mount into a clamp plate 562, thus permitting longitudinal adjustment of the rod mount 550 and splitter rod 554R.

As described previously, the folder chain 518R circumscribes the drive sprocket 526 in the clockwise direction with respect to FIG. 25B. The drive sprocket 526 is also shown in FIG. 25 and is fixedly attached upon the right end of a folder shaft 565. The folder shaft 565 is rotatably mounted in a pair of flange bearings 567. The flange bearings 567, in turn, are fixedly attached to the outboard surfaces of a pair of upstanding bearing plates 569. The upstanding bearing plates 569 are adjustably clamped to the outboard surfaces of the pair of lower frame members 100R and 100L in order to provide longitudinal adjustment for tensioning the right side chain 518R. A crossover bar 571 is fixedly attached between, and located at the upper output corners of the upstanding bearing plates 569 so tensioning adjustments accomplished for the right side chain assembly 512R can more easily be made for the left side chain assembly 512L. The left side chain assembly 512L is driven by a drive sprocket 573 that is fixedly attached to the left end of the folder shaft 565. In all other respects, the left side chain assembly 512L is a mirror image of the right side chain assembly 512R in both structure and mounting.

Figure 26D:
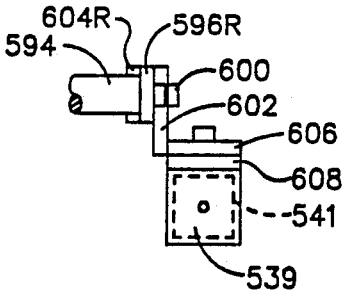
FIG. 26D shows details of a tension bar of the machine.
Figure 26E:
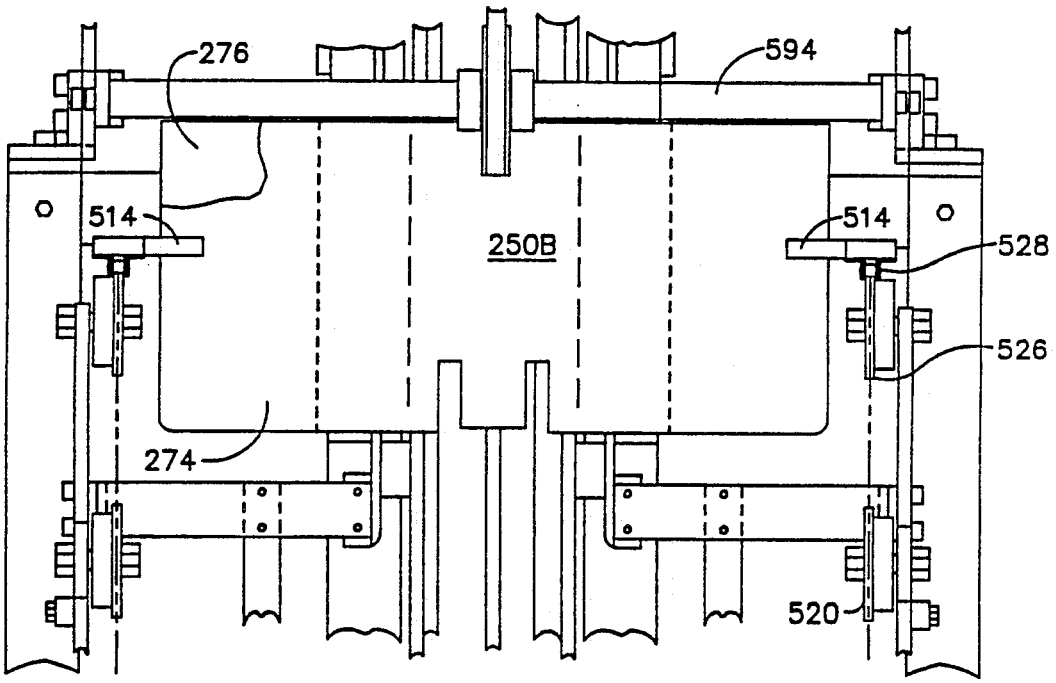
FIG. 26E shows a partition in folded position in association with partition supporting structures of the machine.
Figure 28:
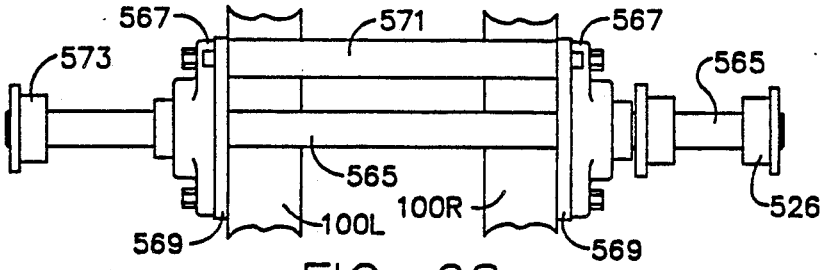
FIG. 28 is a fragmentary view showing supports for a folder shaft of the machine.

As previously described in some detail, the folder assembly 18, by virtue of its folder bars 514, rotates the bottom half 274 of each partition 250A in the clockwise direction (as shown in FIG. 18) into juxtaposition with the input surface of the top half 276 as is shown in FIGS. 25B and 26E. The folder bars 514 will bend the outboard portions of the folded partition 250B in the output direction until they clear the partition completely. The folded partition 250B has risen into working relationship with an overhead belt 574 preventing the folded partition 250B from opening.

The overhead belt 574 and its mounting structure are shown in FIGS. 25C and 26B. The overhead belt 574 lies in the same upright longitudinal plane as does the flight chain 411. The overhead belt 574 moves in a counter clockwise direction (with respect to FIG. 25C) about an upper pulley 576 and a lower pulley 578. The upper pulley 576 is rotatably mounted upon the center of an upper bar 580 that is in turn fixedly attached between the upper ends of a right hand overhead riser 582R and a left hand overhead riser 582L. The overhead riser 582R is fixedly attached at its bottom end to the left hand face of a vertical mount block 584. The bottom edge of the vertical mount block 584 is rigidly affixed to the top surface of, and along the left edge of, a horizontal base 586 that is in turn fixedly attached to a nut block 588. The nut block 588 is fixedly attached to the top surface of, and adjacent the output end of, the square tube 541 of the upper mounting structure of the right hand chain assembly 512R of the folder assembly 18. The left hand overhead riser 582L is mounted in mirror image to the right hand overhead riser 582R upon the left side structure of the left side chain assembly 512L of the folder assembly 18. The upper pulley 576 is held in lateral place by a pair of thrust washers 590 and a pair of shaft collars 592. The collars 592 are fixedly attached to the upper bar 580.

The lower pulley 578 is rotatably mounted upon the center of a lower bar 594 that is in turn fixedly attached between the unsupported ends of right and left tension bars 596R and 596L. The lower pulley 578 is held in lateral place by thrust washers 595 and shaft collars 597.

The right hand tension bar 596R, as seen in FIGS. 25C and 26D, incorporates an elongated slot 598 that lies coincident with the centerline of the part adjacent the output end thereof. Bolts 600 pass through clear holes in an upstanding mount 602, through the elongated slot 598 of the tension bar 596R and threadably mount into a right side nut block 604R that is best shown in FIG. 26D. The upstanding mount 602 is rigidly affixed along its lower outboard surface to the inboard edge of a horizontal mount block 606 that is in turn fixedly attached to a nut plate 608. The nut plate 608 is rigidly affixed to the top surface of, and at the input end of, the square tube 541 of the right side chain assembly 512R mounting structure.

The right side cam rollers of the driver and holder assemblies 407 and 409 respective of the flight chain 411 exit the cam track 479 to enter an arcuate track 611 that is comprised of an outside track 613, an inside track 615, a horizontal support 617, and a vertical support 619. The output surface of the bottom end of the outside track 613 is held adjacent to the top output corner of the input cam rail 485 by being rigidly affixed to the inboard surface of, and at the input end of, the horizontal support 617. The input surface of the bottom end of the inside track 615 is held in vertical alignment with the top input corner of the output cam rail 487 by being rigidly affixed to the inboard surface of the horizontal support 617 in spaced relationship with the outside track 613. The output end of the horizontal support 617 is fixedly attached along the top right hand surface of the right hand member of the pair of frame plates 471. The outside and inside tracks 613 and 615 are rigidly affixed in constant spaced relationship as they rise upwardly and arc into a horizontal plane by being rigidly affixed to the inboard surface of, and at the upper end of, the vertical support 619. The bottom extremity of the vertical support 619 is rigidly affixed to the top edge of, and at approximately the center of, the horizontal support 617. The outside and inside tracks 613 and 615 terminate adjacent the input end of the upper curved track 20. The arc of the arcuate track 611 is such as to guide the right hand cam rollers of the driver and holder assemblies 407 and 409 respectively about the pitch circumference of the driven sprocket 455 in such place that driver and holder assemblies 407 and 409 and the flight chain 411 remain in perpendicular relationship with the driven sprocket 455.

Figure 29:
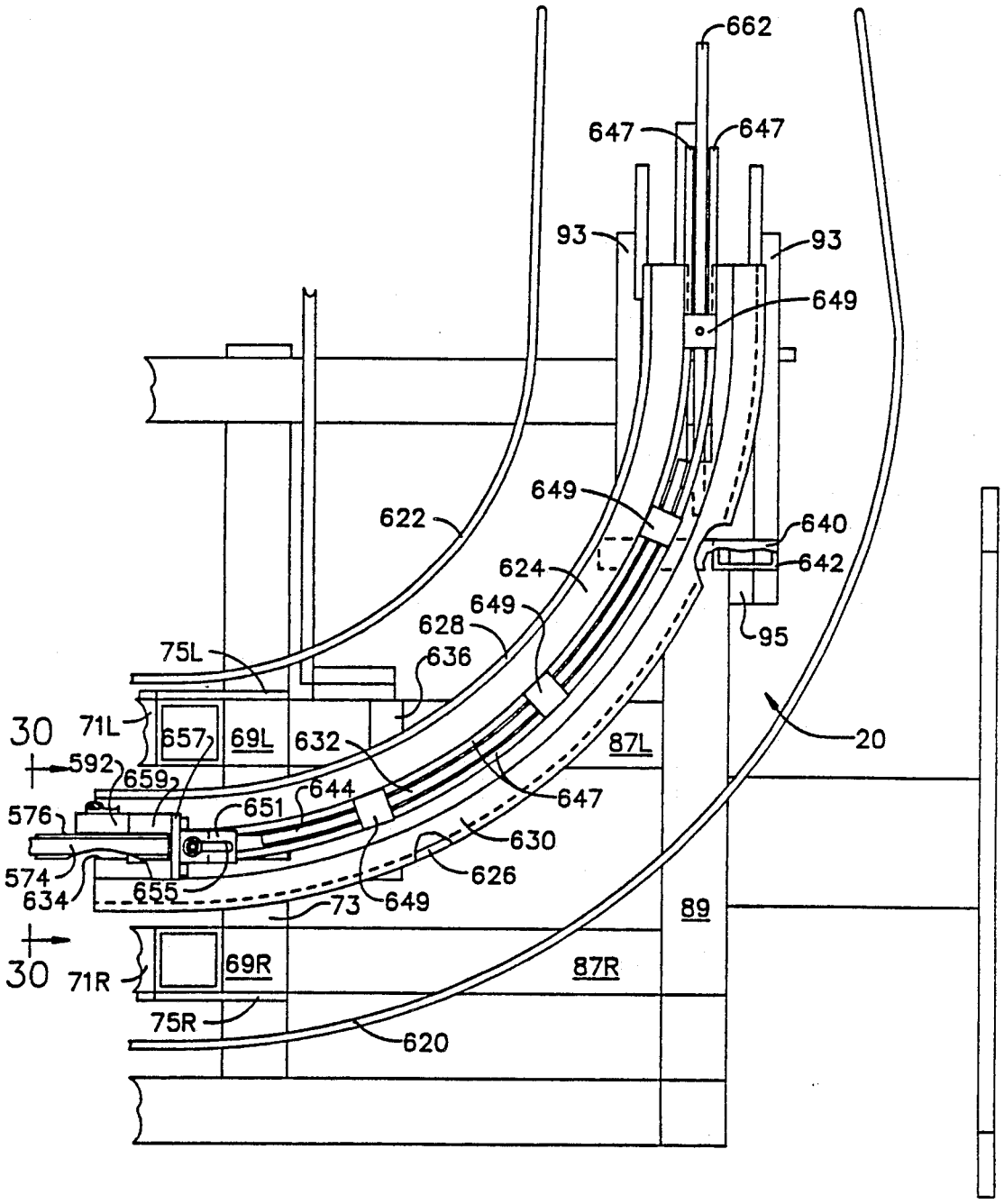
FIG. 29 is a fragmentary plan view of chain and side guide members of the machine.

Referring to FIGS. 25B and 26B, the top extremity of the right hand splitter rod 554R of the folder assembly 18 provides a rigid attachment point for an outside flap guide rod 620 that passes upwardly, then laterally outward to come into widely spaced arcuate relationship with the upper curved track 20 as is shown in FIG. 29. Similarly, the top extremity of the left hand splitter rod 554L of the folder assembly 18 provides a rigid attachment point for an inside flap guide rod 622 that passes upwardly, then laterally outward to come into widely spaced arcuate relationship along the inner radius of the upper curved track 20. Both inside and outside flap guide rods 620 and 622 are rigidly affixed at their output extremities within the confines of the tamp-down assembly 24, as will be described in detail hereinafter. The outside and inside flap guide rods 620 and 622 keep the top half 276 separated from the bottom half 274 of the folded partition 250B as it enters the upper curved track 20.

Upper Curved Track

Figure 30:
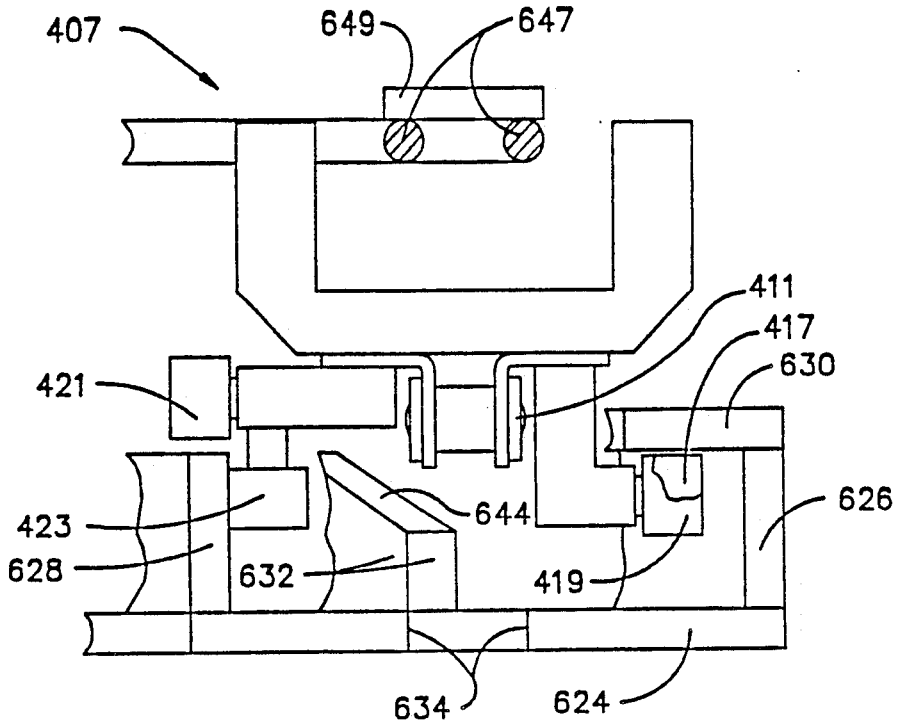
FIG. 30 is a fragmentary generally elevational view, partly in section, of chain guides and supports for the machine.

The upper curved track 20 is best shown in FIGS. 25C, 29 and 30. Starting with FIG. 30, the upper curved track 20 is comprised of a bottom plate 624, a right side wall 626, a left side wall 628, a right side cover plate 630, and an arcuate chain rail 632.

The inlet end of the bottom plate 624 incorporates a slot 634 into which driven sprocket 455 extends so that the input extremity of the upper curved track 20 lies tangent to the top of the driven sprocket 455. The right side wall 626 is rigidly affixed upon the top surface of, and along the right hand edge of, the bottom plate 624. In similar manner, the left side wall 628 is rigidly affixed upon the top surface of, and along the left edge of, the bottom plate 624. Both side walls are of the same height. The right side cover plate 630 is rigidly affixed upon the top edge of the right side wall 626 and extends radially inward therefrom to form a partial cover to the upper curved track 20. The arcuate chain rail 632 is rigidly, affixed upon the top surface of, and along the centerline of, the bottom plate 624.

The upper curved track 20 is fixedly attached upon the top surface of an input lateral bar 636 that is located just downstream of the driven sprocket 455. The left end of the input lateral bar 636 is rigidly affixed upon the top extremity of a riser bar 638 that is in turn rigidly affixed upon the top surface of the top frame member 87L of the upper frame extension 85. The output end of the upper curved track 20 is fixedly attached upon a longitudinal bar 640 that extends in the output direction. The extended end of the longitudinal bar 640 is rigidly affixed upon the top extremity of an output riser bar 642 that is in turn rigidly affixed to the top surface of, and at the left hand end of, the upper lateral member 89 of the upper frame extension 85. The output riser bar 642 also overlies the output members of the spacer blocks 95 and the tines 93.

The flight chain 411 leaves the driven sprocket 455 horizontally and passes in the output direction to ride upon the top of the arcuate chain rail 632. The top input corner of the otherwise rectangular arcuate chain rail 632 incorporates an entry slope 644 to assure proper entry of the flight chain 411. As is most clear in FIG. 30, the first and second cam rollers 417 and 419 of the driver assemblies 407 and the lead cam rollerl 440 of the holder assemblies 409, cooperate with the underside of the right side cover plate 630 to hold the flight chain 411 in a horizontal plane as it is pulled through the upper curved track 20. The fourth cam roller 423 of the driver assemblies 407 and the left side cam roller 442 of the holdef assemblies 409 cooperate with the right hand surface of the left side wall 628 to hold the flight chain 411 in arcuate cooperation with the arcuate chain rail 632.

Driver assemblies 407 motivate folded partition 250B about the upper arcuate track 20, while the outside and inside flap guide rods 620 and 622 respectively keep the top and bottom halves 276 and 274 of the folded partition 250B separated, as previously described. The bottom half 274 is restrained from opening upward by a pair of overhead bars 647 that follow the same arcuate path as the arcuate chain rail 632. The individual members of the pair of overhead bars 647 are held in parallel spaced relationship by a plurality of spacer blocks 649. The spacer blocks 649 are rigidly affixed upon the top of the pair of overhead bars 647.

Figure 31:
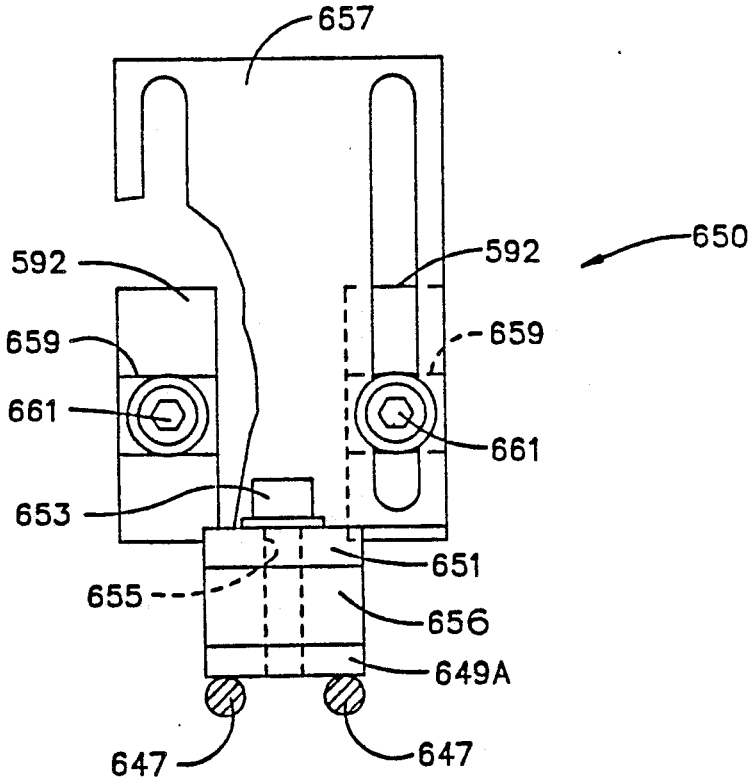
FIG. 31 is a view in upright section showing details of a slotted plate assembly of the machine.

A first spacer block 649A (FIGS. 25C, 29 and 31) is fixedly clamped to an input adjustment assembly 650 that incorporates a longitudinal mount 651. A bolt 653, with washer, passes downwardly through a slot 655 in the longitudinal mount 651, downwardly through a clear hole in a spacer 656, to mount into a threaded hole in the first spacer block 649A, thus permitting the input ends of the overhead bars 647 to be longitudinally adjusted. A vertical slotted plate 657 is rigidly affixed along its bottom edge to the top surface of, and at the input edge of, the longitudinal mount 651. The vertical slotted plate 657 is adjustably clamped to the input extremities of a pair of cantilever bars 659 by a pair of bolt and washer assemblies 661. The cantilever bars 659 are rigidly affixed at input extremities to the shaft collars 592 of the assembly pertaining to the overhead belt 574. Thus, input ends of the overhead bars 647 are adjustable in vertical height, as well as longitudinal position.

Chain, Output Side

The flight chain 411 exits the confines of the upper curved track 20 travelling horizontally to the left of the main frame 41. The flight chain 411 comes into tangential working relationship with the top of an output idler sprocket 662 and passes about it in the clockwise direction with respect to FIG. 32. The flight chain 411 leaves the output idler sprocket 662 vertically downward to come into clockwise working relationship with a return idler sprocket 664.

Figure 32:
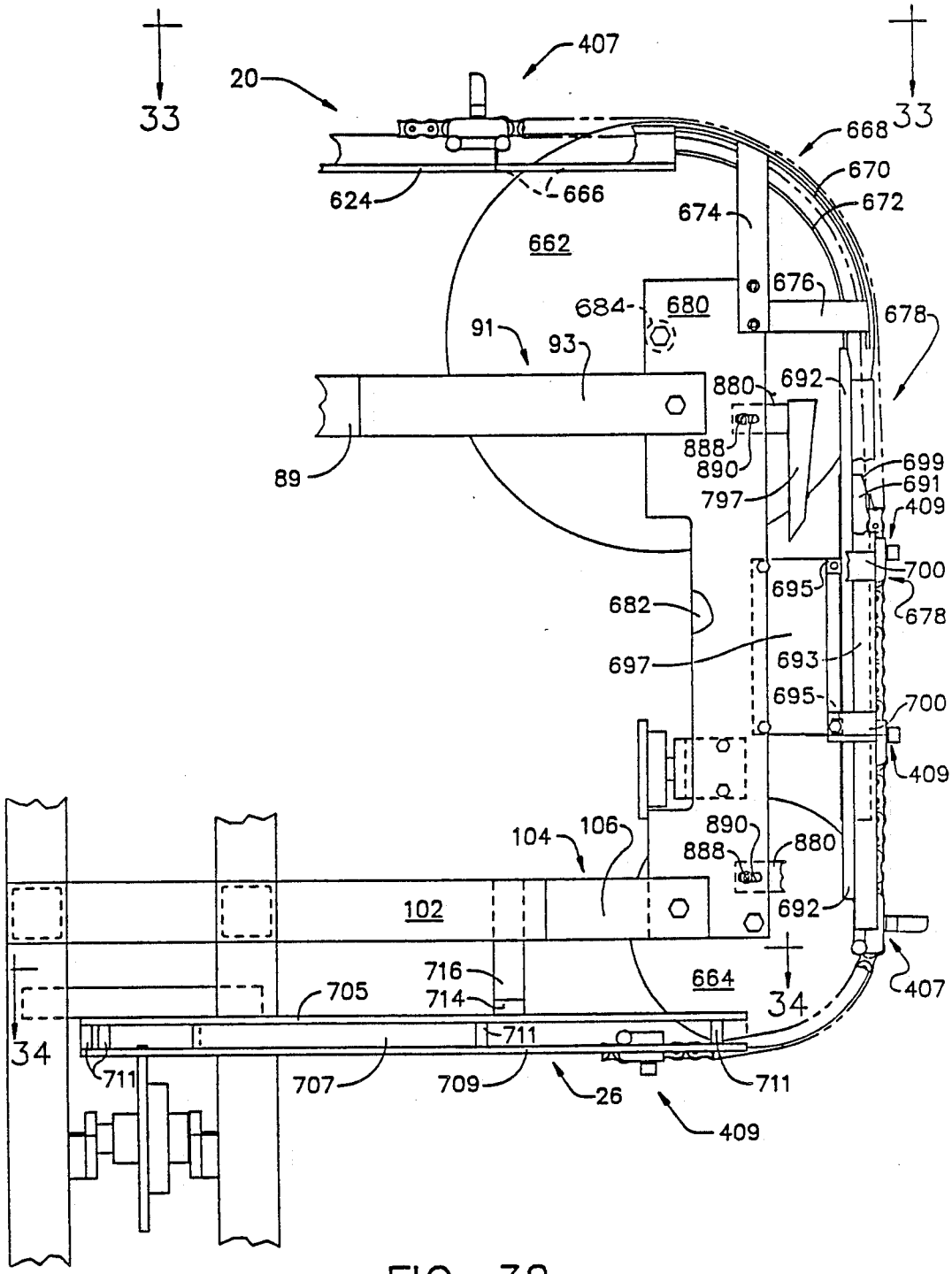
FIG. 32 is a fragmentary view in front elevation showing upright chain guides of the machine.

The output end of the bottom plate 624 of the upper curved track 20 incorporates a slot 666 (FIG. 33) to permit the upper curved track 20 to reach about each side of the output idler sprocket 662, thus providing adequate guidance to the flight chain 411 as it transitions from the upper curved track 20 to the output idler sprocket 662. As can be seen in FIG. 32, the right hand cam rollers of the driver and holder assemblies 407 and 409 respectively leave the upper curved track 20 t enter an output arcuate track 668.

The output arcuate track 668 is comprised of an outside curve 670, an inside curve 672, a vertical mount 674, and a lateral mount 676. The outside and inside curves 670 and 672, respectively, are rigidly affixed to the input surface of, and at the upper end of, the vertical mount 674 in arcuate spaced relationship. The vertical mount 674 is located adjacent the input ends of the outside and inside curves 670 and 672. The output ends thereof are rigidly affixed to the input face of, and at the extended end of the lateral mount 676 to communicate with an output cam track 678. The right hand extremity of the lateral mount 676 is rigidly affixed to the lower left hand edge of the vertical mount 674. The bottom portion of the vertical mount 674 is fixedly attaahed to the output surface of, and at the upper leflt hand corner of, an output plate 680. The output plate 680 is fixedly attached to the input surfaces of, and at unsupported ends of, the output members of the tines 93 and 106 of large and small sprocket yokes 91 and 104, respectively. A companion output plate 682 is similarly attached to the output surfaces of the unsupported ends of the input members of the tines 93 and 106 of the large and small sprocket yokes 91 and 104, respectively.

The output idler sprocket 662 is rotatably mounted upon a bar 684 that is in turn fixedly attached between the upper right hand corners of the output plate 680 and the companion output plate 682. The output idler sprocket 662 is held in proper longitudinal place upon the bar 684 by pairs of thrust washers 686 and shaft collars 688. The return idler sprocket 664 is rotatably mounted between the lower left hand corners of the output plate 680 and companion output plate 682 in the same manner as the output idler sprocket 662.

Figure 33:
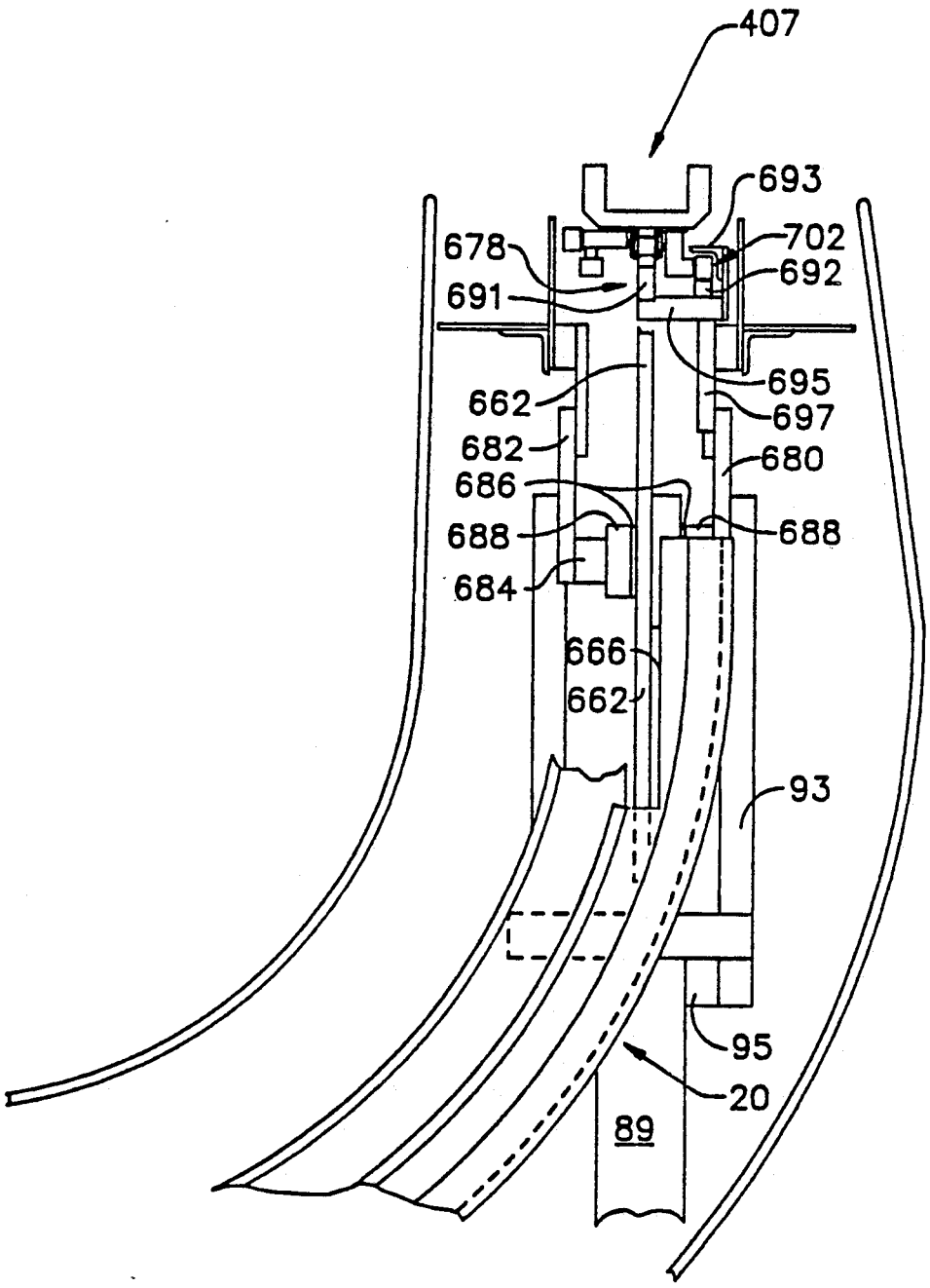
FIG. 33 is a plan view of an upper curved track assembly of the machine.

The flight chain 411 is held in proper perpendicular relationship with the plane of the output idler sprocket 662 by the output arcuate track 668 in cooperation with the first and second cam rollers 417 and 419 respectively of the drive assemblies 407, and the lead cam rollers 440 of the holder assemblies 409. The driver and holder assemblies 407 and 409 respectively leave the bottom of the output arcuate track 668 and move downwardly into guided relationship with the input cam track 678, as is shown in FIGS. 32 and 33.

The output cam track 678 incorporates a vertical chain rail 691, a guide bar 692, and an angle rail 693. The vertical chain rail 691 is rigidly affixed in recesses in the left hand face of, and at the input end of, a pair of square bars 695. The square bars 695 are rigidly affixed near output ends to the left hand edge of a chain rail mount plate 697, that is in turn fixedly attached to the input face of and adjacent the middle left edge of the output plate 680. The upper left hand edge of the vertical chain rail 691 incorporates a chamfer 699 to facilitate the entry of the flight chain 411.

The guide bar 692 (FIGS. 32 and 33) is rigidly affixed across the left hand surfaces of the pair of square bars 695 at such vertical and longitudinal position as to cooperate with the inside curve 672 of the output arcuate track 668. Again, the upper left hand edge of the guide bar 692 is chamfered to facilitate the entry of the right side cam rollers of the driver and holder assemblies 407 and 409, respectively.

The laterally disposed flange of the angle rail 693 is rigidly affixed to the left hand input surfaces of a pair of lateral extension mounts 700. The mounts 700 in turn are fixedly attached upon the output extremities of the square bars 695. As is shown in FIG. 33, the angle rail 693 and the guide bar 692 opposedly cooperate to form a channel 702 through which the first and second cam rollers 417 and 419 of the driver assemblies 407 and the lead cam roller 440 of the holder assemblies 409 pass, holding the flight chain 411 inperpendicular orientation with respect to the plane of the output and return idler sprockets 662 and 664, respectively. Both the vertical chain rail 691 and the guide bar 692 extend downwardly to cooperate with the left hand tangent point of the return idler sprocket 664.

Lower Curved Track

The flight chain 411 passes clockwise about one quarter arc of the return idler sprocket 664 to pass horizontally to the right into the lower curved track 26. The lower curved track 26 is shown best in FIGS. 32, 34 and 35 and incorporates a top arcuate plate 705, an inner wall 707, an outer arc 709, and a plurality of spacer posts 711.

The top edge of the inner wall 707 is rigidly affixed to the bottom surface of, and along the inside edge of, the top arcuate plate 705. The outer arc 709 is fixedly held in parallel spaced relationship under the outer edge of the top arcuate plate 705 by the plurality of spacer posts 711. The plurality of spacer posts 711 reside along the outer edges of the top arcuate plate 705 and the outer arc 709 to form a channel 713 (FIG. 35) through which the first and second cam rollers 417 and 419 of the driver assemblies 407 and the lead cam roller 440 of the holder assemblies 409 pass, holding the flight chain up in a horizontal plane. The outer arcuate surface of the inner wall 707 provides a track upon which the fourth cam roller 423 of the driver assemblies 407 and the left side cam roller 442 of the holder assemblies 409 roll, providing a radial force to the flight chain 411 as it is pulled around the arc of the lower curved track 26. The third cam roller 421 of the driver assemblies 407 does not need to cooperate with the bottom edge of the inner wall 707, indeed the holder assemblies 409 do not employ such a roller.

The lower curved track 26 is fixedly attached near its input end to the bottom surface of a crossbar 714 that is in turn rigidly affixed to the bottom extremity of a hanger 716. The hanger 716 is rigidly affixed at its upper end to the input side of the lower lateral member 102 of the lower frame extension 99. It is located adjacent the right end of the tines 106. The output end of the lower curved track 26 is fixedly attached to the bottom edge of a bar mount 718 that is in turn rigidly affixed across the input faces of the pair of vertical uprights 69R and 69L of the upper frame 45. The elevation of the bar mount 718 is shown in FIG. 25B just below the lower frame 99.

Figure 34:
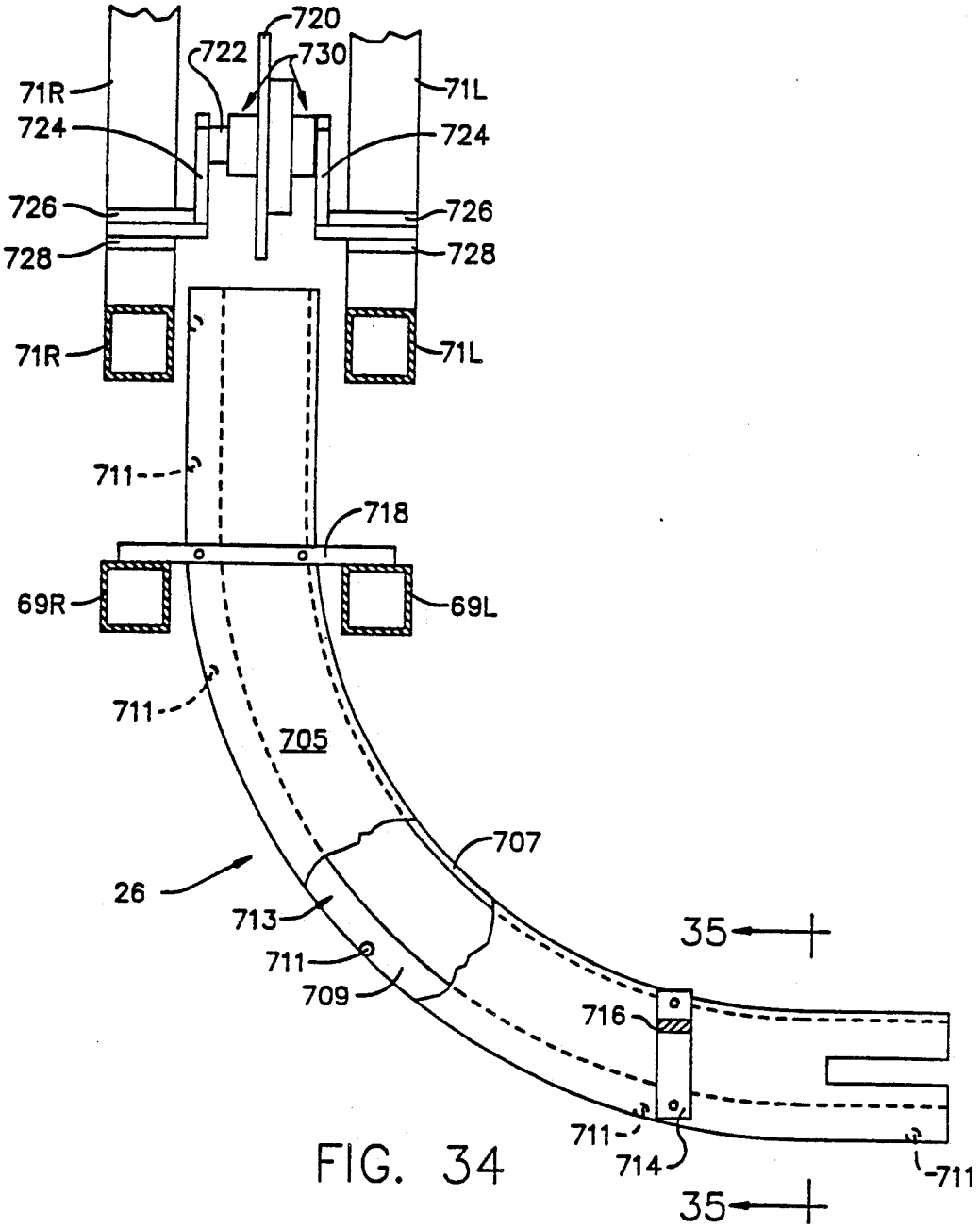
FIG. 34 is a fragmentary plan view of another portion of the curved track assembly.
Figure 35:
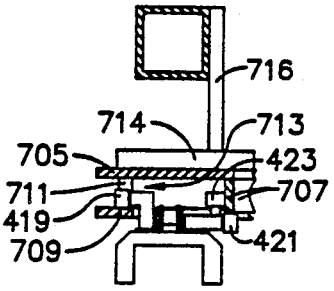
FIG. 35 is a view in section taken on the line 35—35 in FIG. 34.

The flight chain 411 exits the lower curved track 26 to tangentially pass into working relationship with a notched sprocket 720, as is hown in FIGS. 25A and 34. The notched sprocket 720 is rotatably mounted upon a spindle 722 that is in turn fixedly mounted between the extended ends of a pair of mount brackets 724. The mount brackets 724 are fixedly attached at output ends upon the input face of, and along the inboard edges of, a pair of base member 726 that is in turn fixedly attached to nut pads 728. The nut pads 728 are rigidly affixed to the input surfaces of the inclined uprights 71R and 71L. The notched sprocket 720 is held in lateral place upon the spindle 722 with thrust washers and shaft collars 730, as are the previously described sprocket idlers.

The notched sprocket 720 permits the passage of driver and holder assemblies 407 and 409 respectively since these assemblies pass about the notched sprocket inverted. The flight chain 411 subsequently returns to the bottom takeup sprocket 453 where this description began.

Inserter Section

Folded partition 250B exits the upper curved track 20 travelling to the left of the main frame 41 and approaches the tamp-down frame 47 from the right side thereof. As is shown more clearly in FIG. 36, the folded partition 250B reaches the tamp-down frame 47 in a skewed position, its output side lagging the input side thereof. A brush 735, also shown in FIGS. 37 and 38, stands with its bristles upward to apply a retarding force to the input side of the folded partition 250B.

Figure 37:
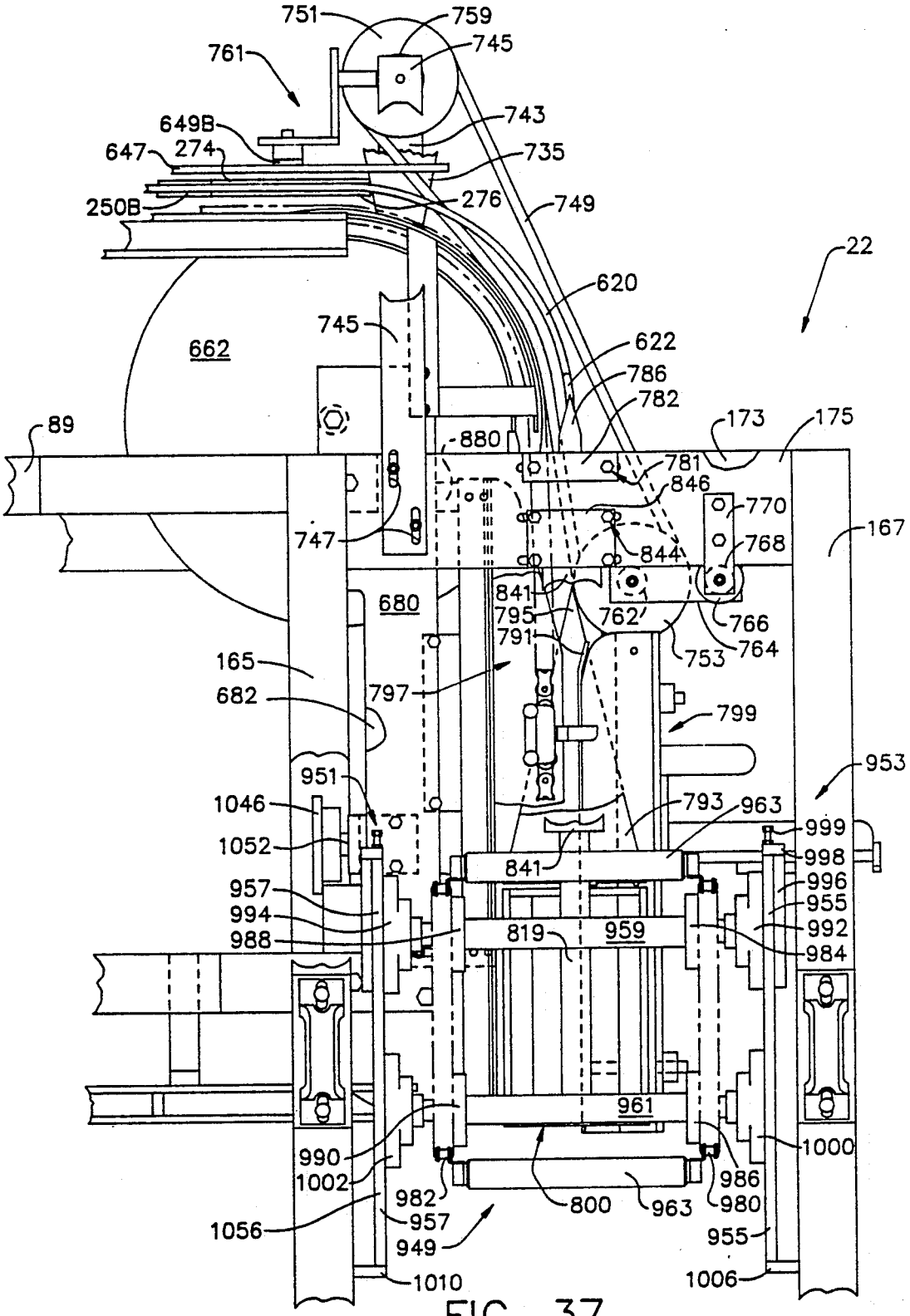
FIG. 37 is a fragmentary end elevational view showing details of the inserter section.

The brush 735 is fixedly attached to the output surface of a vertical flange 737 that is in turn rigidly affixed to the top surface of, and at the output end of, a cantilever bar 739. The cantilever bar 739 is rigidly affixed at its input end to the output face of, and alogn the bottom edge of, a base flange 741 that is in turn fixedly attached to the output face of an input riser bar 743. The input riser bar 743 is adjustably attached to the input surface of the upper lateral plate 173, as is a companion output riser bar 745 that is fixedly attached to the output surface of the upper output lateral plate 175, as is shown in FIG. 37. The input and output riser bars 743 and 745 incorporate staggered vertical slots 747 that facilitate vertical adjustment while preserving their vertical position. Both riser bars are located in parallel spaced relationship across the tamp-down frame 47 near the right input and output posts 161 and 165, respectively.

As the folded partition 250B passes over the brush 735, it rotates into square relationship with the tamp-down frame 44 and proceeds to the left thereof until it comes in working contact with an output overhead belt 749, as is best shown in FIG. 37. Since the belt rotates counterclockwise with respect to the figure, the leading edge of the folded partition 250B of forced downward to negotiate the outside turn over the output idler sprocket 662.

The output overhead belt 749 is mounted about an upper sheave 751 and a lower sheave 753. The upper sheave 751 is rotatably mounted upon the central portion of a first longitudinal bar 755 that is in turn fixedly attached between the upper ends of the input and output riser bars 743 and 745. As before, the upper sheave 751 is held in longitudinal place upon the first longitudinal bar 755 by a pair of shaft collars 759.

The lower sheave 753 of the outpt overhead belt 749 is rotatably mounted upon a short bar 762 that is in turn fixedly attached between radius arms 764. The radius arms 764 are rigidly affixed to the inboard surfaces of a pair of shaft collars 766. The shaft collars 766 are in turn adjustably mounted upon the central portion of a second longitudinal bar 768. The second longitudinal bar 768 is fixedly attached between opposing surfaces of a pair of hangers 770. The hangers 770 are in turn fixedly attached upon the outboard surfces of, and adjacent the left ends of, the upper input and output lateral plates 173 and 175, respectively. By rotation of the pair of shaft collars 766 and the radius arms 764, the lower sheave 753 can be raised and lowered for proper tensioning of the output overhead belt 749.

Proper entrance of the folded partition 250B into the output overhead belt 749 is assured by the output end of the pair of overhead bars 647. The output ends of the overhead bars 647 are adjustably mounted to an output adjustment assembly 761 that is similar to the input adjustment assembly 650, except that is is mounted off the right side of the pair of shaft collars 759 to cooperate with the output spacer block 649B of the plurality of spacer blocks 649 of the pair of overhead bars 647. Thus, the output ends of the overhead bars 647 can be adjusted vertically and in the lateral direction to bring them into proper working alignment with the output idler sprocket 662.

The folded carton 250B comes to a vertical and longitudinal position with respect to the tamp-down frame 47 after having passed about the output idler sprocket 662. The bottom and top halves of the folded carbon 250B are still maintained separately by the outside and inside flap guide rods 620 and 622 that continue arcuately about the working perimeter of the output idler sprocket 662 to be fixedly attached in output and input rod holder assemblies 772 and 774 respectively, as is shown best in FIGS. 36 and 38.

The outside flap guide rod 620 is fixedly attached within the inside diameter of a tube 776 that is rigidly affixed at its upper end to the input extremity of a cantilever member 778. The cantilever member 778 is rigidly affixed at its output extremity to the vertical centerline of a flange plate 780 that is in turn adjustably mounted to the central inboard surface of the upper output lateral plate 175. A pair of bolts 781 pass through clear holes in a clamp plate 782, as well as a pair of horizontal slots in the upper output lateral plate 175, to threadably mount into each end of the flange plate 780. Thus, the output end of the outside flap guide rod 620 can be adjusted to the right or left with respect to the tamp-down frame 47.

The input rod holder assembly 774 is of mirror image construction to that of the output rod holder assembly 772, except that a cantilever member 784 thereof is shorter than the cantilever member 778. The input rod holder assembly 774 is also mounted in mirror image to the output rod holder assembly 772 upon the inboard surface of the upper input lateral plate 173.

The output rod holder assembly 772 also incorporates an output side flap splitter 786 that is rigidly affixed to the inboard side of the tube 776. The upstanding splitter is shown in FIG. 37 to be a symmetrical wedge with its vertex at the top extremity thereof. The wedge comes to full width above the top extremity of the tube 776 to assure that the leading edges of the top and bottom halves 276 and 274 respectively of the folded partition 250B part laterally to pass about each side of the tube 776.

The input rod holder assembly 774 incorporates an input side flap splitter 788 that is identical to the output side flap splitter 786. The input side flap splitter 788 is rigidly affixed in parallel opposition to the output side flap splitter 786 upon the output end of the input rod holder assembly 774.

Figure 38:
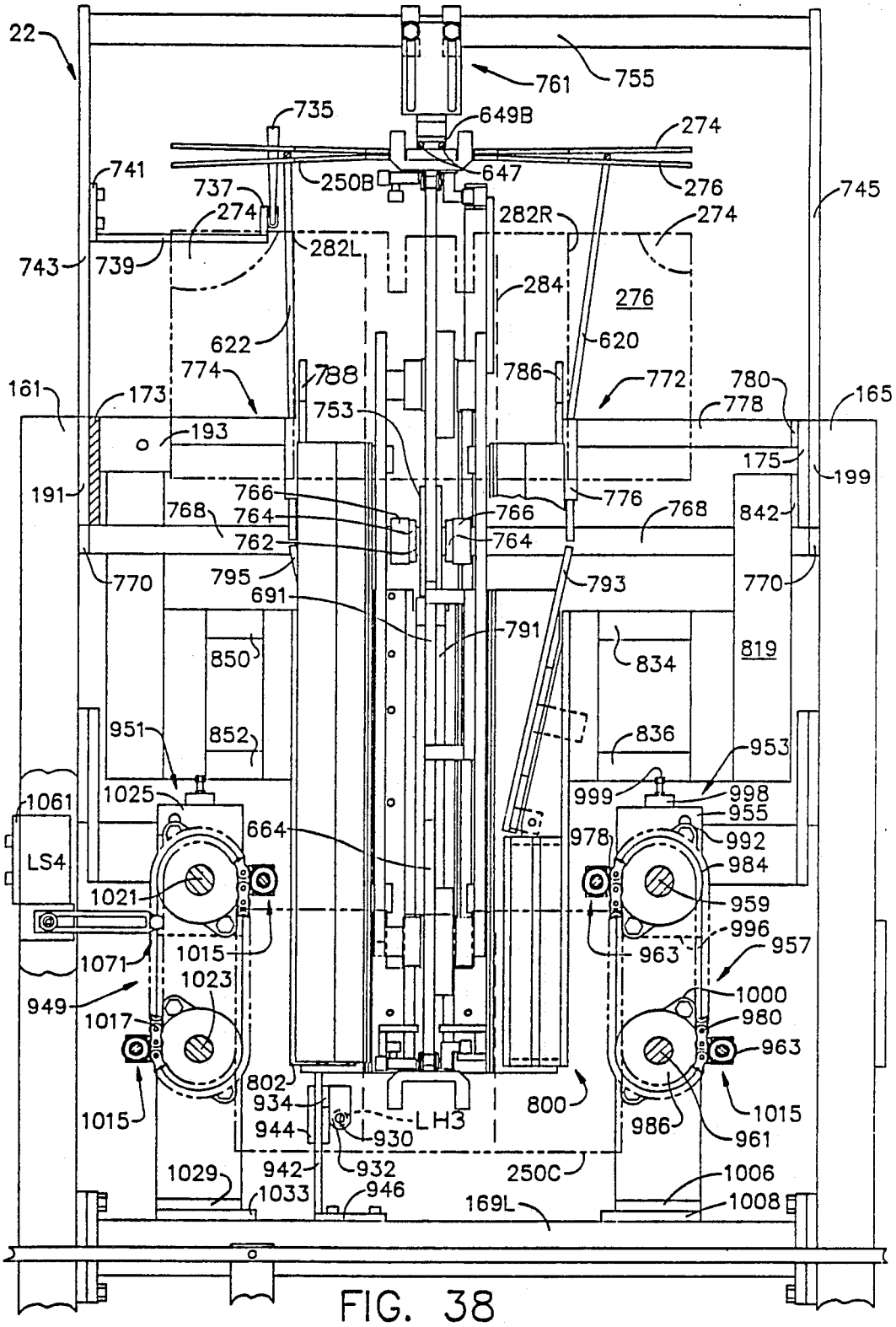
FIG. 38 is another fragmentary elevational view of the inserter section, the folded partition being shown in double-dot-dash lines.
Figure 39:
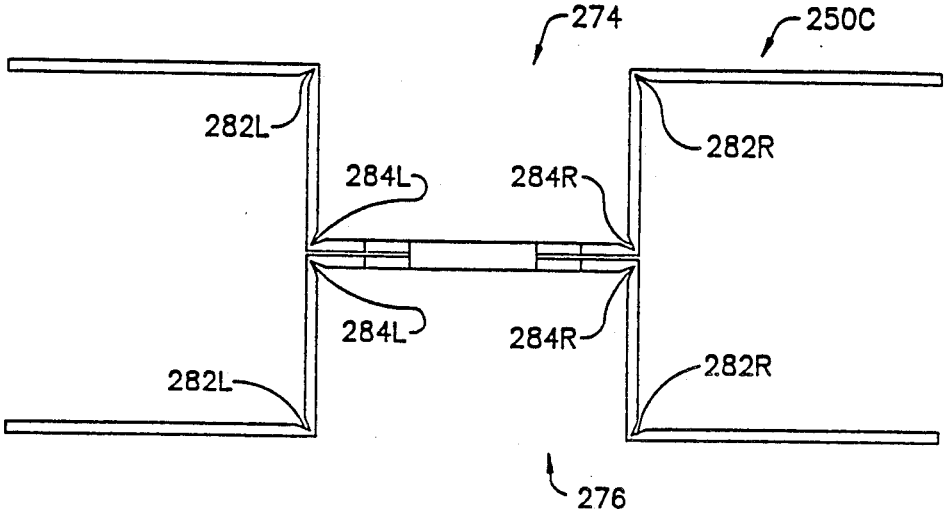
FIG. 39 is a plan view showing a partition in erected position.
Figure 39A:
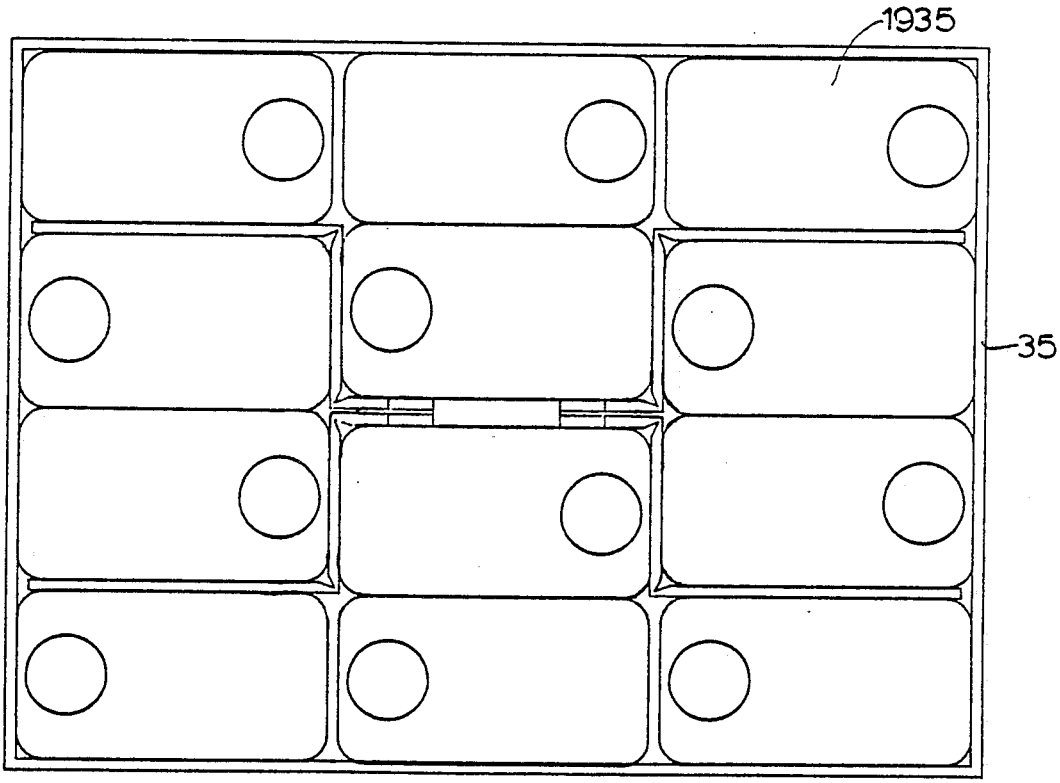
FIG. 39A is a plan view of a carton and a plurality of oil containers separated by the erected partition.

As the folded partition 250B continues downward past the output and input side flap splitters 786 and 788 respectively, the central portion of the top and bottom halves 276 and 274 respectively are held in juxtaposition with each other between a driver and a holder assembly 407 and 409 respectively and a center plate 791. As is shown best in FIGS. 36 and 37, the top of the center plate 791 resides just below the right side of the lower sheave 753 of the output overhead belt 749, and extends downwardly therefrom. As the folded partition 250B continues, the leading edges thereof are further opended by wedge plates 793 and 795. Referring to FIG. 38, the upper end or vertex of the wedge plate 793 is located just beneath the output side flap splitter 786 in order to receive the top and bottom halves 276 and 274 respectively, of the folded partition 250B near the right hand score line 282R, as is shown in FIGS. 12 and 39. The lower end or base of the wedge plate 793 lies closer to the transverse centerline of the tamp-down frame 47, thus positioning the wedge plate 793 in an angled transverse plane. As the foldeld partition 250B continues downwardly, the leading edges thereof move downwardly upon the sides of the wedge plate 793, which requires the opening forces produced therebetween to translate from the right hand score line 282R toward the adjacent perforation lines 284R, breaking the right hand perforated line 284R outwardly. The opposite side of the folded partition 250B is opended in the same manner by wedge plate 795. Simultaneously with the outward breaking of perforated lines 284R, the outer panels of the top and bottom halves 276 and 274 respectively are required to remain in longitudinal alignment with the tamp-down frame 47 by an inside guide assembly 797 (FIG. 37) and an outside guide assembly 799. This requires the right and left hand score lines 282R and 282L respectively of the folded partition 250B to break inwardly, thus forming folded partition 250B into an opened partition 250C, as is shown in plan view in FIGS. 39, 39A, and 39B.

The opened partition 250C continues to move downwardly from the wedge plates 793 and 795 into core frames 800 and 802, where it is maintained in its opened position. At this point, the lower edge of the opened partition 250C makes a switch LH3 that stops the flight chain 411, which remains at rest until an oil case 35 comes into place beneath the inserter section 22.

The core frame 800 is most clearly shown in FIGS. 40, 41 and 42. It incorporates a top plate 807, a bottom plate 809, right and left input angle irons 811 and 813 respectively, right and left output angle iron 815 and 817 respectively, and a hanger bar 819. The top plate 807 and the bottom plate 809 are rigidly affixed in parallel spaced relationship by the right and left input angle irons 811 and 813 respectively, and the right and left output angle irons 815 and 817 respectively, each located at the appropriate corner thereof. The core frame 800 is provided with a right input slide bar 821 that is fixedly attached to the input face of the right input angle iron 811 and is tall enough to overlie the input edges of the top and bottom plates 807 and 809, respectively. In the same manner, a left input slide bar 823 is fixedly attached to the input surface of the left input angle iron 813, a right side slide bar 825 is fixedly attached to the right hand surface of the right input angle iron 811, a left slide bar 827 is fixedly attached to the left hand surface of the left input angle iron 813, a right output slide bar 829 is fixedly attached to the left hand surface of the right output angle bar 815, and a left output slide bar 831 is fixedly attached to the left hand surface of the left output angle iron 817. It should be noted at this junction that the wedge plates 793 and 795, as well as the right and left, input, side, and output slide bars 821, 823, 825, 827, 829, and 831 respectively, are constructed of anti-friction material, such as a preferably plastic.

The core frame 800 is rigidly affixed tothe input surface of, and at the lower end of, the hanger bar 819 that rises upwardly to be rigidly affixed to the input edge of an input frame member 832. The input frame member 832 is rigidly affixed at its upper output edge to the input extremity of a top parallel bar 834, and at its lower output edge of the input extremity of a bottom parallel bar 836. The top and bottom parallel bars 834 and 836 respectively are rigidly affixed at their output extremities to the input edge of an attachment member 838 that is in turn fixedly attached to the left hand surface of a plate mount 840. The plate mount 840 is rigidly affixed along its output edge to the lower input surface of a hanger tube 841 that in turn rigidly incorporates a transverse mounting plate 842 across its upper output surface. The union between the core frame 800 and the hanger bar 819 is stiffened by the rigid attachment of an elongated gusset 843 that is placed in longitudinal plane with the input frame member 832.

The core frame 800 and its support structure is mounted within the confines of the inserter section 22 by a set of four bolts 844 (FIGS. 37 and 51) that pass through clear holes in a clamp plate 846 and through a set of four lateral slots in the upper output lateral plate 175 to fixedly mount into a set of four threaded holes 848 (FIG. 42) located at the corners of the transverse mounting plate 842. The core frame 802 is a mirror image of the core frame 800, save for the fact that top and bottom parallel bars 850 and 852 respectively thereof (FIG. 38) are shorter than the top and bottom parallel bars 834 and 836 of the core frame 800. The core frame 802 is mounted in the same manner as, but in mirror image position to the core frame 800 upon the output face of the upper input lateral plate 173, as is shown also in FIG. 51.

The wedge plate 793 and its mounting structure is shown in FIGS. 43 and 44. The wedge plate 793 is fixedly attached at its lower center to the input surface of a slant brace 855. The slant brace 855 rigidly incorporates upon its left hand edge, upper and lower standoff brackets 857 and 859, respectively. The lower standoff bracket 859 incorporates a slot 861 that cooperates with a threaded hole 863 that is located through the lower portion of the elongated gusset 843 of the core frame 800 (FIG. 40). A bolt (not shown) passes through the slot 861 to threadably mount into the threaded hole 863 resulting in adjustably clamping the lower standoff bracket 859 to the left side of the elongated gusset 843 (FIG. 38). This provides a degree of longitudinal adjustment for the lower edge of the wedge plate 793, so that the opened partition 250C passes the upper input edge of core frame 800 with certainty. The upper standoff bracket 857 incorporates an elongated slot 865 that cooperates with a threaded hole 867 (FIG. 40) through the upper end of the elongated gusset 843 (FIG. 38) to provide a degree of anglular adjustment to the wedge plate 793. As with the lower standoff bracket 859, the upper standoff bracket 857 is clampedly attached to the left side of the elongated gusset 843.

Figure 36:
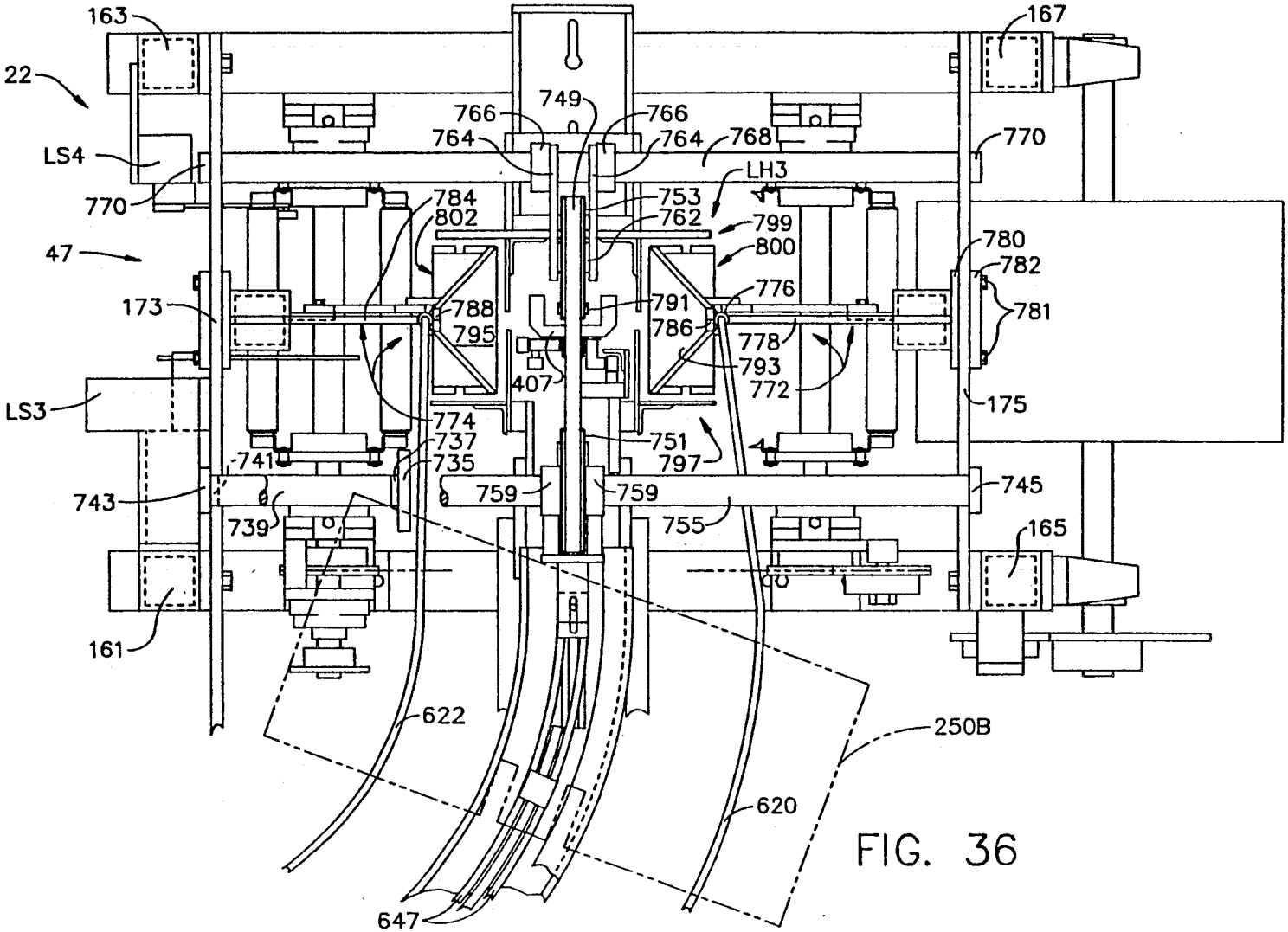
FIG. 36 is a plan view showing details of an inserter section of the machine, a folded partition being shown in double-dot-dash lines.

The inside guide assembly 797 is shown in plan view assembly in FIG. 36, and in structural detail in FIGS. 45, 46 and 47. This inside guide assembly 797 is comprised of an output side guide assembly 868 and an input side guide assembly 870. The output side guide assembly 868 is further comprised of a center retainer plate 872, an outer flap guide plate 874, a connector angle 876, a pair of spacer blocks 878, and a pair of standoff bars 880. The center retainer plate 872 is fixedly attached to the standoff bars 880 by two flathead screws 882 that pass through clear countersunk holes therein, through clear holes in the left hand portion of the pair of spacer blocks 878, to fixedly attach in threaded holes in the left ends of the standoff bars 880. Two machine screws 884 pass through clear holes in the laterally disposed flange of the connector angle 876, through clear holes in the right edge of the center retainer plate 872, through clear holes in the right portion of the pair of spacer blocks 878, to fixedly attach into threaded holes in the left portion of the pair of standoff bars 880. Three flathead screws 886 (FIG. 45 only) pass through clear countersunk holes along the input edge of the outer flap guide plate 874 to fixedly attach in threaded holes in the longitudinally disposed flange of the connector angle 876. Note that the two flathead screws 882 and the two machine screws 884 cooperate with each other to provide a rigid attachment of the pair of standoff bars 880 to the rest of the output side guide assembly 868.

The input side guide assembly 870 is a mirror image of the output side guide assembly 868 with respect to a transverse plane through the inserter section 22. As is shown in FIG. 32, the inside guide assembly 797 is adjustably clamped to the output plate 680 and its companion output plate 682. A pair of bolts 888 passes through clear horizontal slots 890 in the output plate 680 and companion output plate 682 to threadably attach into the right end portion fo the pair of standoff bars 880. Thus, the inside guide assembly can be adjusted laterally.

Figure 48:
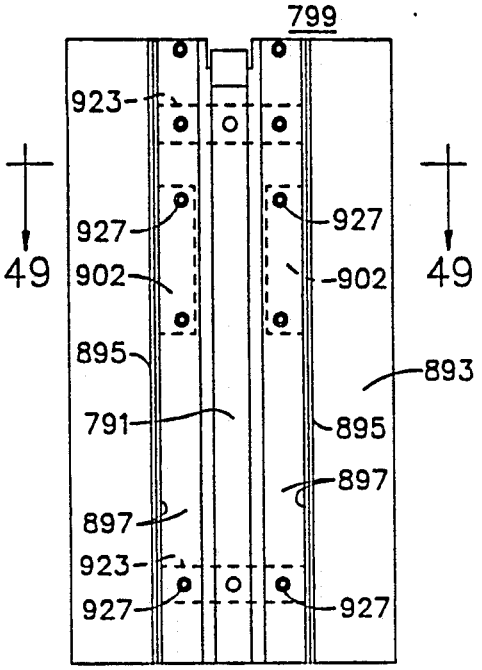
FIG. 48 is a view in side elevation showing a mount assembly of the machine.
Figure 50:
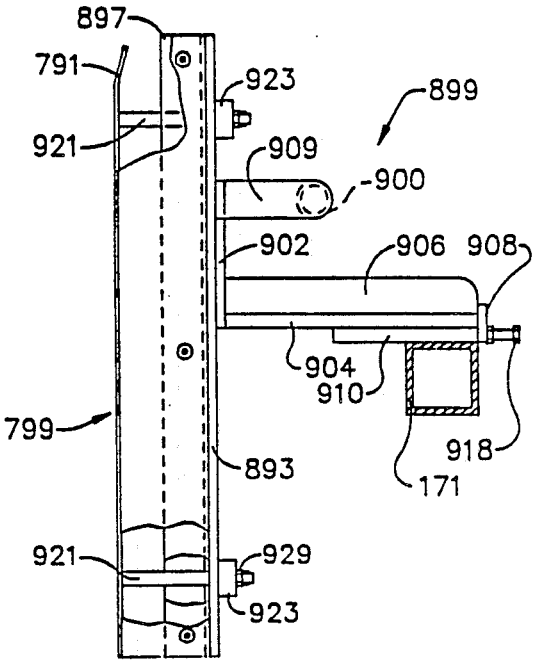
FIG. 50 is a view in end elevation of the mount assembly shown in FIGS. 48 and 49.
Figure 49:
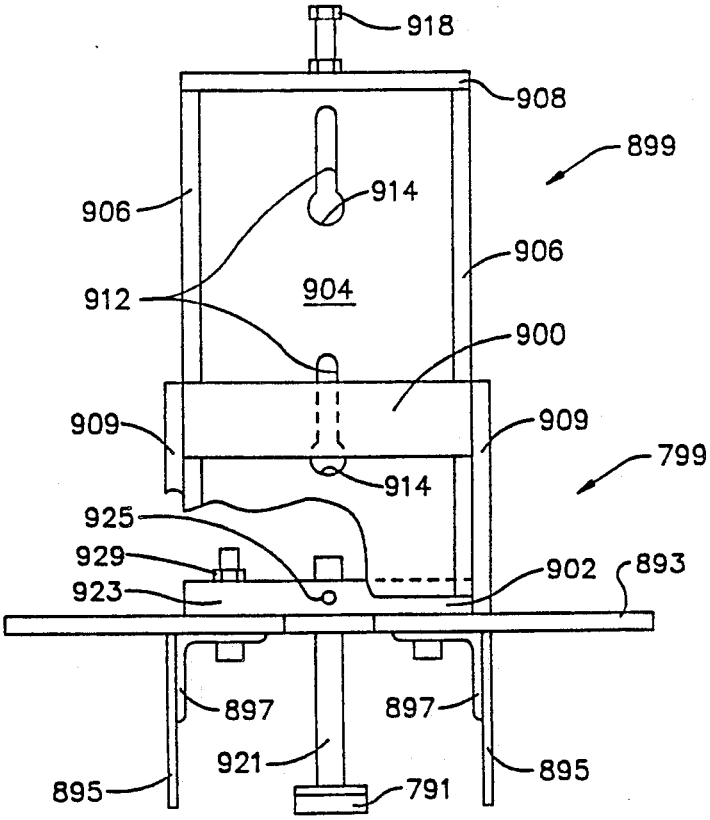
FIG. 49 is a view looking in the direction of the arrows 49—49 in FIG. 48.

The outside guide assembly 799 is shown in FIGS. 48, 49 and 50. It incorporates a translucent outer flap guide plate 893, a pair of center retainer plates 895, a pair of mounting angles 897, a mount assembly 899, and a handle 900. The center retainer plates 895 are fixedly attached along their left sides to the outboard surfaces of the laterally disposed flanges of the pair of mounting angles 897. The longitudinally disposed flanges of the pair of mounting angles 897 are fixedly attached in parallel spaced relationship, upon the right face of the translucent outer flap guide plate 893. The individual members of the pair of center retainer plates 895 are so spaced as to coopereate in opposition with the extended edges of the center retainer plates 872 of the inside guide assembly 797 (FIG. 36).

The mount assembly 899 is comprised of a base plate 904, a pair of mount bars 902, side stiffners 906, and a jack plate 908. The individual members of the pair of mount bars 902 are rigidly affixed in parallel spaced and upstanding disposition to the right edge of the base plate 904. The jack plate 908 is rigidly affixed across the left extremity of the base plate 904. The side stiffners 906 are rigidly affixed along the top input and output edges of the base plate 904, rigidly affixed to the left face of the pair of mount bars 902, and also rigidly affixed to the right upstanding face of the jack plate 908. The handle 900 is a tubular member that is rigidly affixed between a pair of cantilever bars 909. The cantilever bars 909 in turn are rigidly affixed at their right ends to the upper input and output edges of the pair of mount bars 902. Four bolts pass through clear holes in the central portion of the translucent outer flap guide plate 893 to threadably mount into the pair of amount bars 902 of the mount assembly 899.

The mount assembly 899 is adjustably attached to a base 910 (FIGS. 6C and 50) that is rigidly affixed upon the top and center of the upper left longitudinal bar 171 to support the outside guide assembly 799 in cantilever extension within the confines of the inserter frame 47. Referring again to FIG. 49, the base plate 904 incorporates two slots 912 along the lateral centerline thereof, the right hand end thereof terminating in enlarged holes 914. The enlarged holes 914 permit the passage of the heads of a pair of bolts 916 that are mounted uprightly along the transverse centerline of the base 910 (FIG. 6B). The bolts 916 enter the two slots 912 to provide lateral adjustment and quick removal of the outside guide assembly 799. The lateral adjustment of the outside guide assembly 799 is facilitated by a jack screw 918 that passes through a threaded hole in the jack plate 908 to bear against the left edge of the base 910.

The center plate 791 is fixedly attached to the right extremity of a pair of transverse bars 921 that pass to the left through clear holes in the translucent outer flap guide plate 893, as well as through clear holes in the centers of attachment bars 923 (FIG. 49). The transverse bars 921 are fixedly attached within the clear holes of the attachment bars 923 by set screws 925. The attachment bars 923 are fixedly attached to the left hand surface of the translucent outer flap guide plate 893 by a set of four bolts 927 (FIG. 48) that pass through clear holes in the longitudinally disposed flanges of the pair of mounting angles 897, through clear holes in the translucent outer flap guide plate 893, through clear holes in the attachment bars 923, to cooperate with nuts 929. Note that the upper end of the center plate 791 is bent away from the center of the inserter section 22 to facilitate the entry of folded partition 250B.

Figure 51:
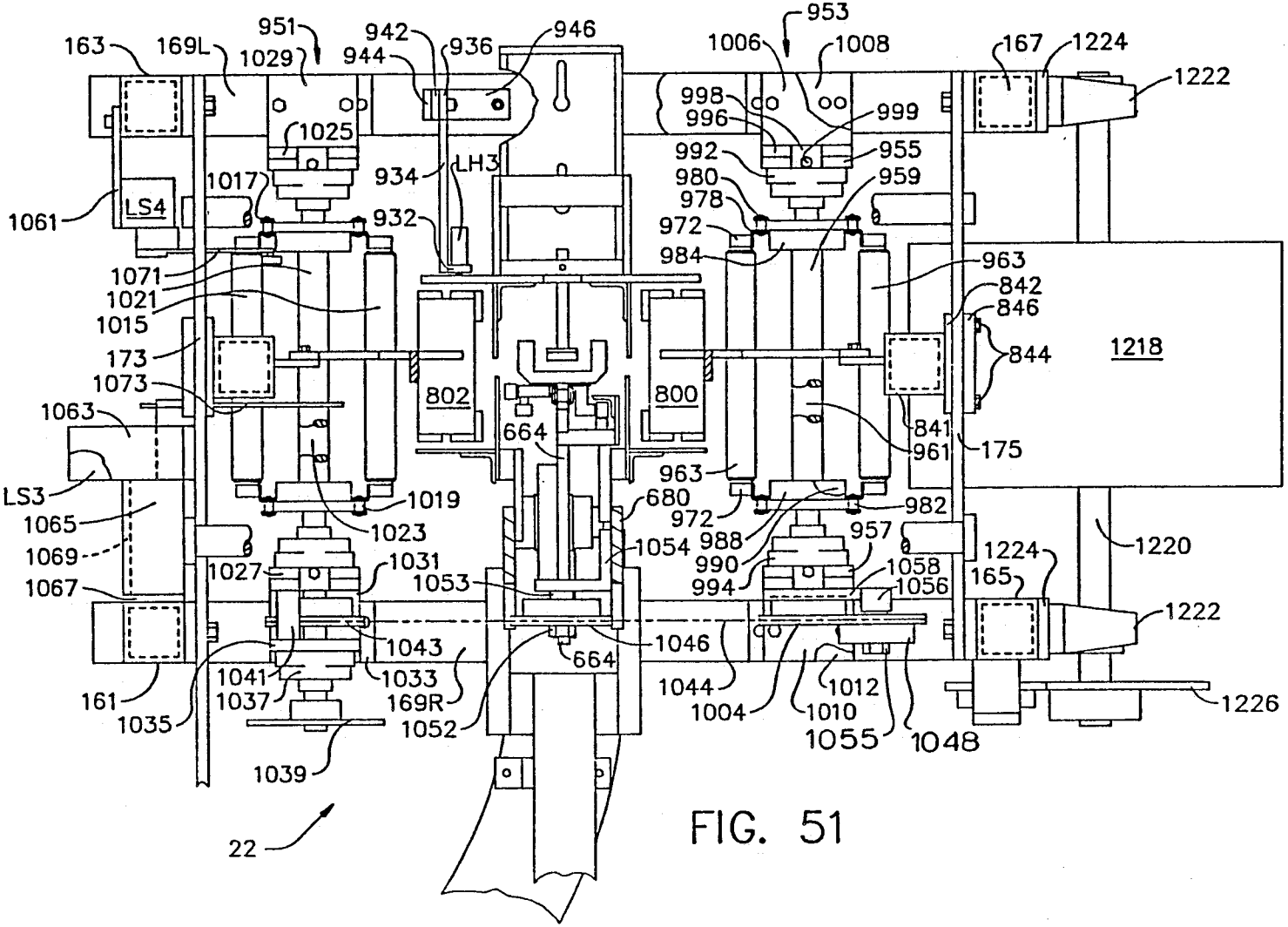
FIG. 51 is a fragmentary plan view of the inserter structure of the machine.
Figure 52:
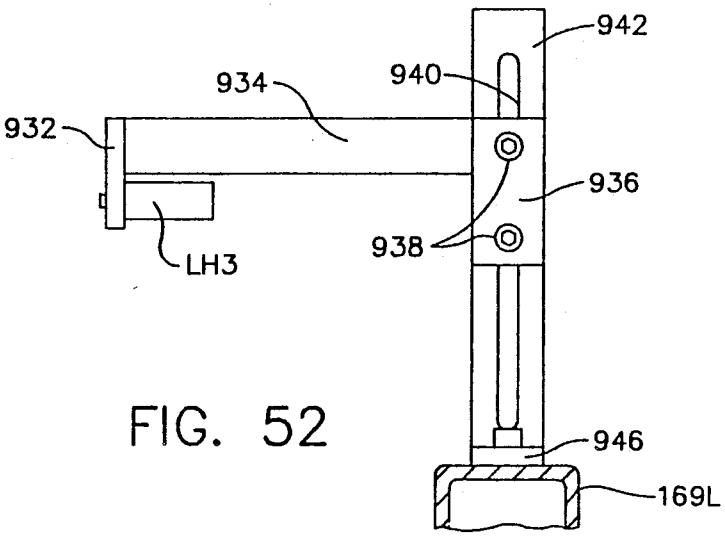
FIG. 52 is a fragmentary view in upright section of a support for a light active switch.

The mountig structure for LH3 is shown in FIGS. 38, 51 and 52. The operative end of LH3 is fixedly clamped through a clear hole 930 throughg the lower end of a swtich holder bracket 932. The upper input edge of the switch holder bracket 932 is rigidly affixed to the output surface of, and at the unsupported end of, a cantilever arm 934 that is in turn rigidly affixed at its left extremity to the upper left edge of a clamp foot 936. Bolts 938 pass through clear holes in the clamp foot 936, through an elongated slot 940 in a riser bar 942, and threadably mount into clamp plate 944 to adjustably fasten clamp foot 936 and LH3 to the riser bar 942. The bottom extremity of the riser bar 942 is rigidly affixed to the upper surface of, and along the input end of, a mount foot 946 that is in turn fixedly attached to the top surface of the left longitudinal bar 169L. A partition at the position 250C (FIG. 38) influences LH3 to indicate the partition 250C is in position to be inserted between oil cans 1935 in the carton 35.

Inserter

The inserter section 22 is provided with an inserter 949 as is shown in FIGS. 37, 38, 51, 53 and 54. The inserter assembly 949 incorporates an input flight assembly 951 and an output flight assembly 953. Referring more specifically to FIGS. 37, 38, and 51, the output flight assembly 953 further incorporates a left stanchion 955, a right stanchion 957, an idler shaft 959, a reverse shaft 961, and two flight assemblies 963.

Figure 53:
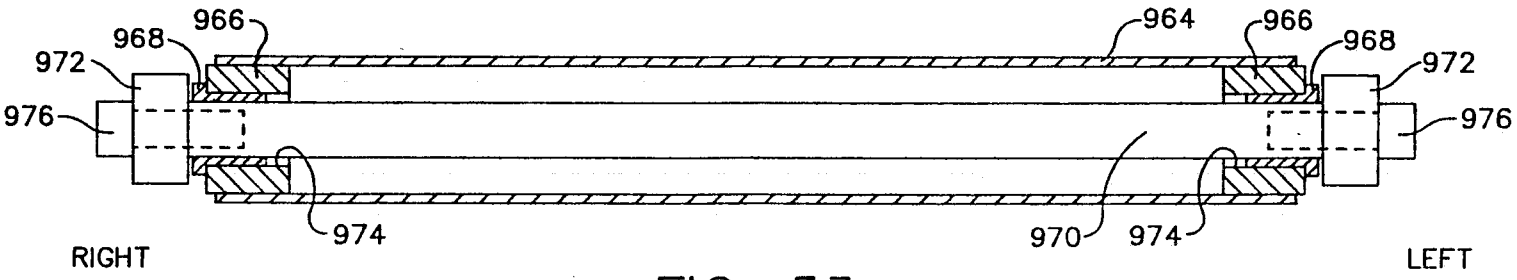
FIG. 53 is a sectional view of tube structure of the machine.

As is shown more specifically in FIG. 53, each flight assembly 963 is comprised of a tube 964, end plugs 966, flange bushings 968, a rod 970, and attachment blocks 972. The end plugs 966 are rigidly affixed into the ends of the tube 964 and are provided with central bores 974 into which the flange bushings 968 are frictionally inserted. The tube 964, end plugs 966, and flange bushings 968 are rotatably mounted upon the rod 970. The rod 970 is fixedly attached between attachment blocks 972 by bolts 976 that pass through clear holes in the center of the attachment blocks 972 to threadably mount into the ends of the transversely disposed rod 970. The left hand member of the attachment blocks 972 is fixedly attached to an attachment link 978 of a left output inserter chain 980 (FIGS. 38 and 51). The right hand member of the attachment block 972 is similarly attached to a right output inserter chain 982.

The left output inserter chain 980 circumscribes a left idler sprocket 984 and a left driver sprocket 986. Similarly, the right output inserter chain 982 circumscribes a right idler sprocket 988 and a right driver sprocket 990. The left and right idler sprockets 984 and 988 respectively are fixedly and spacely attached upon the idler shaft 959, and the left and right driver sprockets 986 and 990 respectively are fixedly attached in vertical alignment with respect to the left and right idler sprockets 984 and 988 upon the reverse shaft 961. The left and right idler sprockets 984 and 988 respectively, and the left and right driver sprockets 986 and 990 respectively, are synchronously attached upon their respective shafts so the two flight assemblies 963 are laterally disposed across the inserter section 22.

The idler shaft 959 is rotatably mounted in idler bearings 992 and 994 that are in turn adjustably clamped to the upper inboard surfaces of the left stanchion 955 and the right stanchion 957. Bolts pass through clear holes in the housing of the idler bearing 992, through corresponding vertical slots in the upper portion of the left stanchion 955, to threadably mount into a left jack plate 996. A nut block 998 is rigidly affixed to the central top edge of the left jack plate 996, and extends to the right therefrom to overhang the top edge of the left stanchion 955. An adjustment screw 999 passes through a threaded hole in the unsupported end of the nut block 998 to bear against the upper edge of the left stanchion 955, thus being able to raise the left end of the idler shaft 959 and bring tension into the left output inserter chain 980. The idler bearing 994 on the right side of the machine is adjustably mounted in mirror image to the idler bearing 992 to bring tension into the right output inserter chain 982.

The left end of the reverse shaft 961 is rotatably mounted in a lower left bearing 1000 that is in turn fixedly attached to the inboard surface of the left stanchion 955 just below its center portion. The right end of the reverse shaft 961 is rotatably mounted in a lower right bearing 1002 that is in turn fixedly attached to the inboard surface of the right stanchion 957 in lateral opposition to the lower left bearing 1000. The right end of the reverse shaft 961 extends through the lower right bearing 1002 and through a clear hole in the right stanchion 957 to fixedly accommodate a reverse drive sprocket 1004.

The left stanchion 955 is rigidly affixed at its bottom edge to the top surface of, and along the inboard edge of, a left output mounting foot 1006 that is in turn fixedly attached at its outboard end to a left output nut pad 1008 (FIG. 6B). The left output nut pad 1008 is fixedly attached to the top surface of the left longtudinal bar 169L of the inserter frame 47. The bottom extremity of the right stanchion 957 is rigidly affixed at its lower extremity to the top surface of, and along the inboard edge of, a right output mounting foot 1010 that is in turn fixedly attached at its right end to a right output nut pad 1012. The right output nut pad 1012 is rigidly affixed to the top surface of the right longitudinal bar 169R in lateral alignment with the left output nut pad 1008. The left and right output nut pads 1008 and 1012 respectively each incorporated two pairs of tapped holes.

The input flight assembly 951 incorporates two flight assemblies 1015, a left input flight chain 1017, a right input flight chain 1019, an input idler shaft 1021, an inserter drive shaft 1023, a left input stanchion 1025, a right input stanchion 1027, a left input mounting foot 1029, and a right input mounting foot 1031. The input flight assembly 951 is assembled in the same manner as the output flight assembly 953. It is also mounted in the same manner upon input nut pads 1033, as is the output flight assembly 953, upon the left and right output nut pads 1008 and 1012. The input nut pads 1033 are rigidly afixed in transverse alignment upon the top of the right and left longitudinal bar 169R and 169L respectively of the inserter frame 47. Again, the nut pads 1033 incorporate two pairs of tapped holes each, and in cooperation with the left and right output nut pads 1008 and 1012, permit the input and output flight assemblies 951 and 953 respectively of the inserter 949 to be set in either one of two places to accommodate two different sizes of partitions.

The inserter drive shaft 1023 (FIG. 51) of the input flight assembly 951 extends to the right through a clear hole in the right input stanchion 1027, through a clear hole in a standoff plate 1035, through an outboard bearing 1037, to provide mounting for an inserter drive sprocket 1039. The drive sprocket 1039 is fixedly attached upon the right end of the inserter drive shaft 1023 that is in turn rotatably mounted through the outboard bearing 1037. The outboard bearing 1037 is fixedly attached to the right face of the standoff plate 1035 that is in turn fixedly attached in spaced parallel relationship to the right side of the right input stanchion 1027 by two spacers 1041. The top fastener and spacer of the two spacers 1041 is located in the upper input corner of the standoff plate 1035, while the bottom fastener and spacer of the two spacers 1041 is located at the bottom center of the standoff plate 1035. An output sprocket 1043 is fixedly attached to the inserter drive shaft 1023 between the standoff plate 1035 and the right input stanchion 1027 to lie in the same longitudinal plane as the reverse drive sprocket 1004 of the reverse shaft 961 of the output flight assembly 953.

An inserter drive chain 1044 circumstances the output sprocket 1043, and upper idler sprocket 1046, and an upper tension sprocket 1048, passes counterclockwise about the reverse drive sprocket 1004, then continues clockwise about a lower tension sprocket 1050 to complete its circuit at the output sprocket 1043. The upper idler sprocket 1046 is bored out to compressively accept a double row ball bearing. A bolt 1052 passes through the inner race of the ball bearing of the upper idler sprocket 1046, through a spacer 1053, then threadably and fixedly mounts into a longitudinally disposed flange of an angle mount 1054 (FIG. 51). The laterally disposed flange of the angle mount 1054 is fixedly attached to the input surface of the output plate 680 that is associated with the output and return idler sprockets 662 and 664 respectively (FIGS. 32 and 37).

The upper tension sprocket 1048 is also bored out to accept a double row ball bearing whose inner race is likewise clampedly mounted upon a bolt 1055 that is in turn rigidly affixed into the right hand surface of, and at the upper end of, a vertical bar 1056. The lower tension sprocket 1050 is rotatably mounted upon the right hand surface of, and at the lower end of, the vertical bar 1056 in the same mannere as the upper tension sprocket 1048. The vertical bar 1056 is rigidly affixed upon the output extremities of a pair of slotted bars 1058, the members thereof being vertically spaced to reside at the upper and lower ends of vertical bar 1056. The left sides of all three pieces reside in the same longitudinal and vertical plane. Bolts pass through the slots of the pair of slotted bars 1058 to threadably mount into the right side of the right stanchion 957 such that the reverse drive sprocket 1004 lies halfway therebetween. The pair of slotted bars 1058 permit the upper and lower tension sprockets 1048 and 1050 to move in the output direction bringing tension into the inserter drive chain 1044.

The inserter drive sprocket 1039 can be driven by an appropriate drive chain, not shown, thus driving the left and right input flight chains 1017 and 1019 (FIG. 51) in a clockwise direction, as seen from the bottom of FIG. 51, causing the two flight assemblies 1015 to move downwardly on the inboard side of the input flight assembly 951. The inserter drive chain 1044 is simultaneously driven in a clockwise direction as seen from the bottom of FIG. 51, and, due to the reverse wrap about the reverse drive sprocket 1004, turns the left and right output inserter chains 980 and 982 respectively counterclockwise as viewed from the bottom of FIG. 51, causing the two flight assemblies 963 to move downwardly on the inboard side of the output flight assembly 953. The two sets of flight assemblies 963 and 1015 (FIG. 38) are synchronized to operate in horizontal alignment with each other to bear simultaneously upon both the input and output sides of the opened partition 250C and motivate it downwardly out of the core frames 800 and 802. The rotatably tubes 964 of the flight assemblies 963 and 1015 bear against the top edges of the opened partition 250C and, upon ejection, roll off the top edges of the opened partition 250C, preventing damage thereto.

As the one flight assembly 1015 of the input flight assembly 951 and the one flight assembly 963 of the output flight assembly 953 motivate the opened partition 250C out of the core assemblies 800 and 802, the companion flight assembly 1015 of the input flight assembly 951 is moving upwardly along the input side thereof to actuate a limit switch LS-4 (FIGS. 38 and 51). The limit swtich LS-4 releases the oil case 35 that is resting on the conveyor 28, as will be described hereinafter. As the companion flight continues upward, it also makes a limit switch LS-3 (FIGS. 38 and 54) as it comes to top center, thus shutting off the inserter 949.

The limit switch LS-4 is fixedly attached to the output side of an adjustment plate 1061 that extends to the left therefrom to be clampedly attached to the input side of the left input post 163 of the inserter frame 47 by two bolts that pass through a vertical slot (not shown) therein to provide a degree of vertical adjustment.

The limit switch LS-3 is fixedly attached to the bottom surface of a switch plate 1063 that is in turn rigidly affixed at its right hand output edge of the left extremity of an extension plate 1065. The right extremity of the extension plate 1065 is rigidly affixed to the left hand surface of, and along the top edge of, a mount plate 1067 that is in turn rigidly affixed to the left hand surface of the right input post 161 of the inserter frame 47. The perpendicular intersection between the extension plate 1065 and the mount plate 1067 is stiffened by rigidly affixing a stiffner plate 1069 therebetween along the input edge thereof.

LS-4 is located at a vertical height within the inserter frame 47 so a roller and arm 1071, in cooperation with the rising flight assembly 1015, actuates LS-4 after the opended partition 250C is placed in the oil case 35. A switch rod 1073, also in cooperation with the rising flight assembly 1015, actuates LS-3 as the flight reaches the top of the input flight assembly 951.

Conveyor

Figure 56:
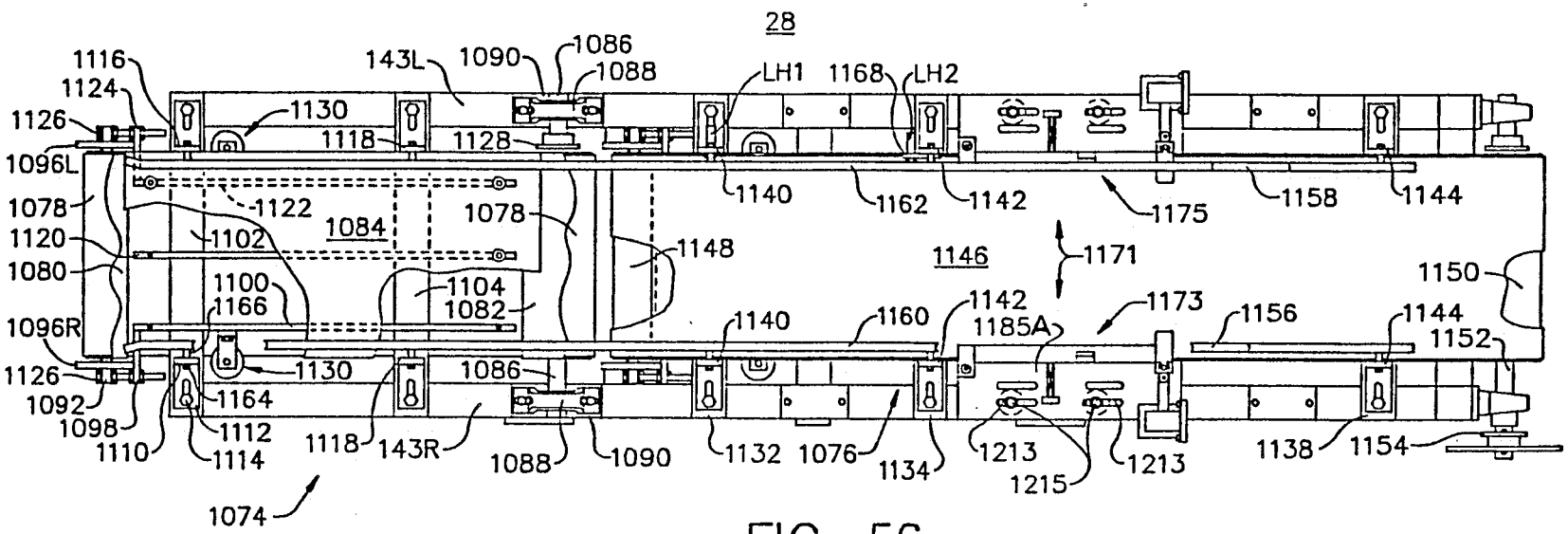
FIG. 56 is a top plan view of the case conveyor.
Figure 55:
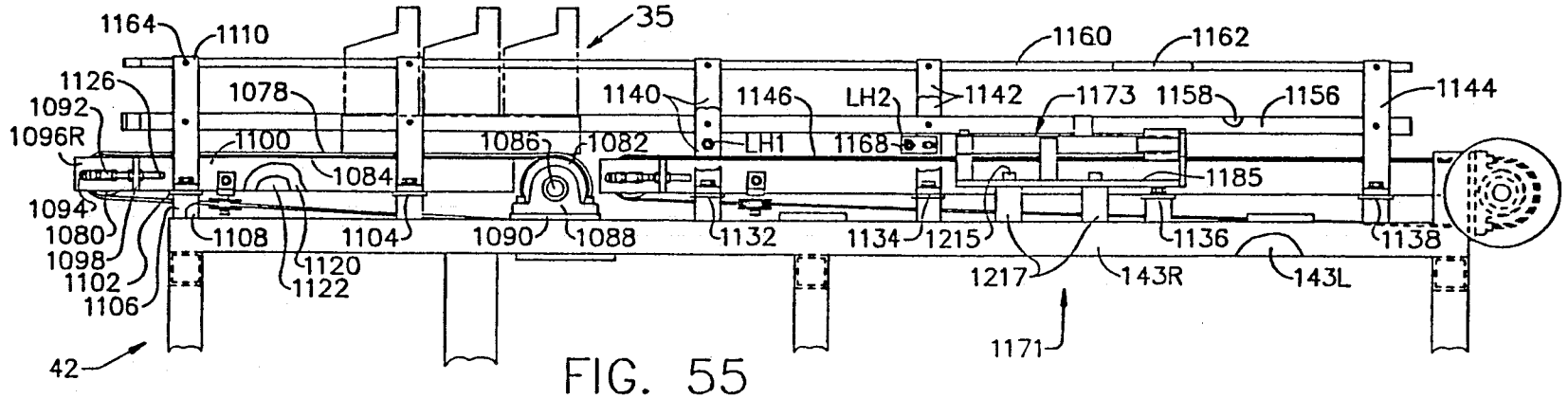
FIG. 55 is a fragmentary view in side elevation of the case conveyor.

The case conveyor 28 is shown in FIGS. 55 and 56, and is comprised of an intermittent conveyor 1074 and a continuous conveyor 1076. The intermittent conveyor incorporates a feed belt 1078, an input roller 1080, an output roller 1082, and a support plate 1084. The feed belt 1078 circumscribes the input and output rollers 1080 and 1082 respectively in a clockwise direction. The output roller 1082 is fixedly attached to an output shaft 1086 that is in turn rotatably mounted in a pair of pillow bearings 1088. The pillow bearings 1088 are fixedly attached to the top surface of nut pads 1090 that are in turn fixedly attached to the top surfaces of the pair of top longitudinal members 143R and 143L about one-third the distance from the input end thereof. The input roller 1080 is rotatably mounted on an input shaft 1092 whose extended ends incorporate flats on opposing sides thereof for non-rotational cooperation with slots 1094 of longitudinal guide plates 1096R and 1096L.

The output edge of the longitudinal guide plate 1096R is rigidly affixed upon the input face of a lateral flange 1098 to form a "T" joint. The leftward extending extremity of the lateral flange 1098 is rigidly affixed to the right side of, and at the input end of, a right longeron 1100 that is in turn fixedly attached across the top surfaces of an input lateral bar 1102 and an output lateral bar 1104, respectively. The input lateral bar 1102 spans the top surfaces of right and left cylindrical risers 1106 and 1108 respectively, that are in turn fixedly attached to the top surfaces of, and at the input ends of, the top longitudinal members 143R and 143L respectively of the conveyor frame 42. An input right side fence post 1110 is rigidly affixed at its lower right hand edge to the left extremity of a slotted foot 1112. The shaft of a bolt and washer 1114 passes downwardly through a clear lateral slot in the slotted foot 1112, through a clear hole in the right end of the input lateral bar 1102, to threadably mount into the top end of the right cylindrical riser 1106. An input left hand fence post 1116 is adjustably clamped upon the top of the input lateral bar 1102 and the left cylindrical riser 1108 in the same manner as the input right side fence post 1110. Thus, the lateral distance between the input right and left side fence posts 1110 and 1116 can be adjustably set without disturbing the position of the input lateral bar 1102. A second pair of fence posts 1118 is adjustably attached upon the outboard ends of the output lateral bar 1104 in the same ay as the input right and left side fence posts 1110 and 1116, respectively.

A center longeron 1120 is fixedly attached coincident with the case conveyor 28 centerline across the top of the input and output lateral bars 1102 and 1104, respectively. A left longeron 1122 is also fixedly attached across the input and output lateral bars 1102 and 1104 respectively, in mirror image location to that of the right longeron 1100. A lateral flange 1124 is rigidly affixed at its right extremity to the left side of, and at the input end of, the left longeron 1122. The lateral flange 1124 extends to the left therefrom to rigidly accommodate the output extremity of the left hand longitudinal guide plagte 1096L in a "T" joint that is a mirror image of the right hand longitudinal guide plate 1096R.

The outboard ends of the input shaft 1092 incorporate longitudinally disposed holes in which bolts 1126 are fixedly attached. The bolts 1126 extend substantially in the output direction to pass through clear holes in the outboard ends of the lateral flanges 1098 and 1124 into which it is adjustably attached. Consequently, the input shaft 1092 can be moved to bring tension into the feed belt 1078.

The center span of the feed belt 1078 is supported by the support plate 1084 that is in turn fixedly attached to the top edges of the right, center, and left longerons 1100, 1120, and 1122, respectively. The feed belt 1078 of the intermittent conveyor 1074 receives power through a drive sprocket 1128 that is fixedly attached upon the left end of the output shaftr 1086 between the output roller 1082 and the left hand member of the pair of pillow bearings 1088.

The feed belt 1078 remains centered during operation by a pair of side roller assemblies 1130. The roller assemblies 1130 are fixedly attached to outboard surfaces of the right and left longerons and 1122 respectively adjacent to the input lateral bar 1102. The feed belt is of a rought surface texture for gripping the oil cases 35 and moving them firmly downstream when the feed belt 1078 is activated.

The continuous conveyor 1076 is of duplicate design to that of the intermittent conveyor 1074, except that it is longer requiring a first, second, third, and fourth lateral bar 1132, 1134, 1136 and 1138 respectively for proper support. A first and a second pair of fence posts 1140 and 1142 are associated with the first and second lateral bars 1132 and 1134, respectively, while a third pair of fence posts 1144 is associated with the fourth lateral bar 1138.

The continuous conveyor 1076 of the case conveyor 28 incorporates a smooth belt 1146 that circulates in the clockwise direction with respect to the figures about its input and output drums 1148 and 1150. The right end of a drive shaft 1152 of the output drum 1150 extends through its bearing block to accommodate a drive sprocket 1154 through which power is transmitted from the main powertrain that is not shown in detail.

The oil cases 35 are maintained in proper lateral place and alignment upon the case conveyor 28 by right and left lower guide bars 1156 and 1158 respectively, and right and left upper guide bars 1160 and 1162, respectively. The right upper guide bar 1160 is fixedly attached upon the inboard side of the input right side fence post 1110 by a bolt 1164 that passes laterally through a clear hole in the upper end of the input right side fence post 1110 and through a tubular spacer 1166 to threadably mount into the right upper guide bar 1160. Each intersection of a guide bar and fence post is fixedly attached together in the same way.

A limit switch LH-1, which is a photoelectric switch, is fixedly mounted through a threaded hole in the left member of the first pair of fence posts 1140 of the continuous conveyor 1076. Another limit switch LH-2, which is also a photoelectric switch, is fixedly mounted through a threaded hole in the input end of a switch bracket 1168 that is in turn adjustably clamped to the inboard side of the left member of the second pair of fence posts 1142.

An oil case 35 containing oil containers 1935 is fed onto the intermittent conveyor 1074 from an input conveyor 38 (FIG. 1) and proceeds downstream past LH-1 and LH-2 until it is stopped upon the top of the continuous conveyor 1076 by a finger assembly 1171. At this point, it also makes a limit switch LS-2 to be described hereinafter.

Figure 59:
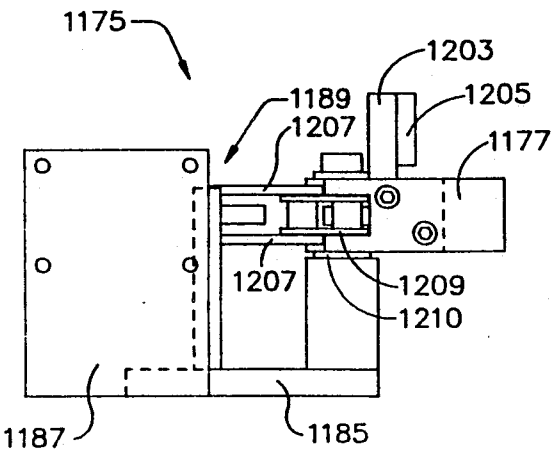
FIG. 59 is a view in end elevation of the stop structure.
Figure 58:
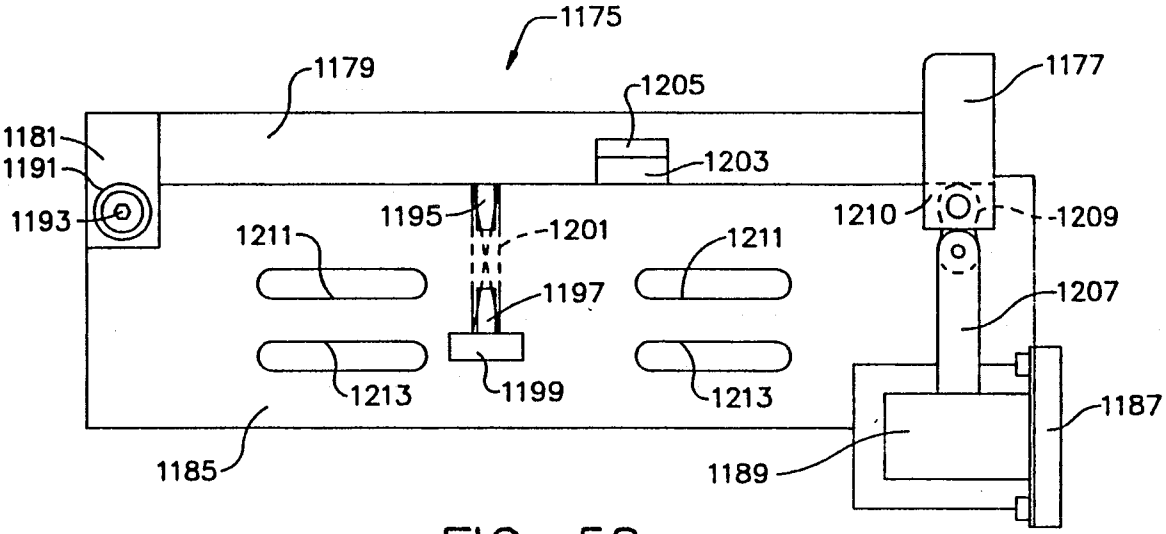
FIG. 58 is a plan view of the stop structure.
Figure 57:
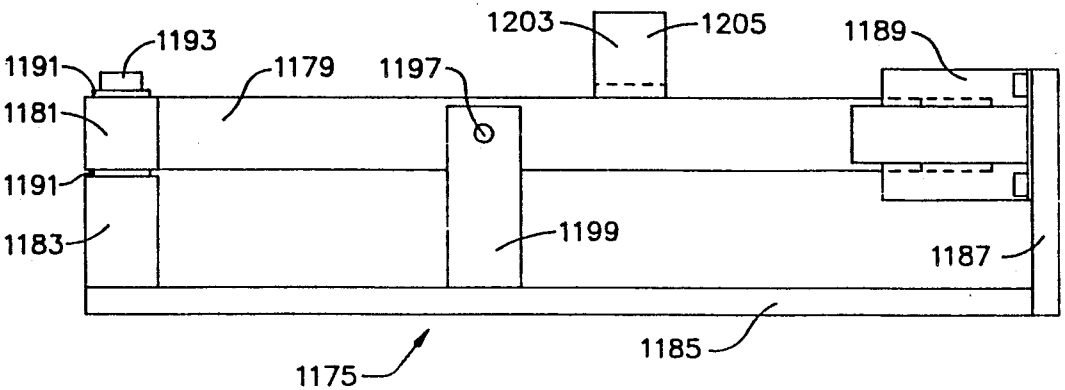
FIG. 57 is a side elevational view on an enlarged scale of a stop structure for the case conveyor.

The finger assembly 1171 is comprised of a right side assembly 1173 and a left side assembly 1175. The right side assembly 1175 is shown in FIGS. 57, 58, and 59 and incorporates a stop block 1177, arm 1179, a pivot block 1181, a pivot riser 1183, a base plate 1185, a solenoid mount 1187, and a solenoid 1189. The stop block 1177 is fixedly attached to the output extremity of the arm 1179 in such position that the left end thereof extends somewhat inboardly and the right end thereof extends somewhat outboardly. The input extremity of the arm 1179 is fixedly attached to the output face of, and at the left end of, the pivot block 1181. The right end of the pivot block 1181 incorporates a vertical hole that receives into each end thereof flange bearings 1191. A shoulder bolt 1193 passes downnwardly through the flange bearings 1191 to threadably mount into the center of the top surface of the pivot riser 1183 that is in turn fixedly attached to the top surface of, and at the left input cornr of, the base plate 1185.

A spring pin 1195 is compressively mounted in a transverse hole in the right hand face of, and at the approximate center of, the arm 1179. A second spring pin 1197 is also compressively mounted in a transverse hole in the upper end of a spring stop 1199 that is in turn fixedly attached to the top central surface of, and favoring the right side of, the base plate 1185. A compression spring 1201 is mouunted upon the spring pin 1195 and the second spring pin 1197 to urge the arm 1179 away from the spring stop 1199.

A stop block 1203 is fixedly attached to the top surface of, and along the right side of, the arm 1179. It is longitudinally located just downstream of the spring pin 1195 and provides mounting for a resilient stop 1205. The resilient stop 1205 is adhesively attached to the upper left side of the stop block 1203 to work against the right side of the right lower guide bar 1156 (FIGS. 55 and 56). The solenoid mount 1187 is rigidly affixed at its lower left input surface to the right side of the output extremity of the base plate 1185. The solenoid 1189 is fixedly attached to the upper input surface of the solenoid mount 1187 with its working tines 1207 extending laterally to the left therefrom to pivotally cooperate with a chain link 1209. The left end of the chain link 1209 pivotally cooperates with stop block tines 1210 that are formed in the right end of the stop block 1177.

A base plate 1185A of the right side assembly 1173 of the finger assembly 1171 incorporates an inboard pair of longitudinal slots 1211 and an outboard pair of longitudinal slots 1213 to accommodate two sizes of oil cases 35. As can be seen in FIG. 56, the right side assembly 1173 is fixedly attached upon the right side of the case conveyor 28 by bolts 1215 that pass downwardly through the inboard pair of longitudinal slots 1213 in the base plate 1185A to threadably mount into the top surface of, and at the center of, a pair of cylindrical standoff mounts 1217. The pair of cylindrical standoff mounts 1217 is fixedly attached to the top surface of the right side member of the pair of longitudinal members 143R of the conveyor frame 41. The pair of cylindrical standoff mounts 1217 is located between the second and third lateral bars 1134 and 1136, respectively. The right side assembly 1173 is adjusted longitudinally so the input side of the stop block 1177 will stop the oil case 35 dead center under the core frames 800 and 802 of the inserter section 22. The left side assembly 1175 of the finger assembly 1171 is of mirror image construction and installation to that of the right side assembly 1173 just described.

As an oil case 35 is retained in place under the inserter section 22 by the finger assembly 1171, it makes a limit switch LS-2 (FIG. 54) that starts the inserter 949. The inserter 949 moves the opened partition 250C downwardly into the oil case 35. As described previously with respect to FIG. 38, the rising flight assembly 1015 makes limit switch LS-4 to open the finger assembly 1171 and release the oil case 35 to move in the output direction upon the smooth belt 1146 of the continuous conveyor 1076. On the way down the continuous conveyor 1076, the oil case 35 passes under the tamp-down drum 1218 that completes the insertion of the opened partition 250C into the oil case 35.

Figure 54:
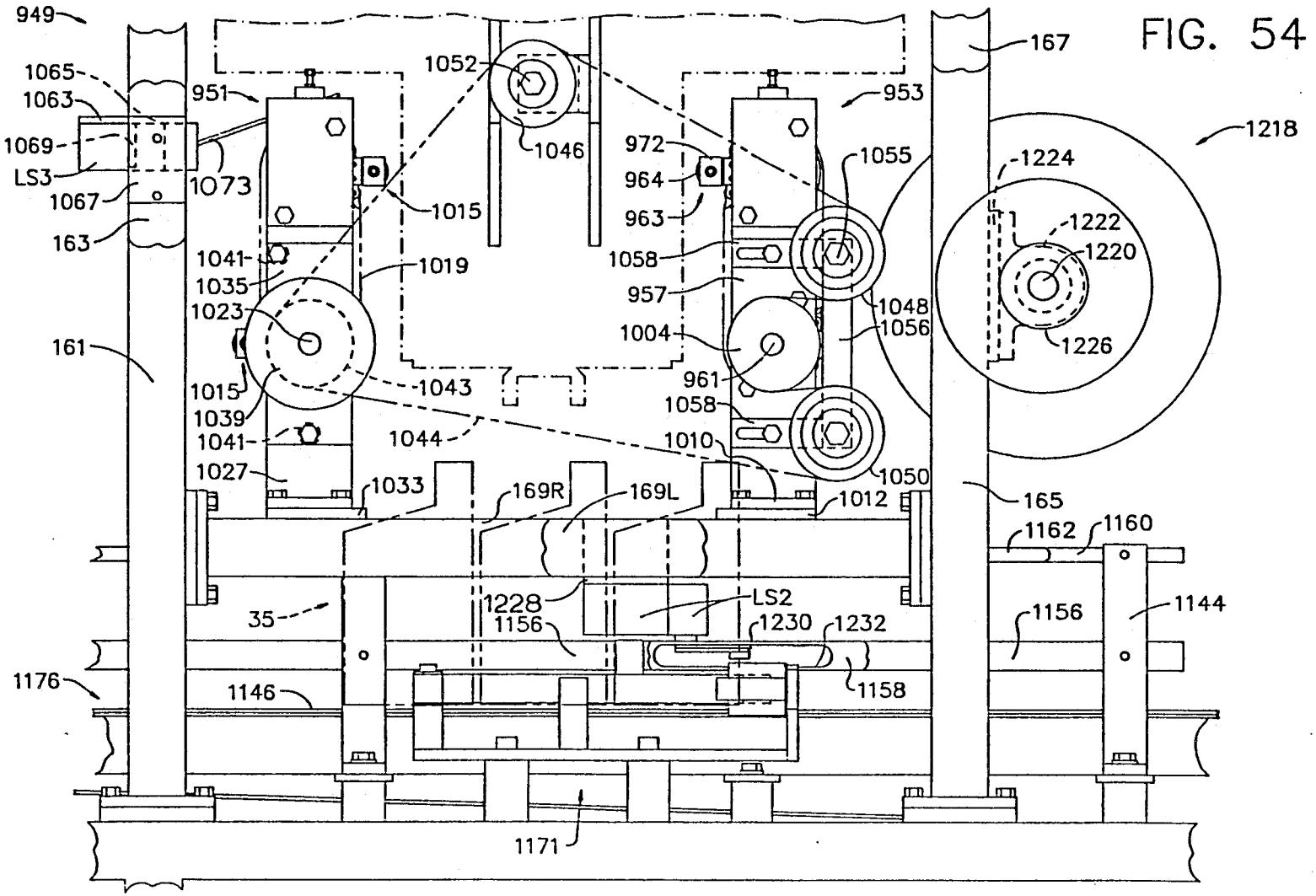
FIG. 54 is a fragmentary side elevational view which shows details of structure of a case conveyor of the machine.

The tamp-down drum 1218 is shown in FIGS. 51 and 54. The tamp-down drum 1218 is a purchased cast part that is fixedly attached upon the center span of a tamp-down shaft 1220 that is in turn rotatably mounted in a pair of bearings 1222. The pair of bearings 1222 is fixedly attached to a pair of nut pads 1224. The nut pads 1224 are in turn rigidly affixed to the output surface of the right and left output posts 165 and 167 of the inserter frame 47. The right end of the tamp-down shaft 1220 extends to the right from the right hand member of the pair of bearings 1222 to fixedly accommodate a drive sprocket 1226. The main drive assembly (not shown in detail) drives the tamp-down drum 1218 counterclockwise (FIG. 54) at such a rotational speed so as to match the surface speed thereof with the linear speed of the oil case 35.

While the oil case is under the inserter section 22, it makes LH-2 (FIG. 56). The next succeeding oil case makes LH-1 as it starts to pass to the continuous conveyor 1076, and the advance of the intermittent conveyor 74 is arrested until the first case 35 has departed from beneath the inserter section 22. In this manner, a sufficient separation is maintained between oil cases.

The limit switch LS-2 (FIG. 54) is fixedly mounted upon the lower right surface of a vertical plate 1228 that is fixedly attached at its upper end to the left side of the left longitudinal bar 169L of the inserter frame 47, and longitudinally positioned so a switch arm and roller 1230 thereof cooperates with a longitudinal slot 1232 in the left lower guide bar 1158. This allows the switch roller to protrude inboardly of the right surface of the left lower guide bar 1158 far enough to make contact with an oil case 35 and make the switch LS-2 when the oil case is in position to receive a partition. When the case 35 has received a partition, the case is discharged onto the output conveyor 39 (FIG. 1, not shown in detail). When the case has been discharged, the case 35, the bottles in the case, and the partition can be surrounded by an appropriate shrink pack (not shown).

The machine for folding and inserting a partition and the partition for a carton which are illustrated in the drawings and described above are subject to structural modification without departing from the spirit and scope of the appended claims.

Having described our invention, what we claim as new and desire to secure by letters patent is:

1. A machine for folding and shaping a partition for a case which carries a plurality of articles and for inserting the partition between articles in the case which comprises hopper means for holding a plurality of the partitions in flat position, each of the partitions having slot means substantially centrally thereof, vacuum cup means for gripping one of the partitions, a flight conveyor, flight means on the flight conveyor for engaging said one of the partitions at the slot means, means for advancing the vacuum cup means in a direction to free said one of the partitions from the hopper and to bring said one of the partitions into position for engagement by the flight means, means for advancing the flight conveyor to advance said one of the partitions to a folding station, means at the folding station for folding the partition centrally thereof into two substantially face-to-face sections, means for advancing the flight conveyor to advance the folded partition to a forming and insertion stations, means for advancing a case having a plurality of articles therein to a loading station below the forming and insertion stationl, forming elements between the forming and insertion station and the loading station, means for advancing the flight conveyor to advance the folded partition into engagement with said forming elements to form the partition to erect position, and insertion conveyor means for advancing the formed partition from the forming elements into alignment with the ariticles in the case to separate the articles in the case.

2. A machine as in claim 1 in which the slot means in the partition crosses a fold line at which the partition is folded, the flight means engaging a portion of the slot means in an upper section of the partition as the partition is folded, a lower portion of the slot means being advanced toward the flight means as the lower section of the partition if folded, and means for folding the lower section of the partition upwardly to folded position at which the lower portion of the slot means is inverted with the central portion of the slot means being lowermost and open and flight means can bear on upper portions of the slot means.

3. A machine as in claim 2 in which the means for folding the lower section of said one of the partitions upwardly includes first and second drive chains on opposite sides of said one of the partitions when at the folding station, and dog member means mounted on the first and second drive chains and engageable with the lower section of said one of the partitions to fold the lower section to folded position.

4. A machine as in claim 1 in which the forming elements include wedge members engageable by the sections of the folded partition to separate portions of the sections, core frames receiving the separated portions, and guide assembly elements holding the separate portions in engagement with the core frames to hold the partition is erect position, the insertion conveyor means being engageable with the partition when held by the core frames to discharge the partition from the core frame.

5. A machine for folding and shaping a partition for a case which carries a plurality of articles and for inserting the partition between articles in the case which comprises hopper means for holding a plurality of the partitions in flat position, each of the partitions having slot means substantially centrally thereof, means for gripping on eof the partitions, a flight conveyor, flight means on the flight conveyor for engaging said one of the partitions at the slot means, mean for advancing the gripping means in a direction to free said one of the partitions from the hopper and to bring said one of the partitions into position for engagement by the flight means, means for advancing the flight conveyor to advance said one of the partitions to a folding station, means at the folding station for folding the partition centrally thereof into two substantially face-to-face sections, means for advancing the flight conveyor to advance the folded partition to a forming and insertion station, means for advancing a case having a plurality of articles therein to a loading station below the forming and insertion station, forming elements between the forming and insertion station and the loading station, means for advancing the flight conveyor to advance the folded partition into engagement with said forming elements to form the partition to erect position, and insertion conveyor means for advancing the formed partition from the forming elements into alignment with the articles in the case to separate the articles in the case.

6. A machine as in claim 5 in which the forming elements include wedge members engageable by the sections of the folded partition to separate portions of the sections, core frames receiving the separated portions, and guide assembly elements holding the separate portions in engagement with the core frames to hold the partition in erect position, the insertion conveyor means being engageable with the partition when held by the core frames to discharge the partition from the core frames.

* * * * *